US011026496B2

(12) United States Patent
Hasegawa et al.

(10) Patent No.: US 11,026,496 B2
(45) Date of Patent: Jun. 8, 2021

(54) MASCARA COMB

(71) Applicant: AMG Co., Ltd., Tokyo (JP)

(72) Inventors: Hiroki Hasegawa, Tokyo (JP); Sung Joon Kang, Gunpo-si (KR)

(73) Assignee: AMG CO., LTD., Tokyo (JP)

( * ) Notice: Subject to any disclaimer, the term of this patent is extended or adjusted under 35 U.S.C. 154(b) by 0 days.

(21) Appl. No.: 16/644,115

(22) PCT Filed: Jun. 7, 2019

(86) PCT No.: PCT/JP2019/022829
§ 371 (c)(1),
(2) Date: Mar. 3, 2020

(87) PCT Pub. No.: WO2020/095473
PCT Pub. Date: May 14, 2020

(65) Prior Publication Data

US 2021/0000242 A1 Jan. 7, 2021

(30) Foreign Application Priority Data

Nov. 9, 2018 (WO) ..... PCT/JP2018/041755

(51) Int. Cl.
*A45D 40/26* (2006.01)
*A46B 9/02* (2006.01)

(52) U.S. Cl.
CPC ..... *A45D 40/265* (2013.01); *A46B 9/021* (2013.01); *A46B 9/025* (2013.01); *A46B 2200/1053* (2013.01)

(58) Field of Classification Search
CPC .. A45D 40/262; A45D 40/265; A45D 40/267; A45D 34/00; A45D 34/04;
(Continued)

(56) References Cited

U.S. PATENT DOCUMENTS

2008/0115798 A1 5/2008 Rainey et al.
2011/0041863 A1* 2/2011 Roualdes ..... A45D 40/262 132/114

(Continued)

FOREIGN PATENT DOCUMENTS

JP 2003-259914 A 9/2003
JP 2006-034497 A 2/2006

(Continued)

*Primary Examiner* — Rachel R Steitz
*Assistant Examiner* — Karim Asqiriba
(74) *Attorney, Agent, or Firm* — Muncy, Geissler, Olds and Lowe, P.C.

(57) ABSTRACT

A mascara comb allows a user to quickly apply mascara liquid to the eyelashes without forming clumps. On the upper surface of the mascara comb a plurality of protrusion elements are disposed so as to form a plurality of rhombus structures; the rhombus structures are configured so as to form a predetermined gap for applying the mascara liquid to the eyelashes while combing the eyelashes, wherein a diagonal line in the axial direction of the comb portion forms a rhombus longer than a diagonal line in the orthogonal direction orthogonal thereto; further, the rhombus structures function as a velocity adjustment mechanism for making the velocity with which the mascara liquid flows in the axial direction slower than the velocity with which the mascara liquid flows in the orthogonal direction; and the inside of the rhombus structures are a holding portion having a function of holding the mascara liquid.

4 Claims, 47 Drawing Sheets

(58) Field of Classification Search
CPC ..... A45D 34/042; A45D 2200/157; A45D 44/18; A46B 9/00; A46B 9/02; A46B 9/06; A46B 9/023; A46B 9/025; A46B 9/026; A46B 9/028; A46B 2200/00; A46B 2200/1046; A46B 2200/1053; A46B 2200/106; A46B 1/00; A46B 3/00
See application file for complete search history.

(56) References Cited

U.S. PATENT DOCUMENTS

| | | | | |
|---|---|---|---|---|
| 2013/0121745 | A1* | 5/2013 | Tarling | A45D 40/265 401/1 |
| 2016/0360860 | A1 | 12/2016 | Berhault et al. | |
| 2017/0164718 | A1* | 6/2017 | Pires | A46B 3/005 |
| 2018/0027943 | A1* | 2/2018 | Rosario-Melendez | A45D 34/042 |
| 2018/0279740 | A1 | 10/2018 | Kukreja | |
| 2020/0245751 | A1* | 8/2020 | Thenin | A45D 40/267 |

FOREIGN PATENT DOCUMENTS

| | | | | |
|---|---|---|---|---|
| JP | 2006-296625 | A | 11/2006 | |
| JP | 4260674 | B2 | 4/2009 | |
| JP | 2010-227297 | A | 10/2010 | |
| JP | 2010227297 | * | 10/2010 | A45D 34/04 |
| JP | 2012-100929 | A | 5/2012 | |
| JP | 5756619 | B2 | 7/2015 | |
| KR | 20-0436831 | Y1 | 10/2007 | |

* cited by examiner

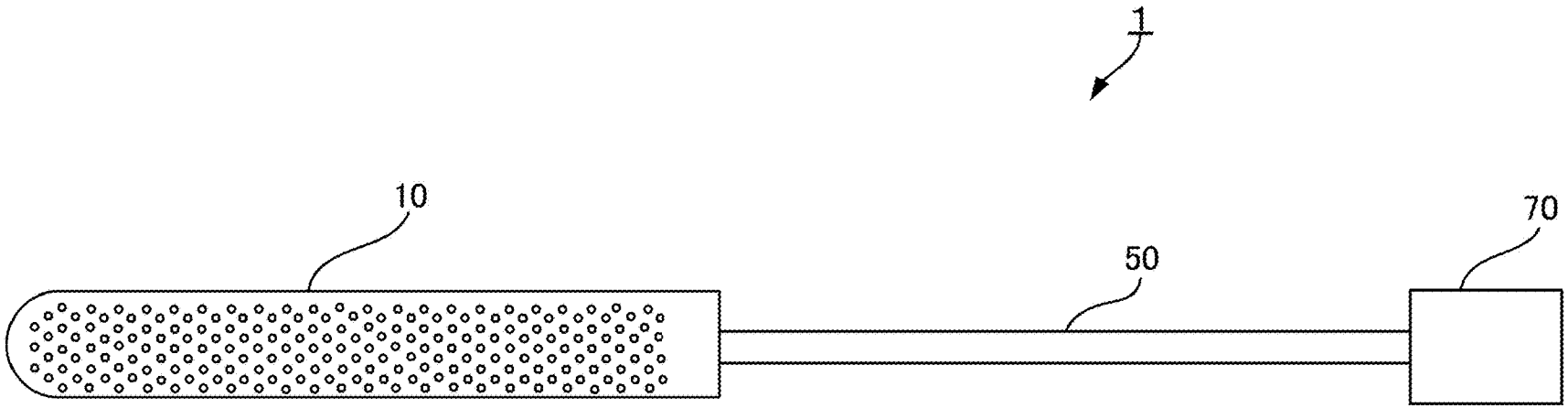
[Figure 1]

[Figure 2]
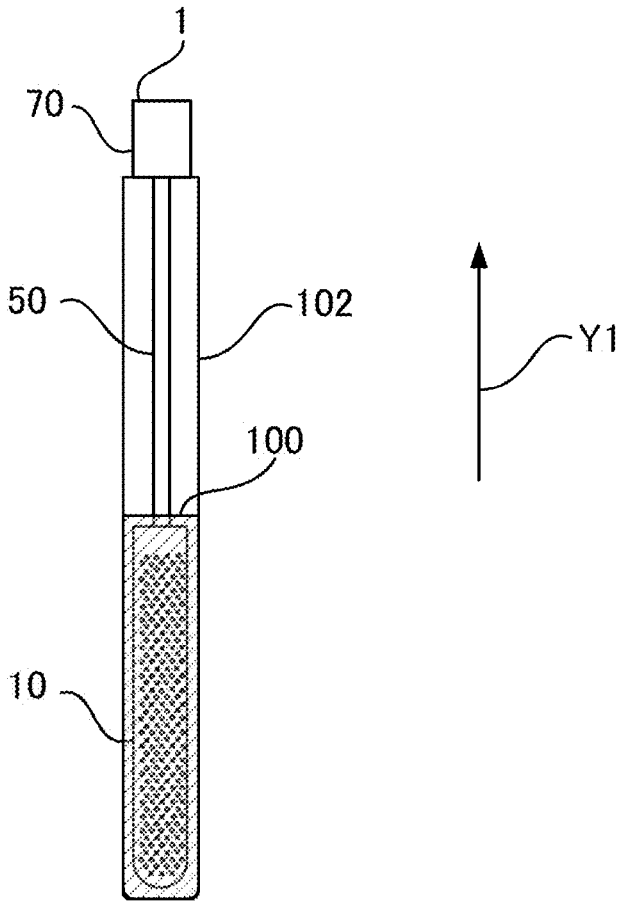

[Figure 3]
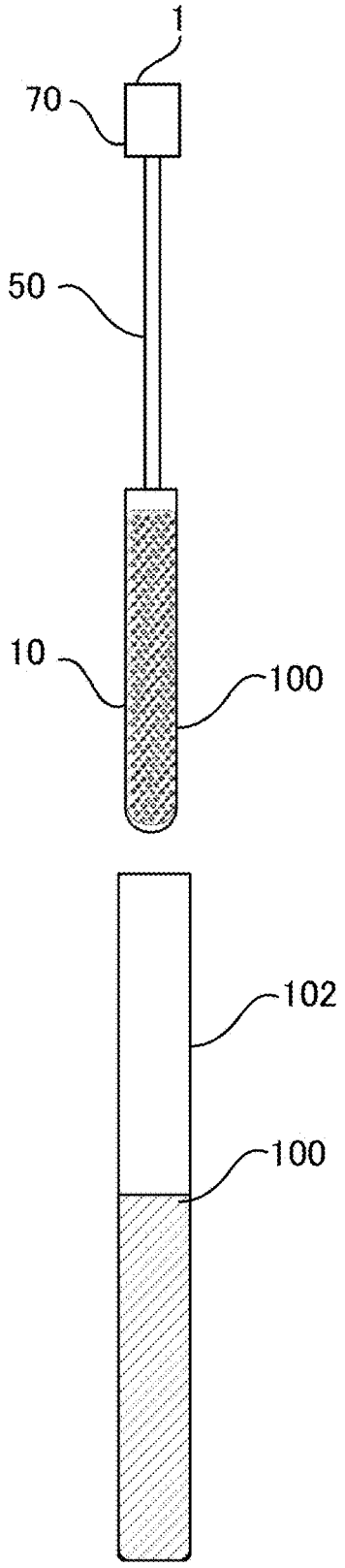

[Figure 4]
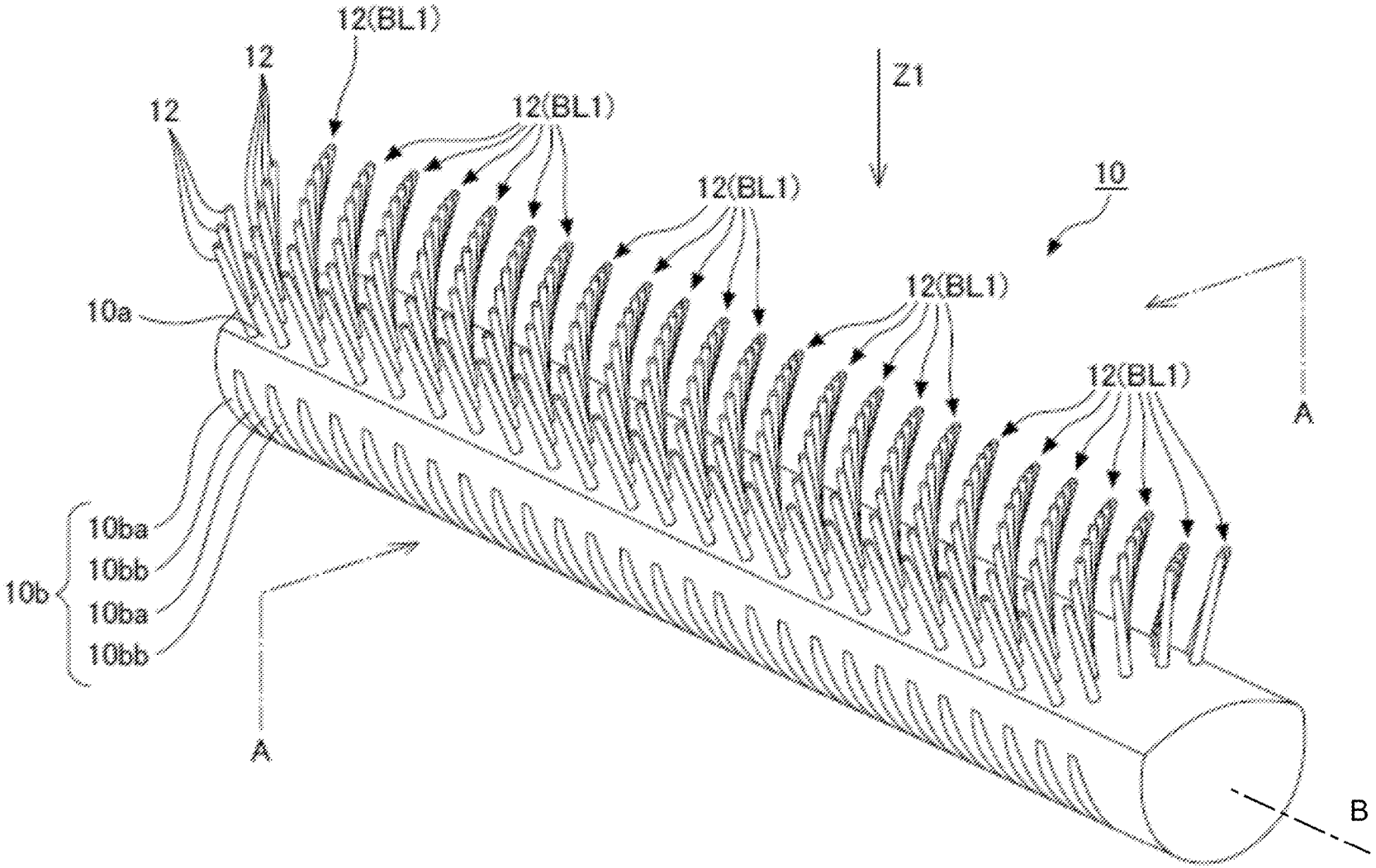

[Figure 5]
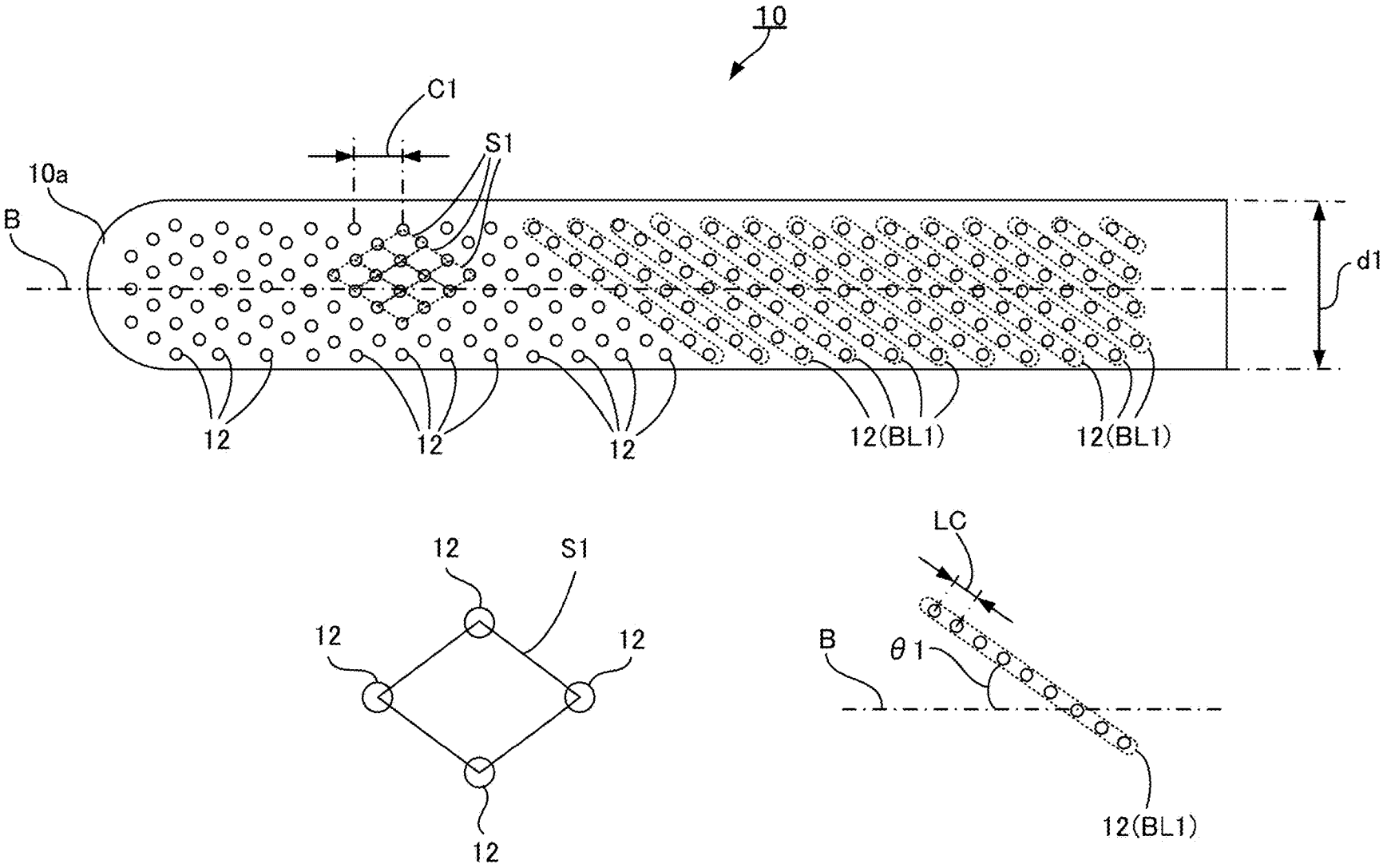

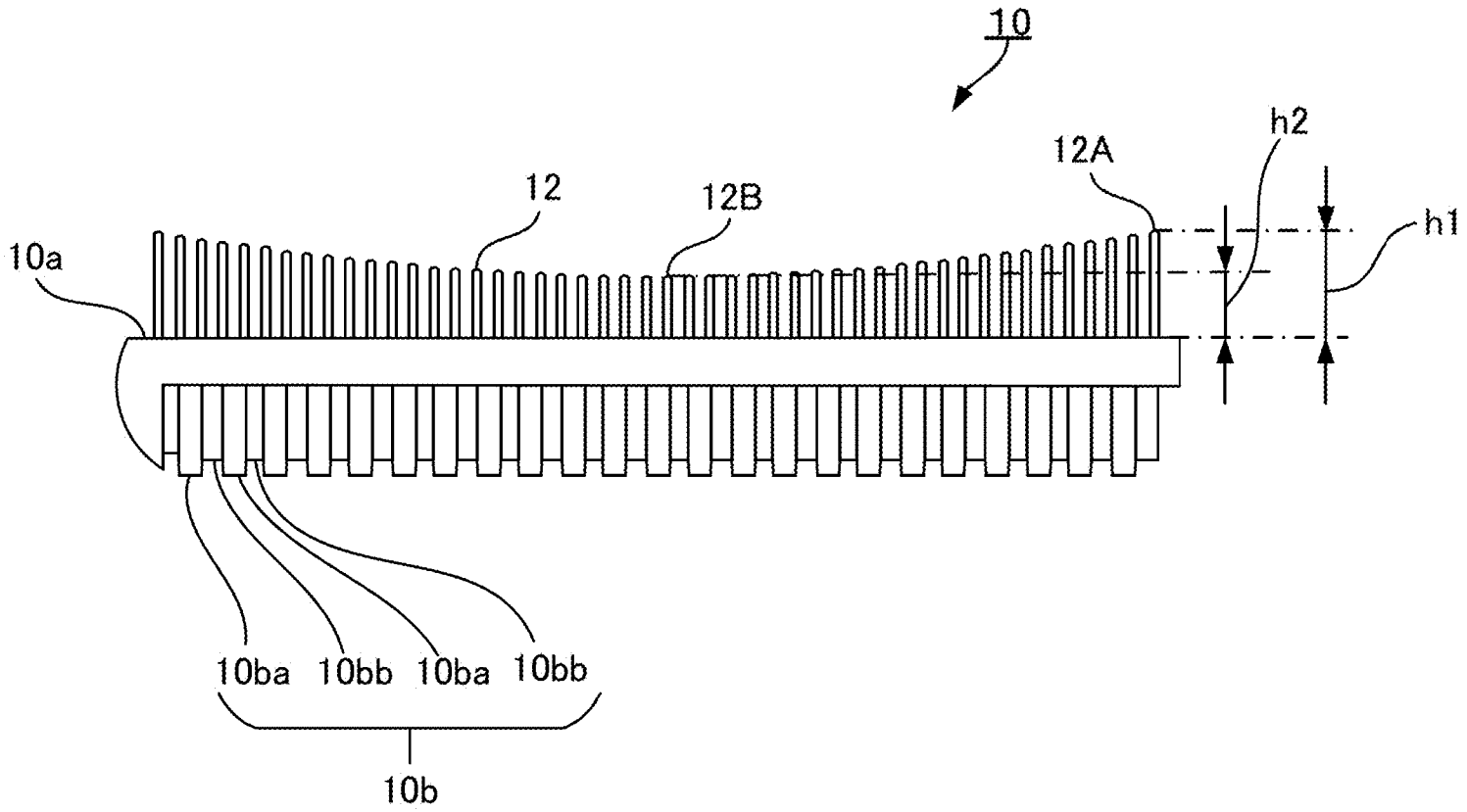
[Figure 6]

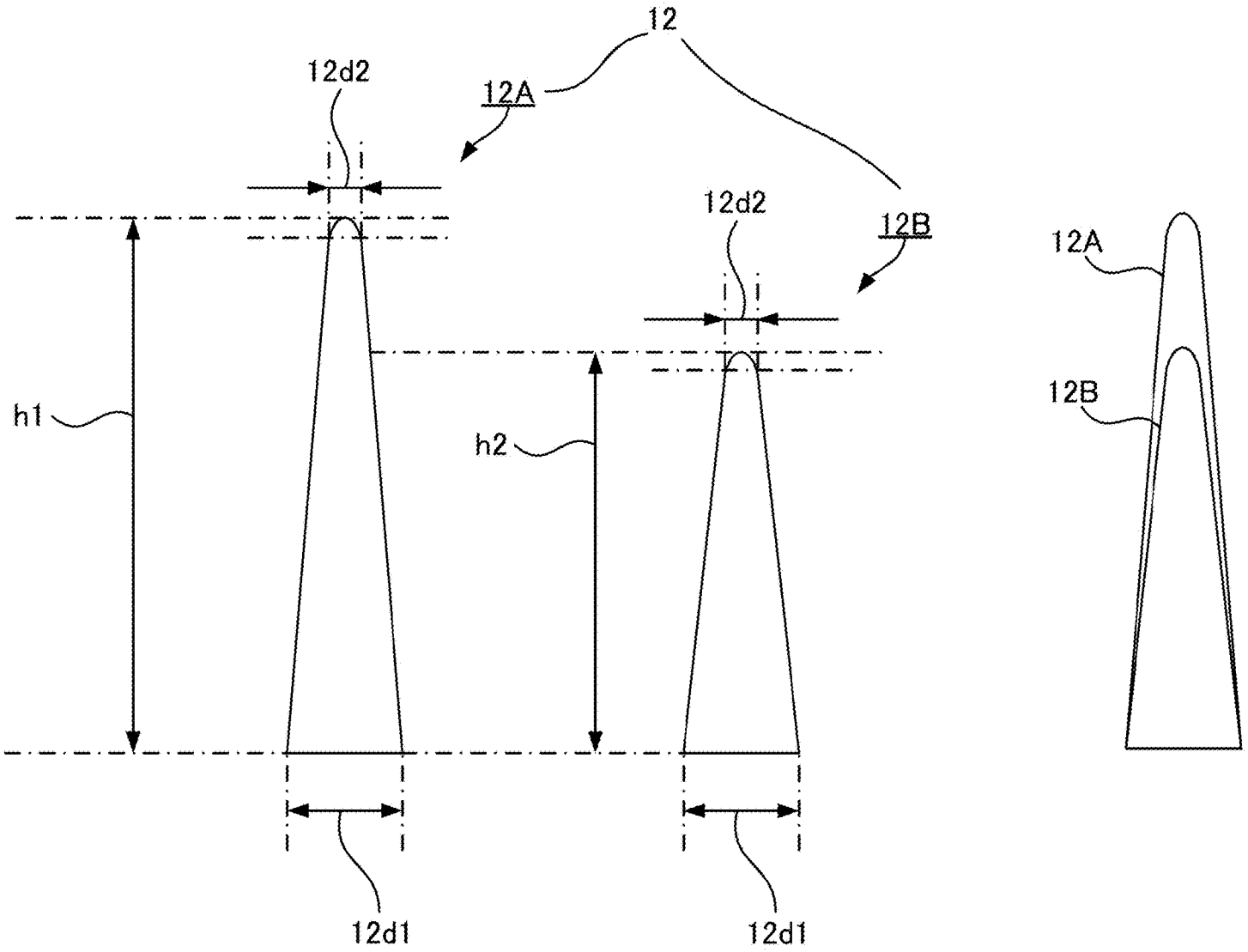
[Figure 7]

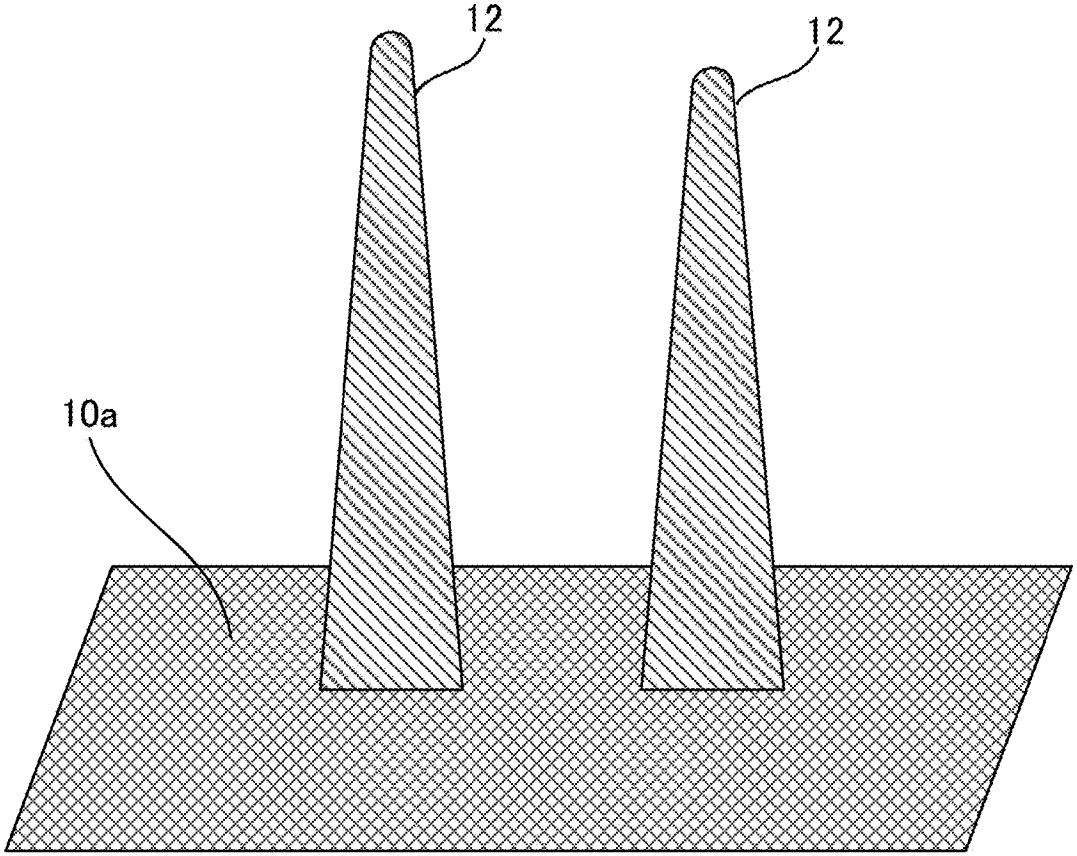
[Figure 8]

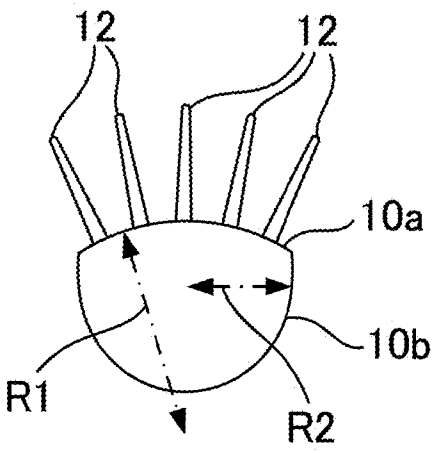
[Figure 9]

[Figure 10]
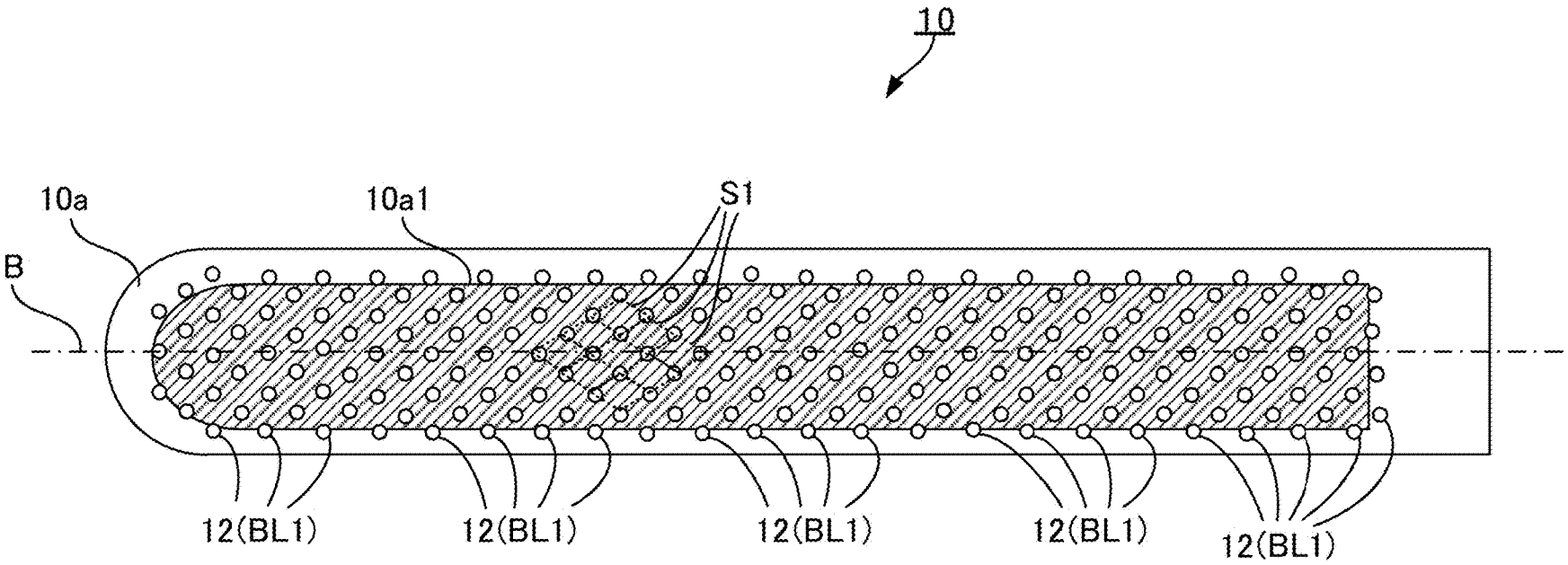

[Figure 11]
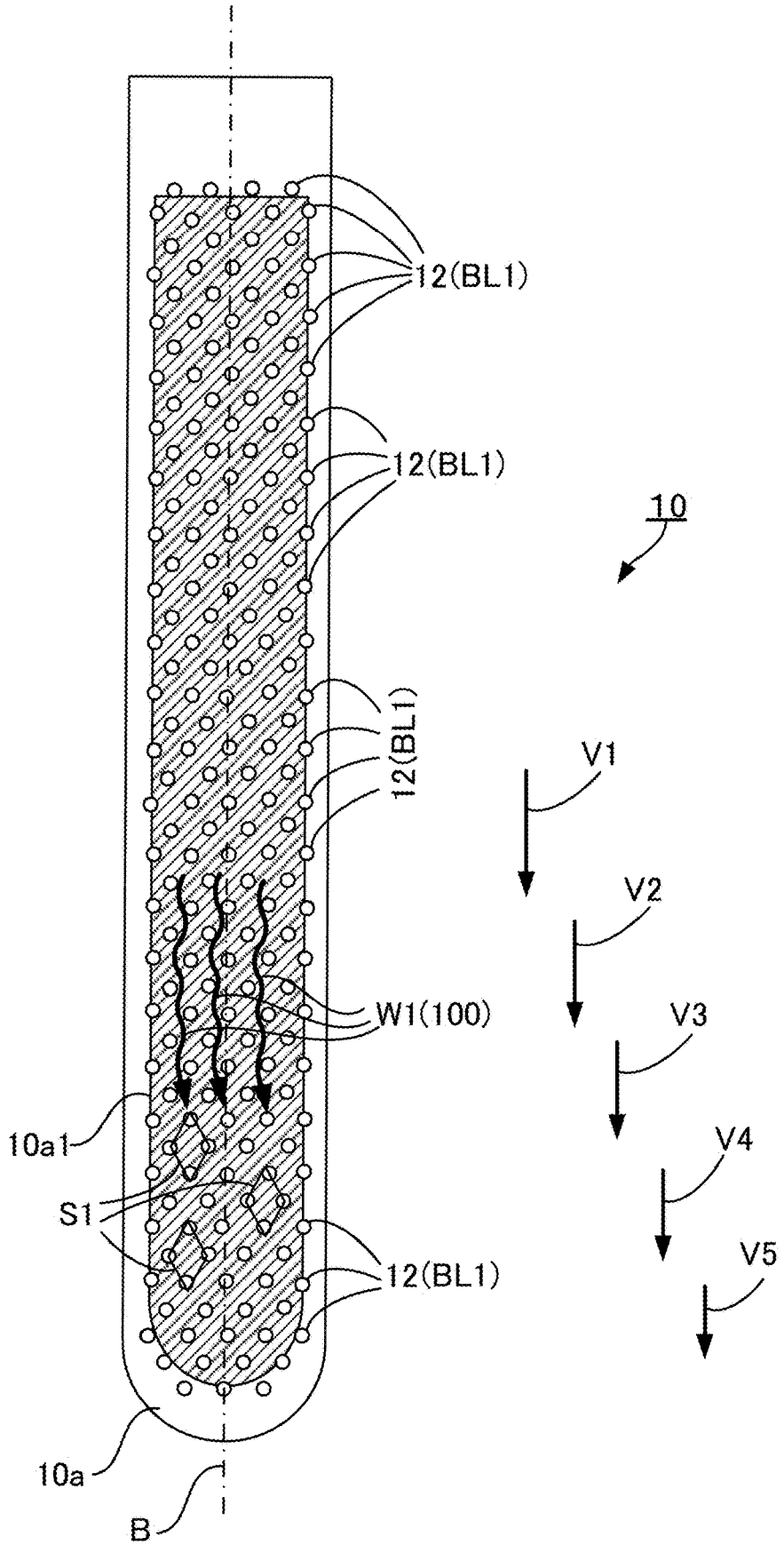

[Figure 12]
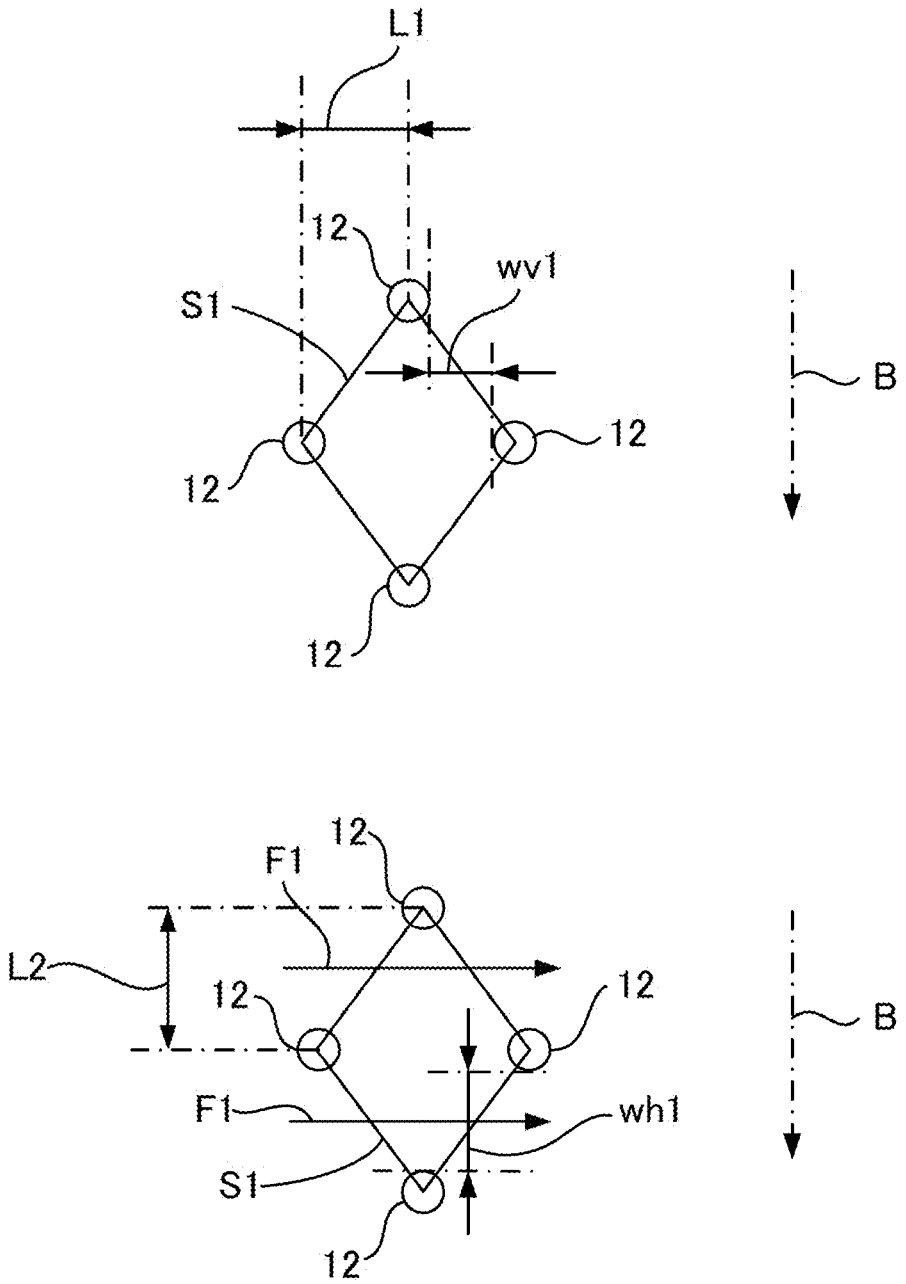

[Figure 13]
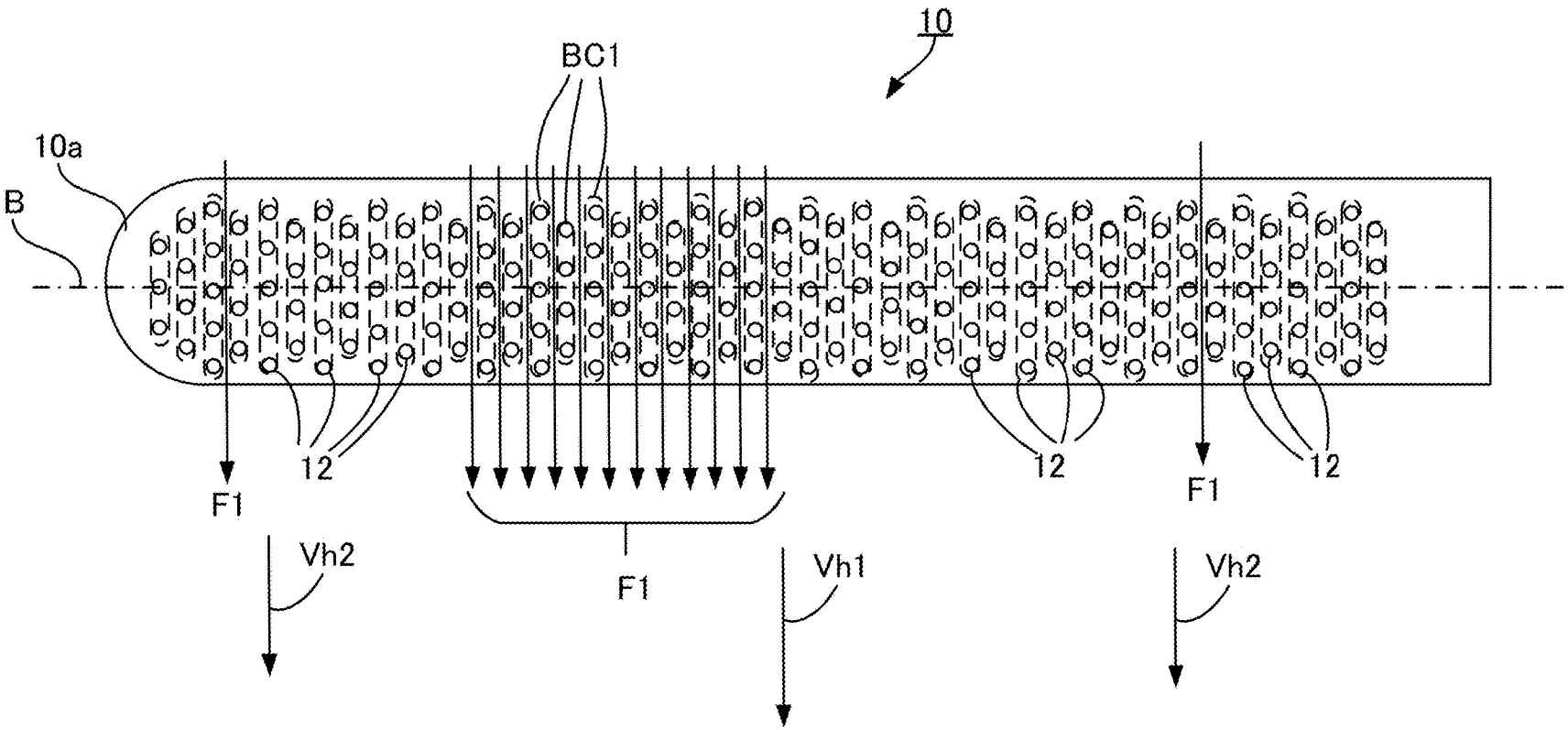

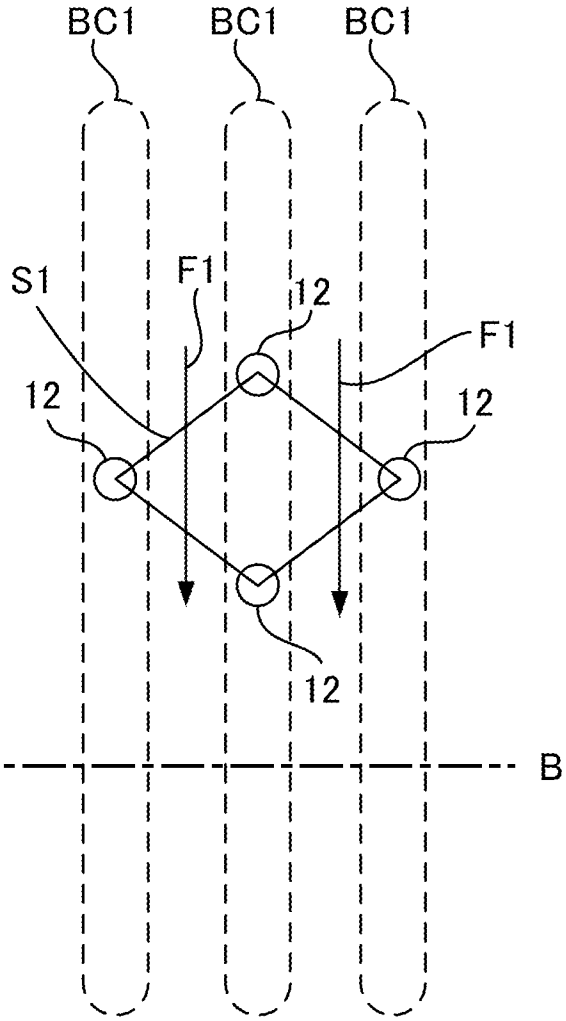
[Figure 14]

[Figure 15]
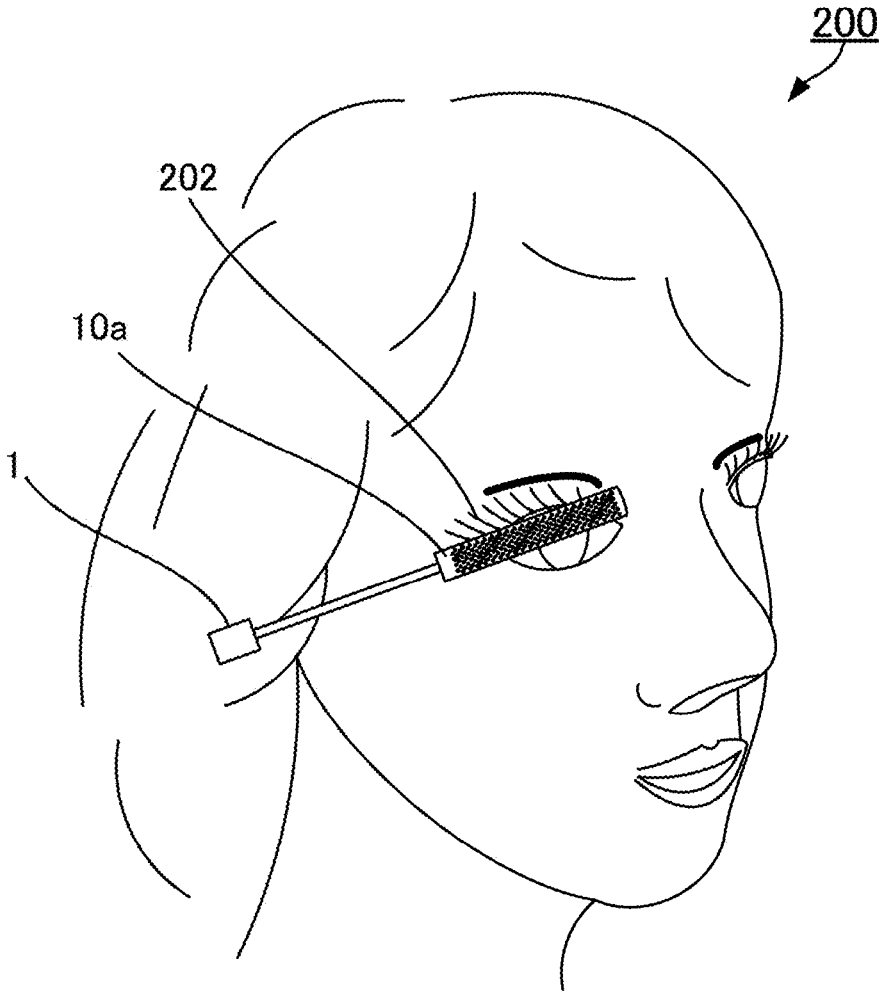

[Figure 16]
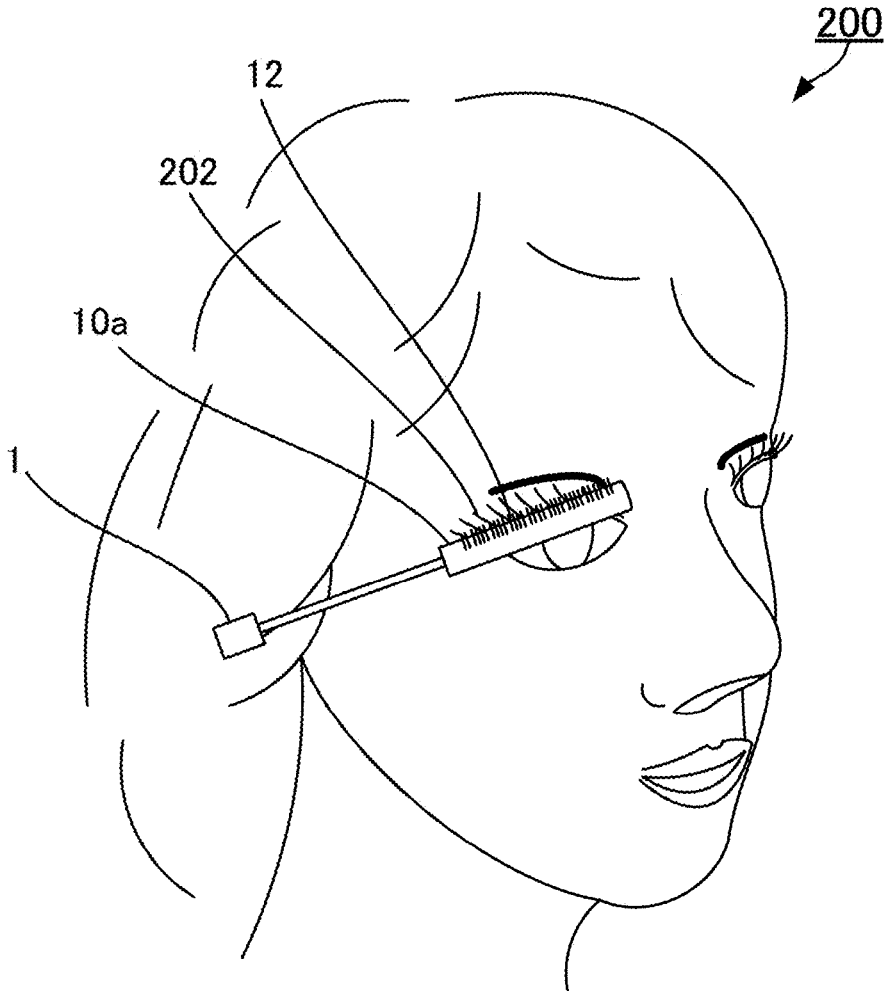

[Figure 17]
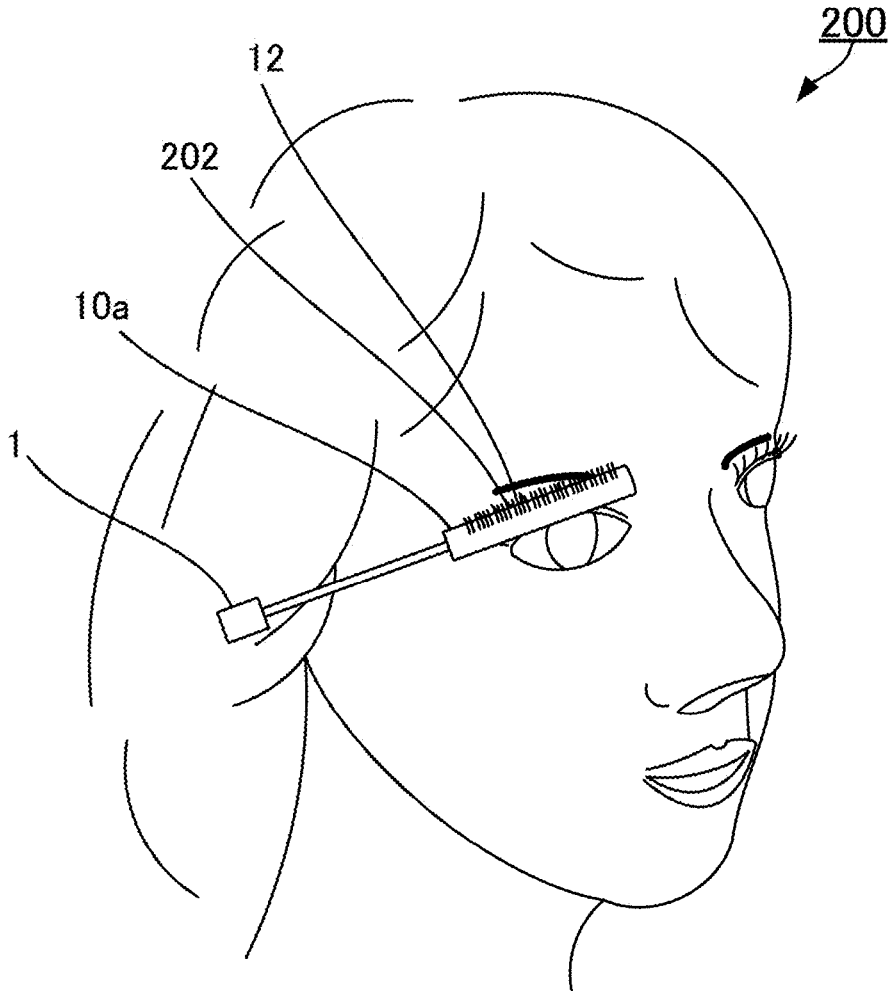

[Figure 18]
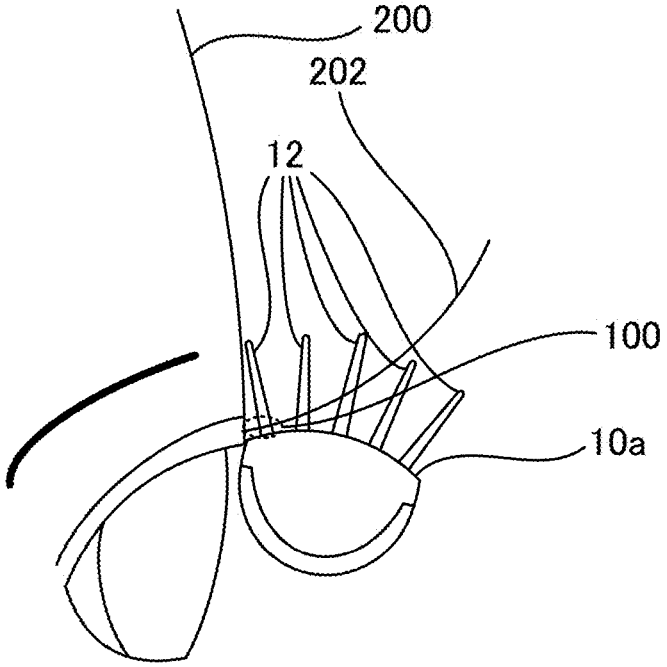
[Figure 19]
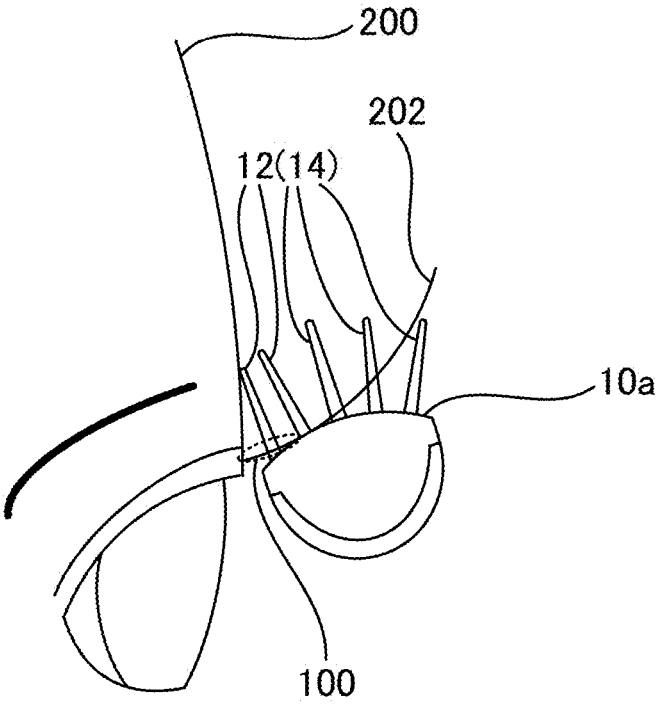

[Figure 20]
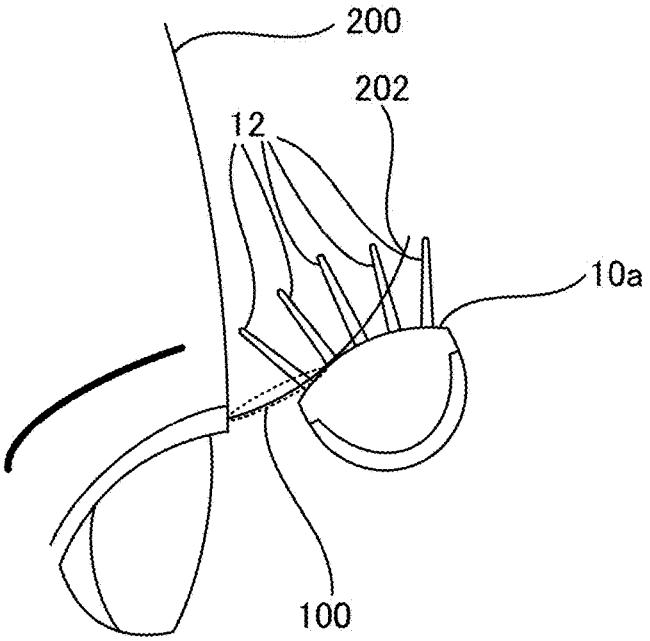
[Figure 21]
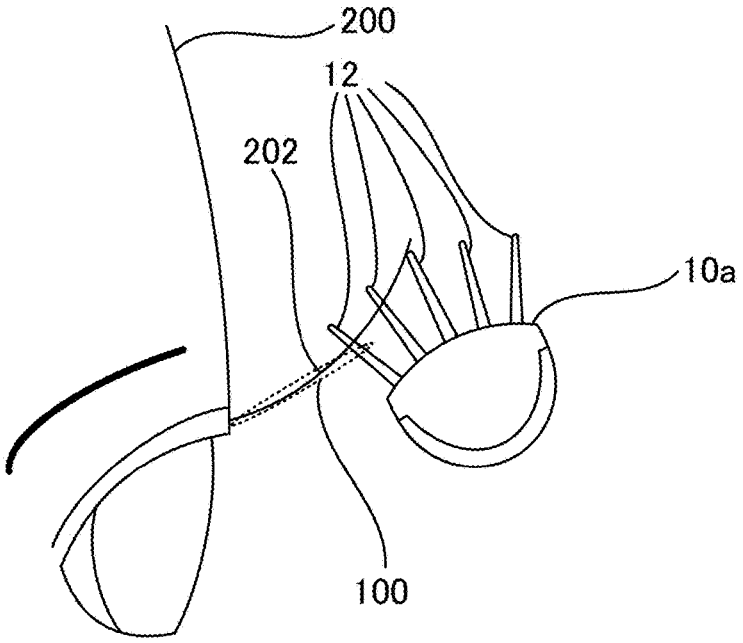

[Figure 22]
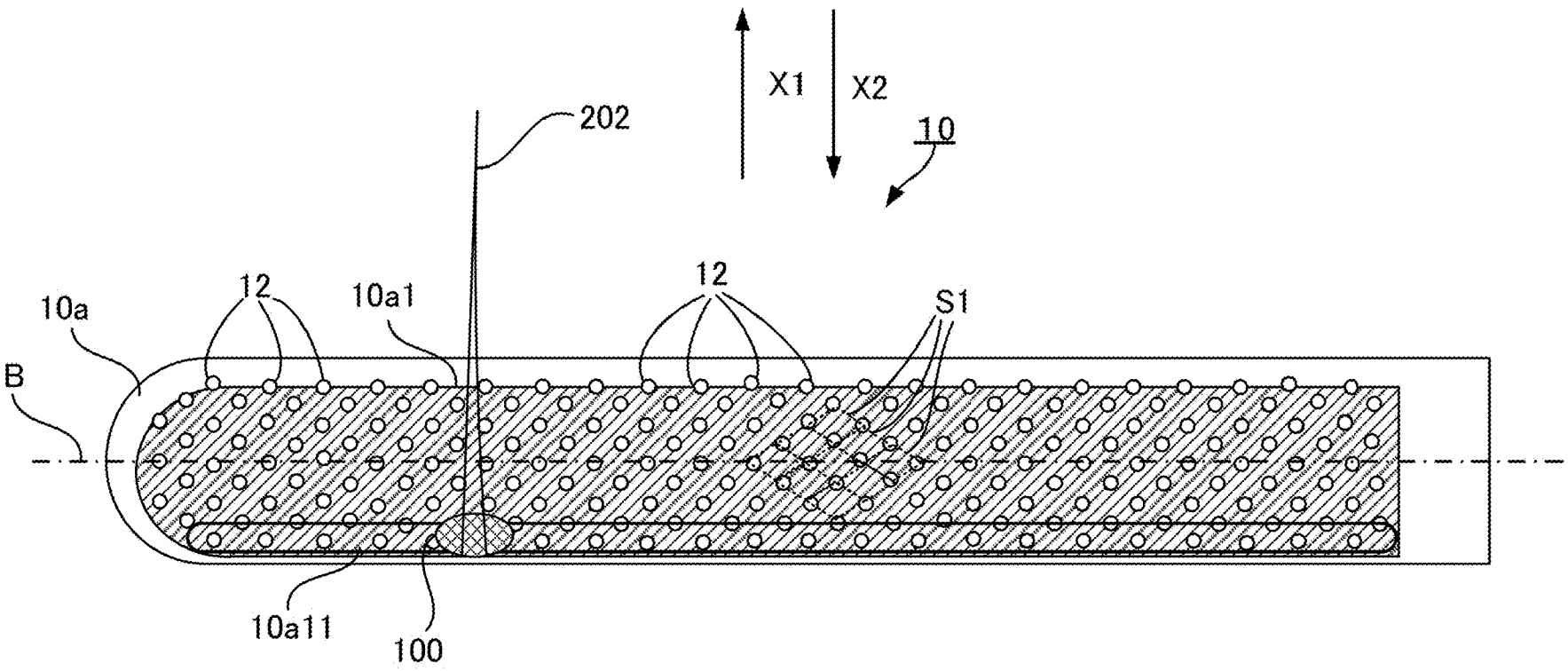

[Figure 23]
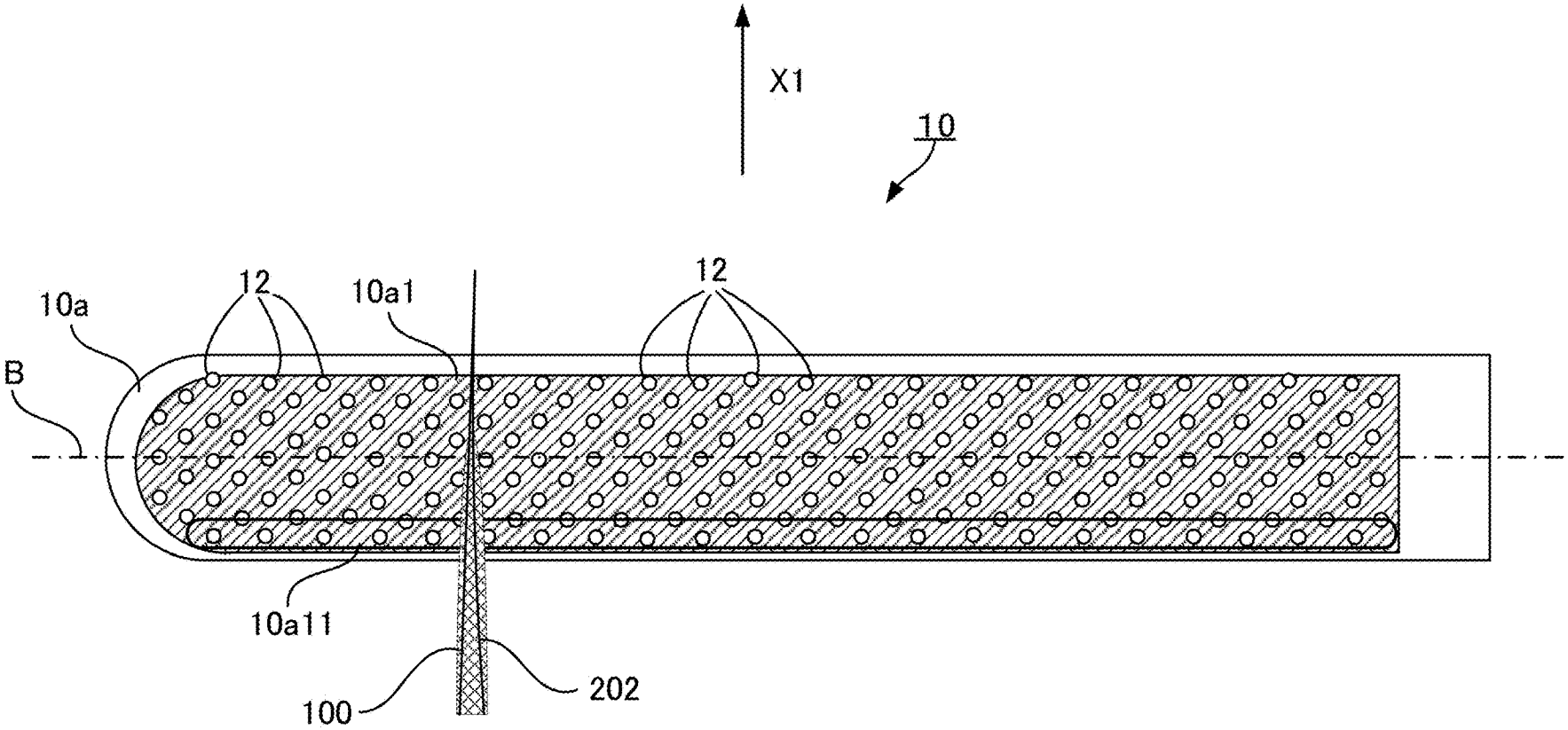

[Figure 24]
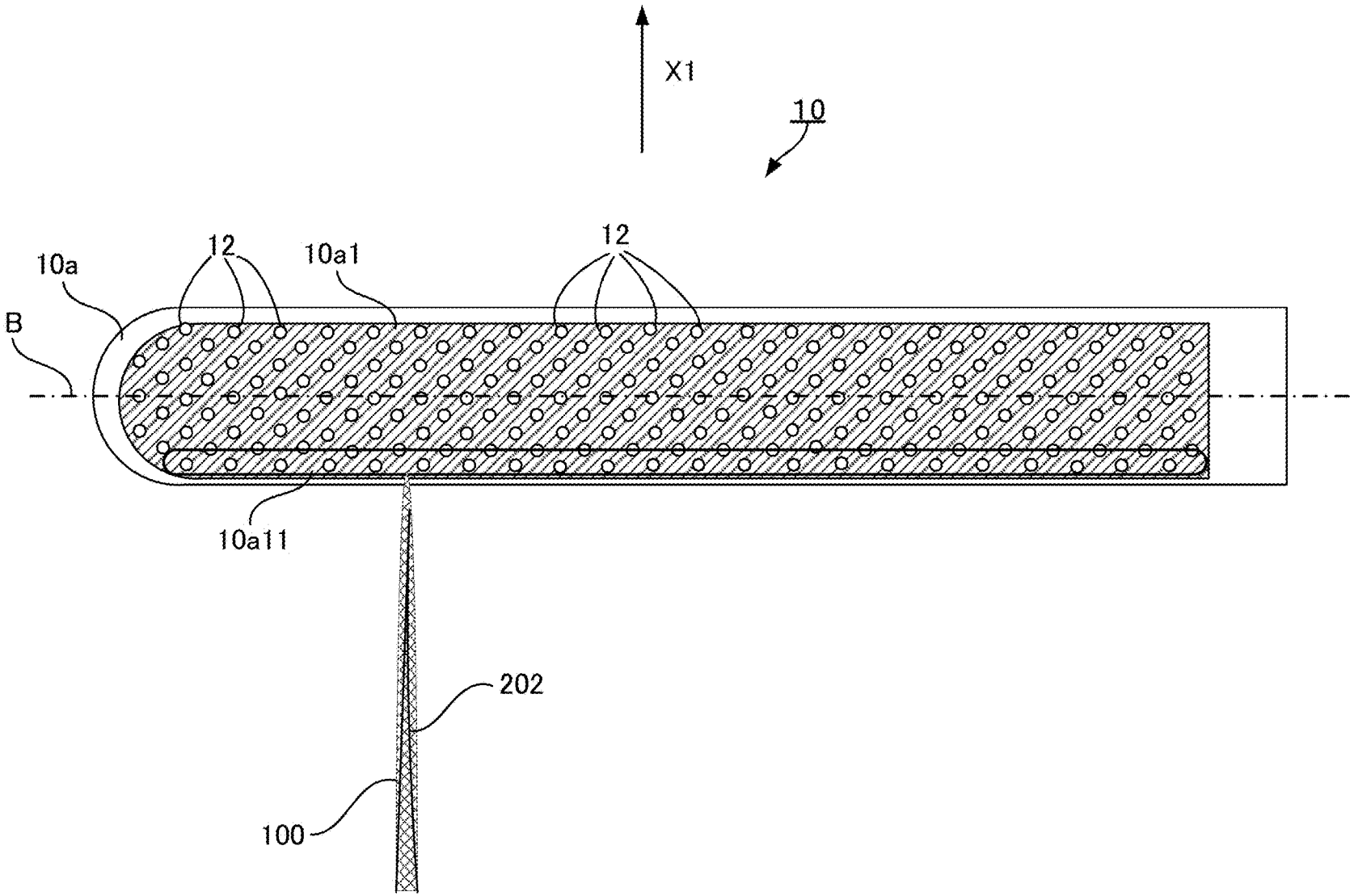

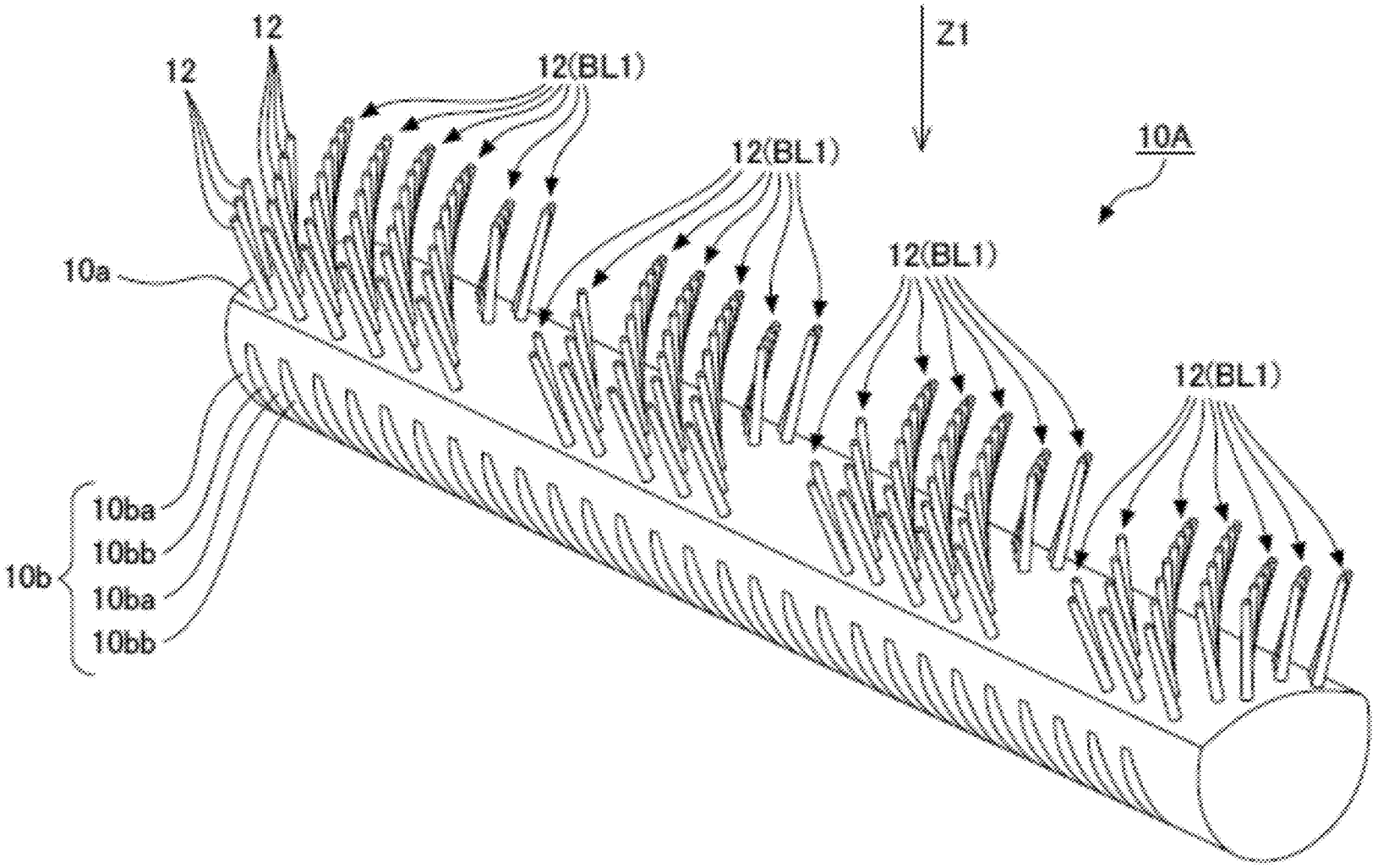
[Figure 25]

[Figure 26]
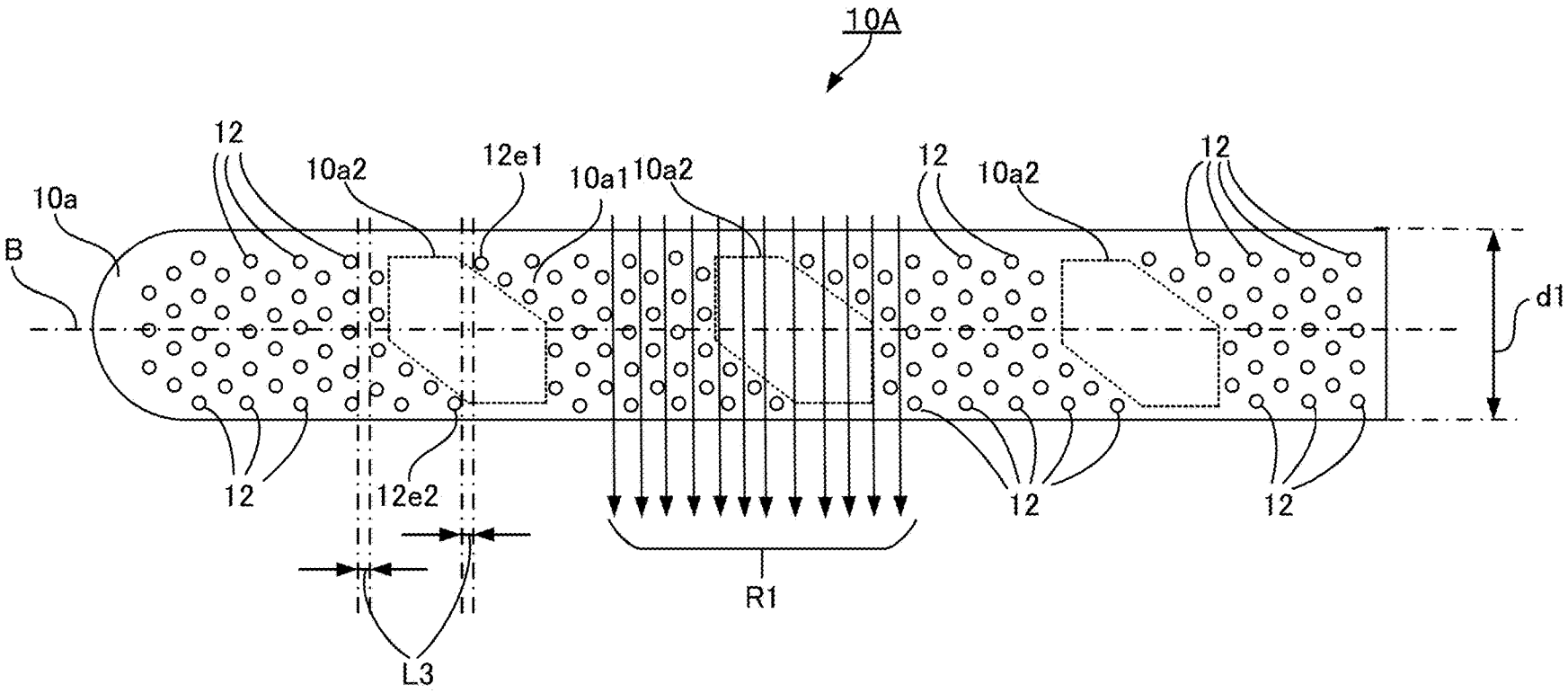

[Figure 27]
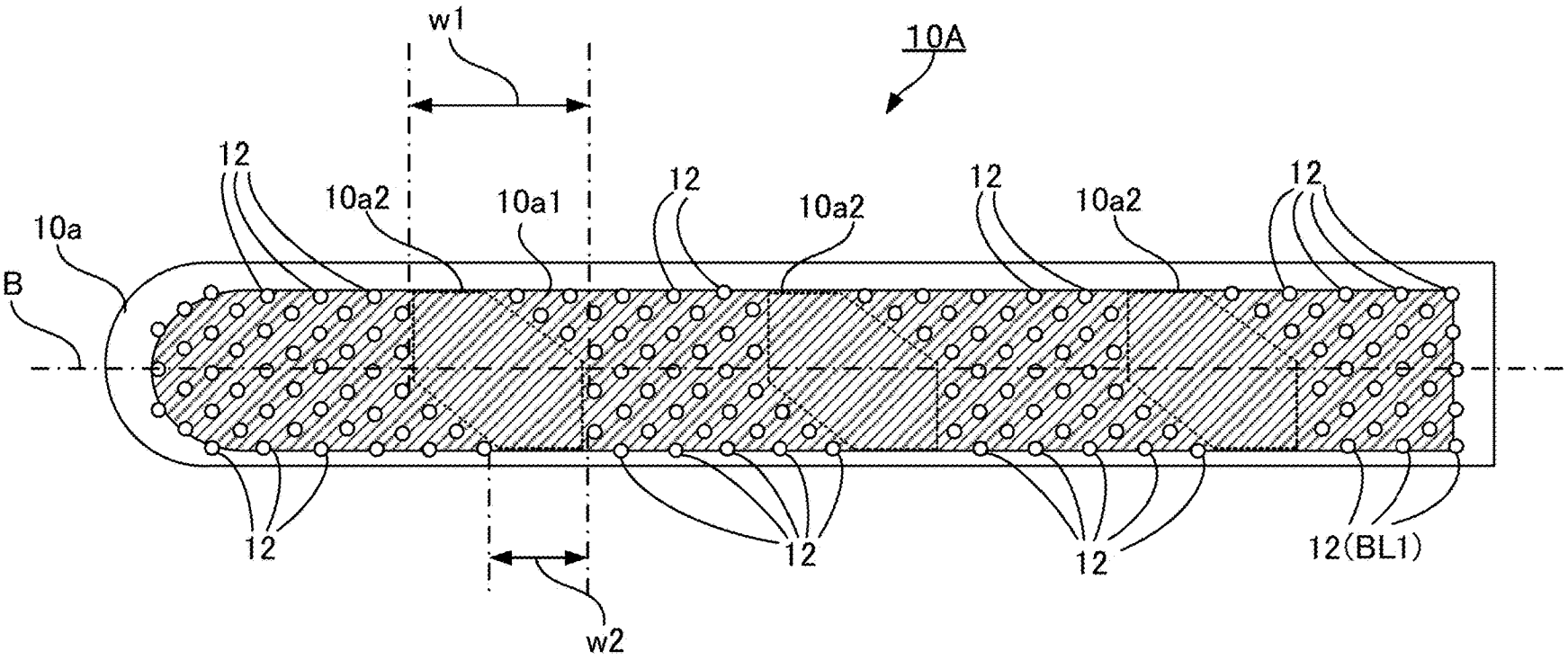

[Figure 28]
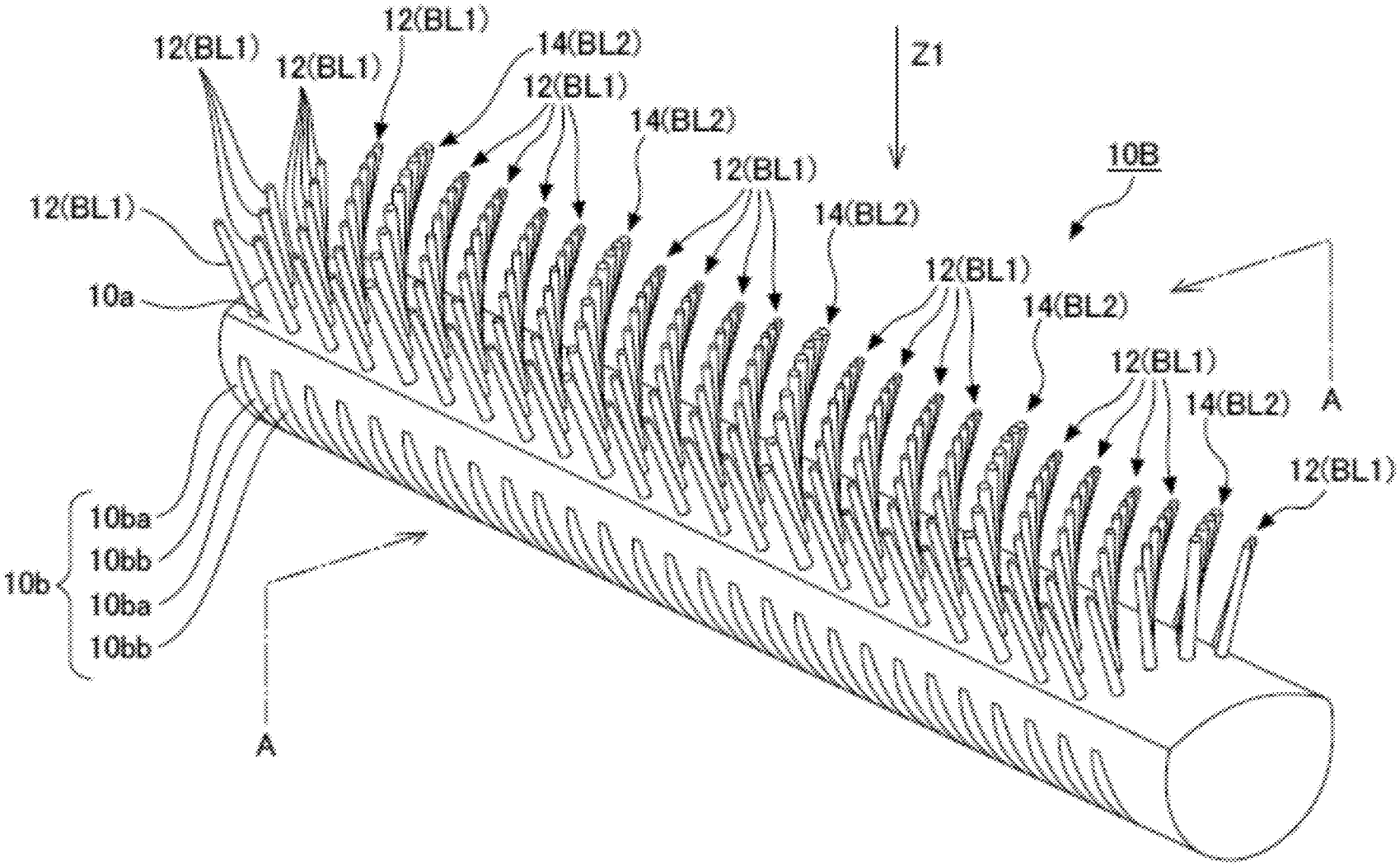

[Figure 29]
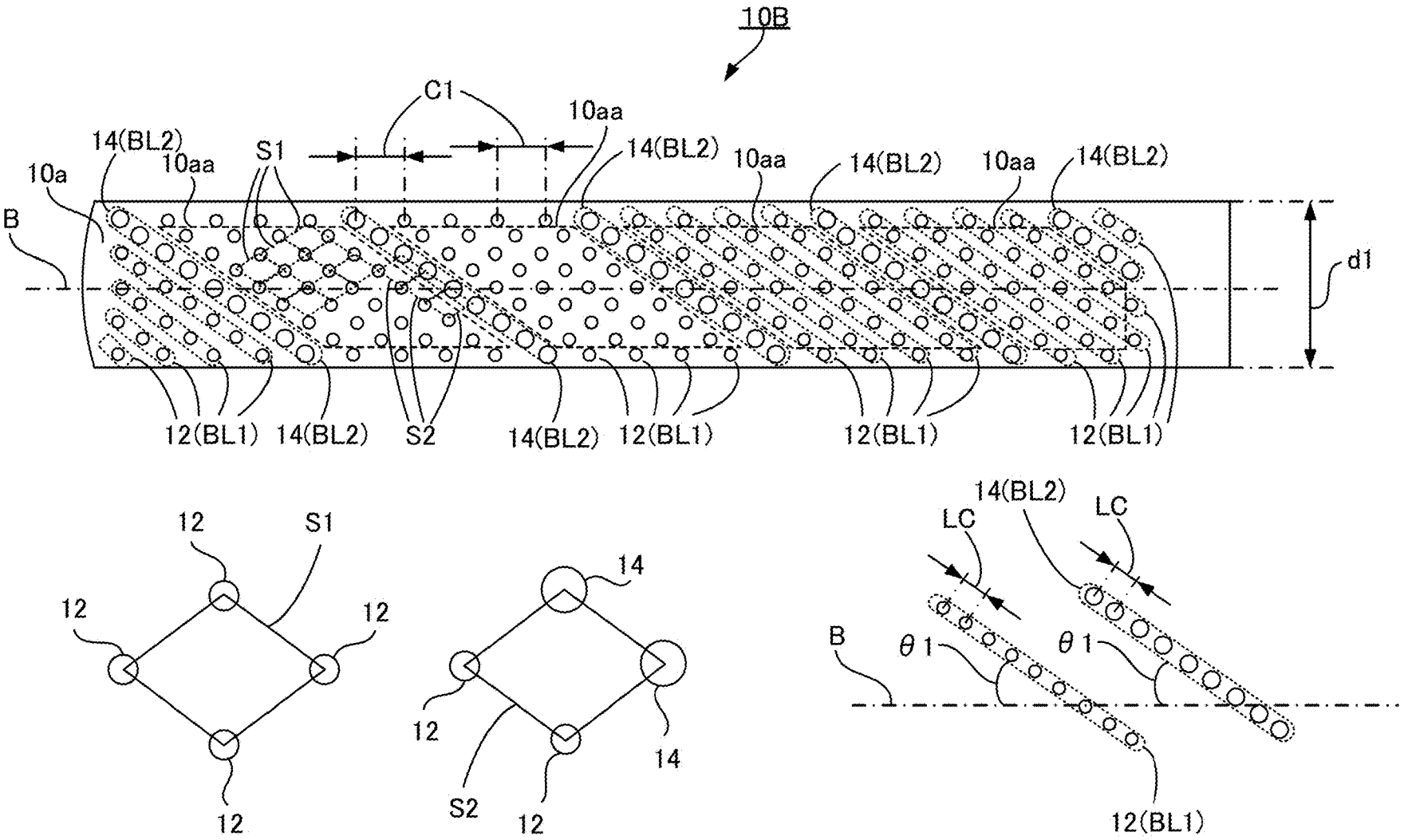

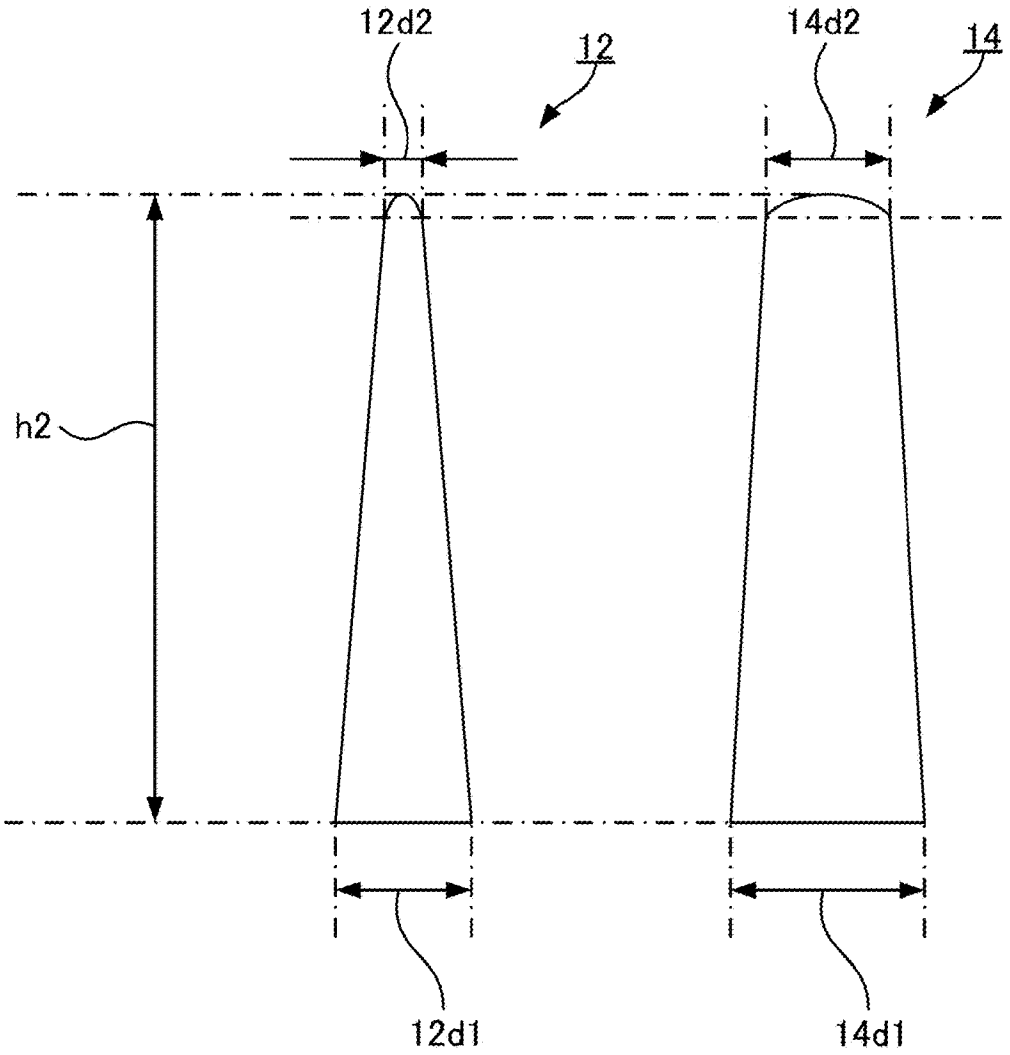
[Figure 30]

[Figure 31]
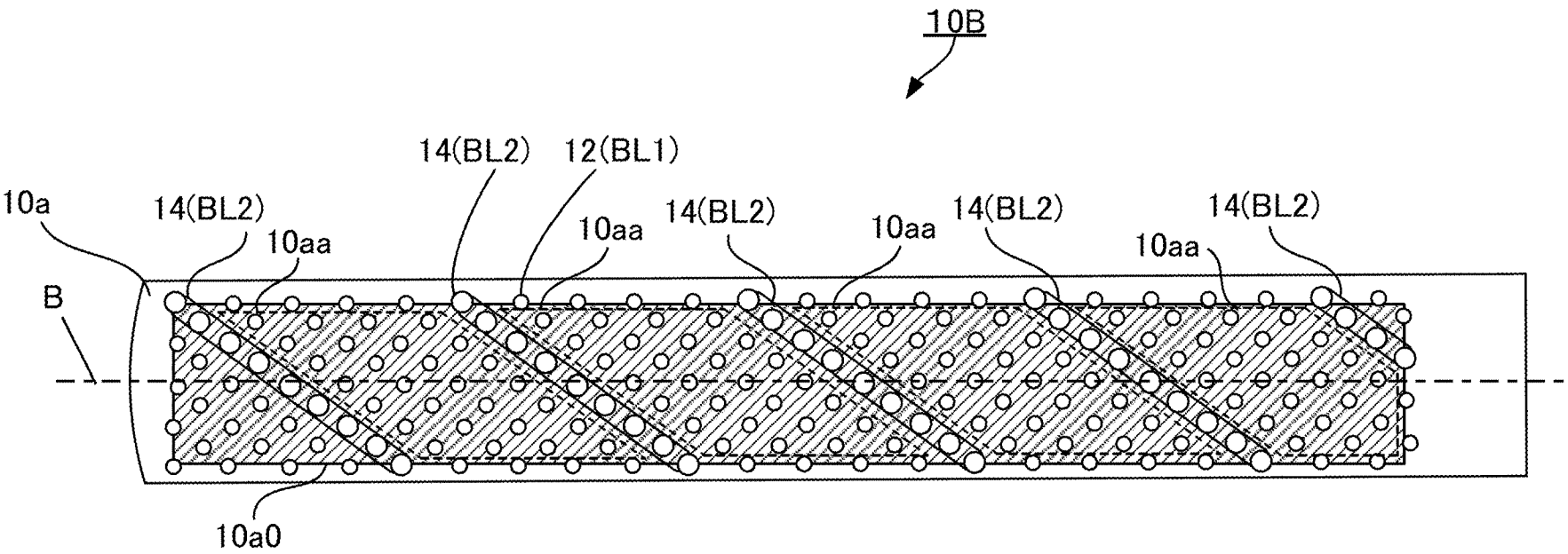

[Figure 32]
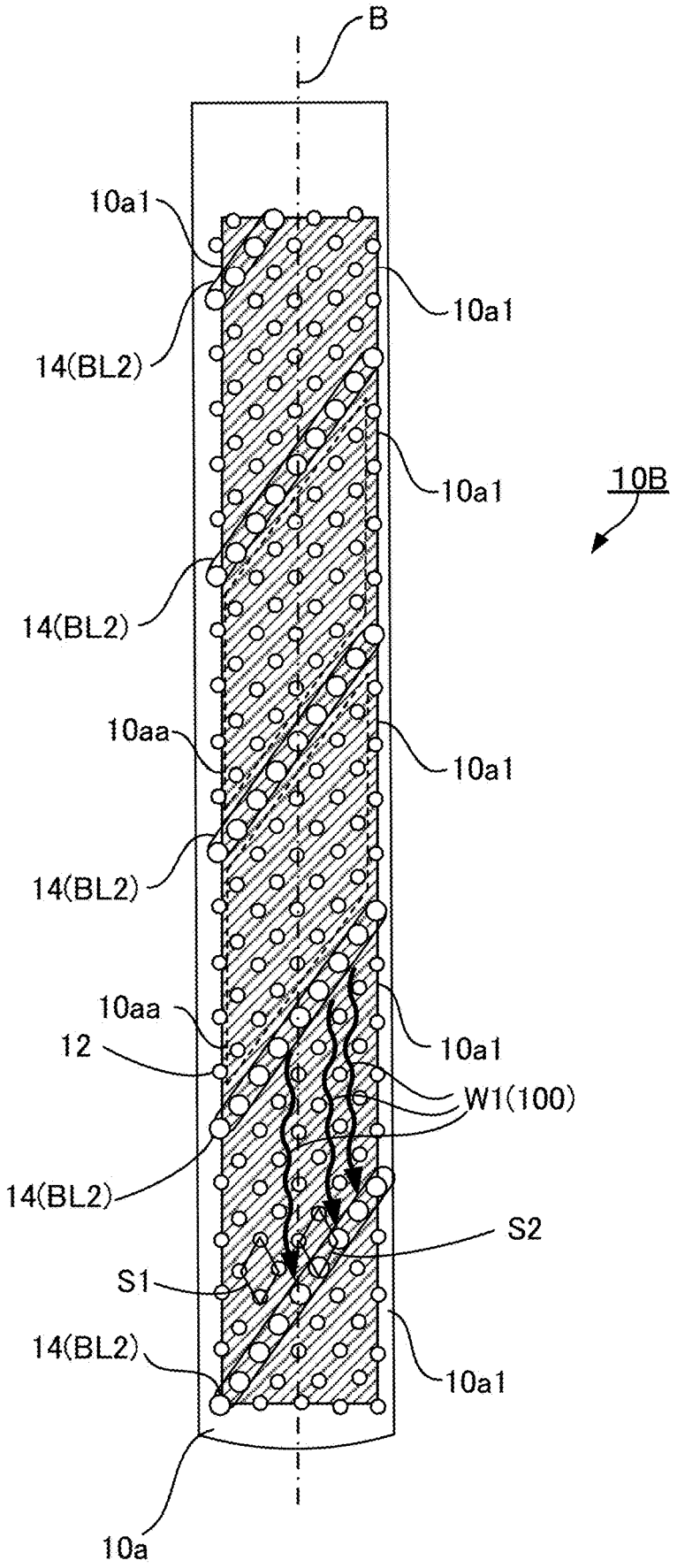

[Figure 33]
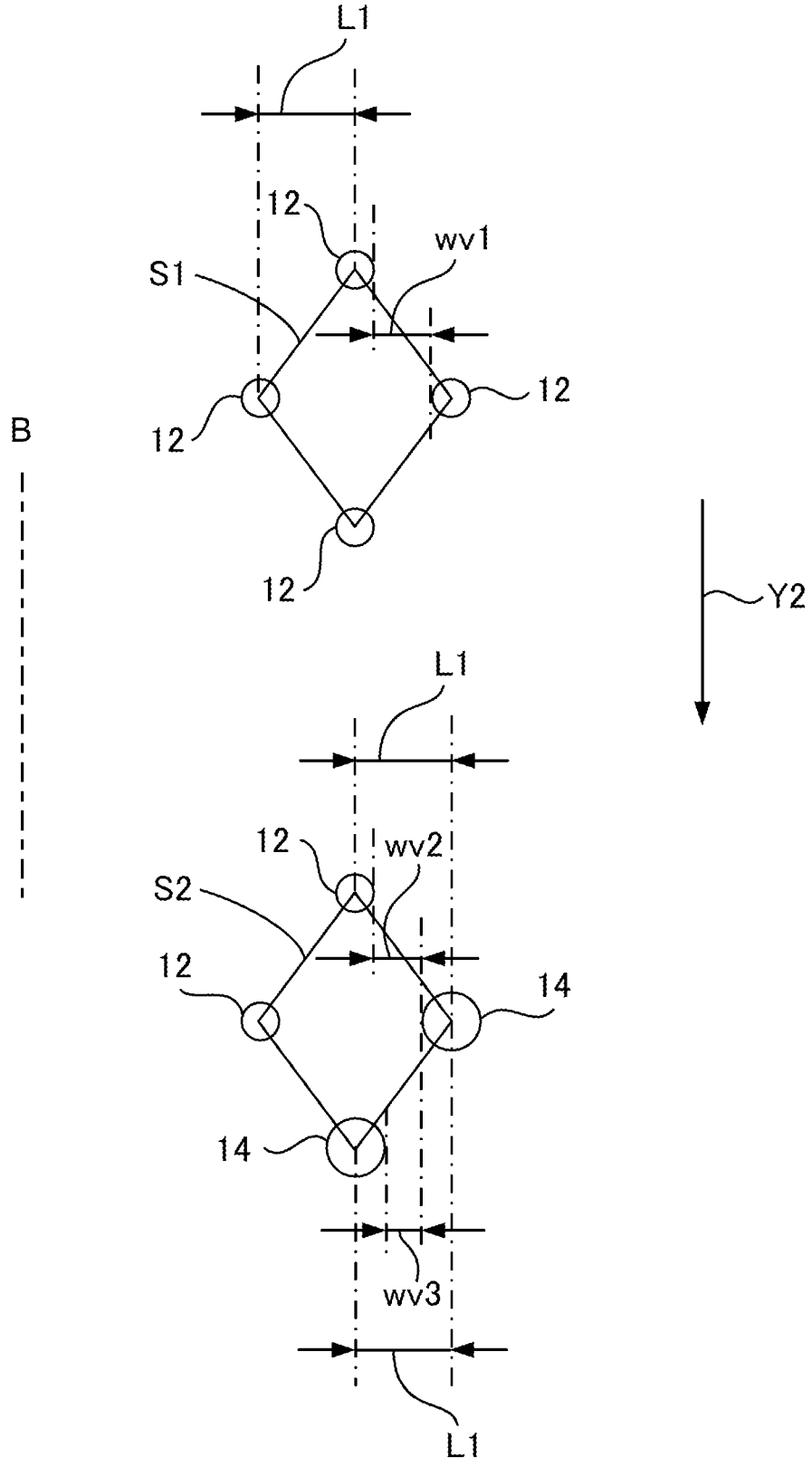

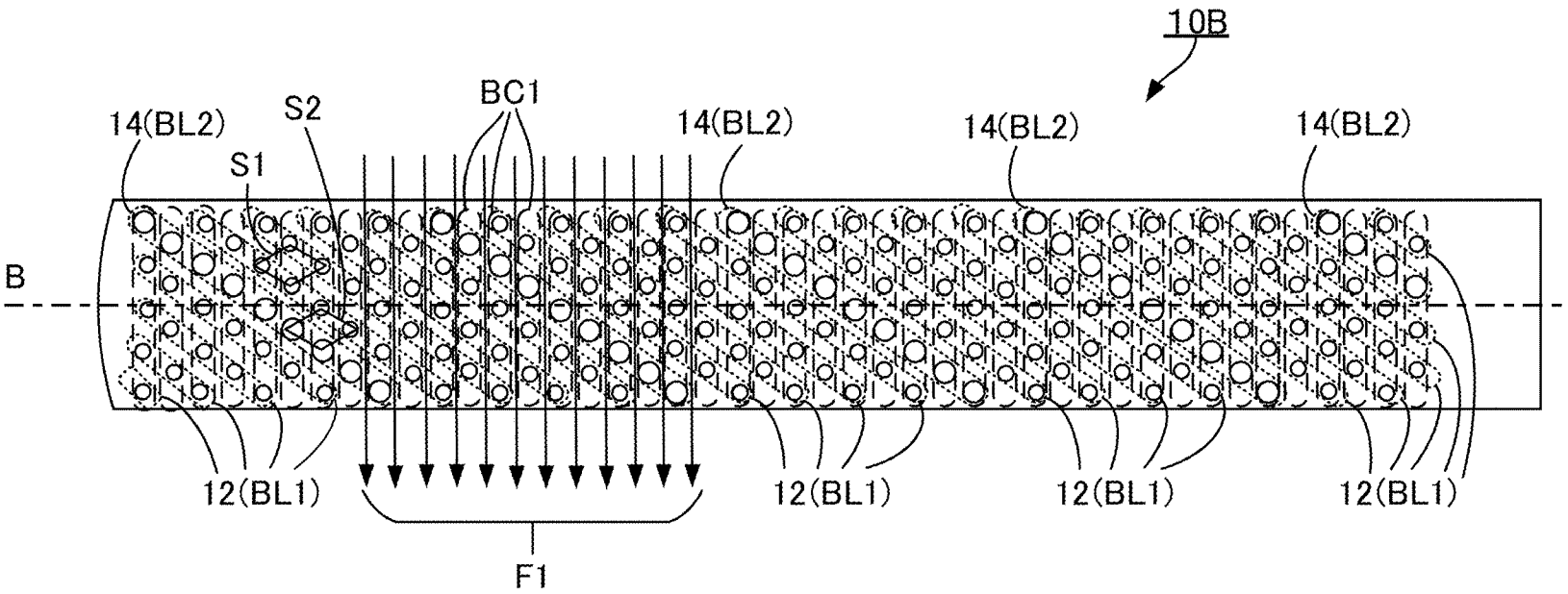
[Figure 34]

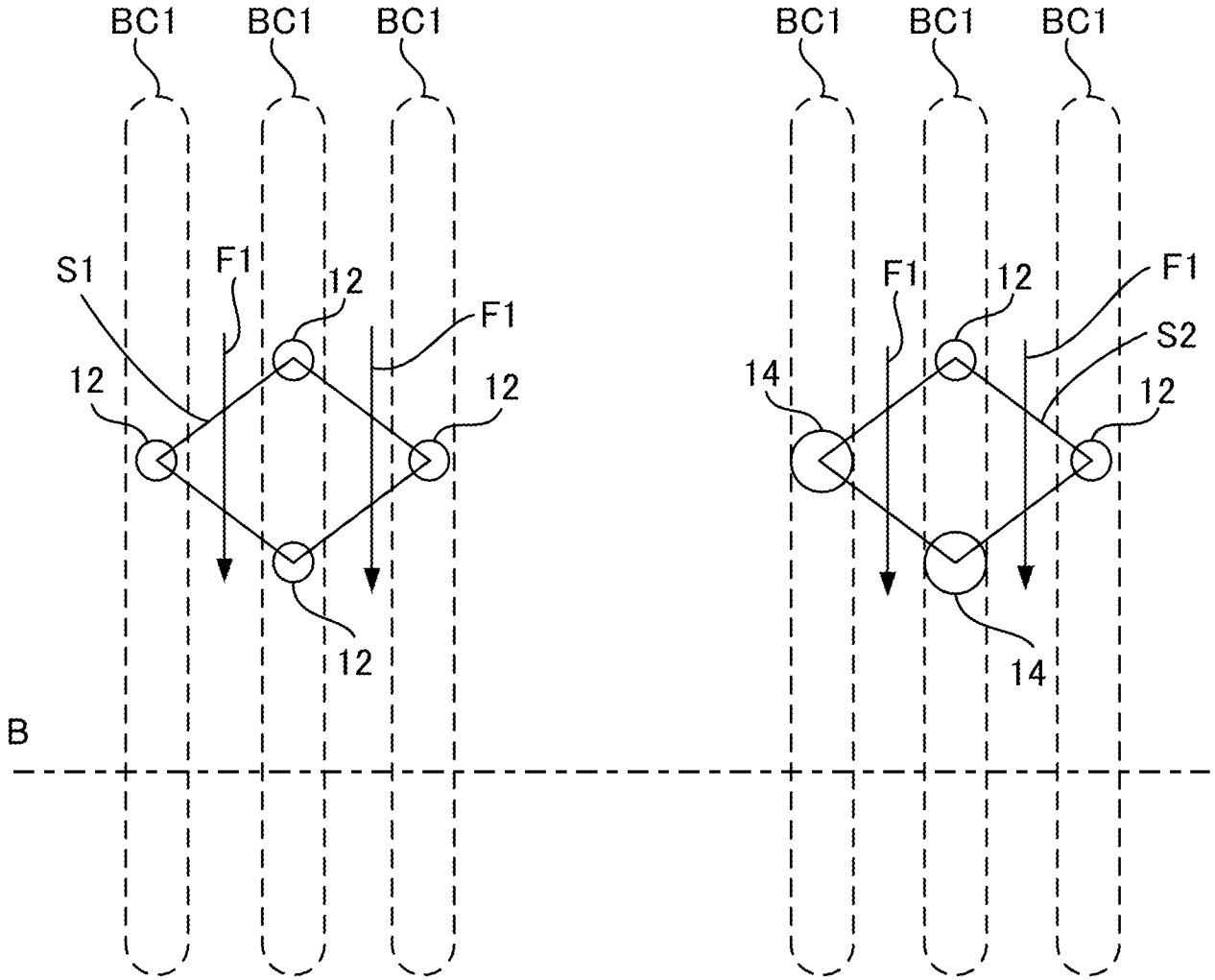
[Figure 35]

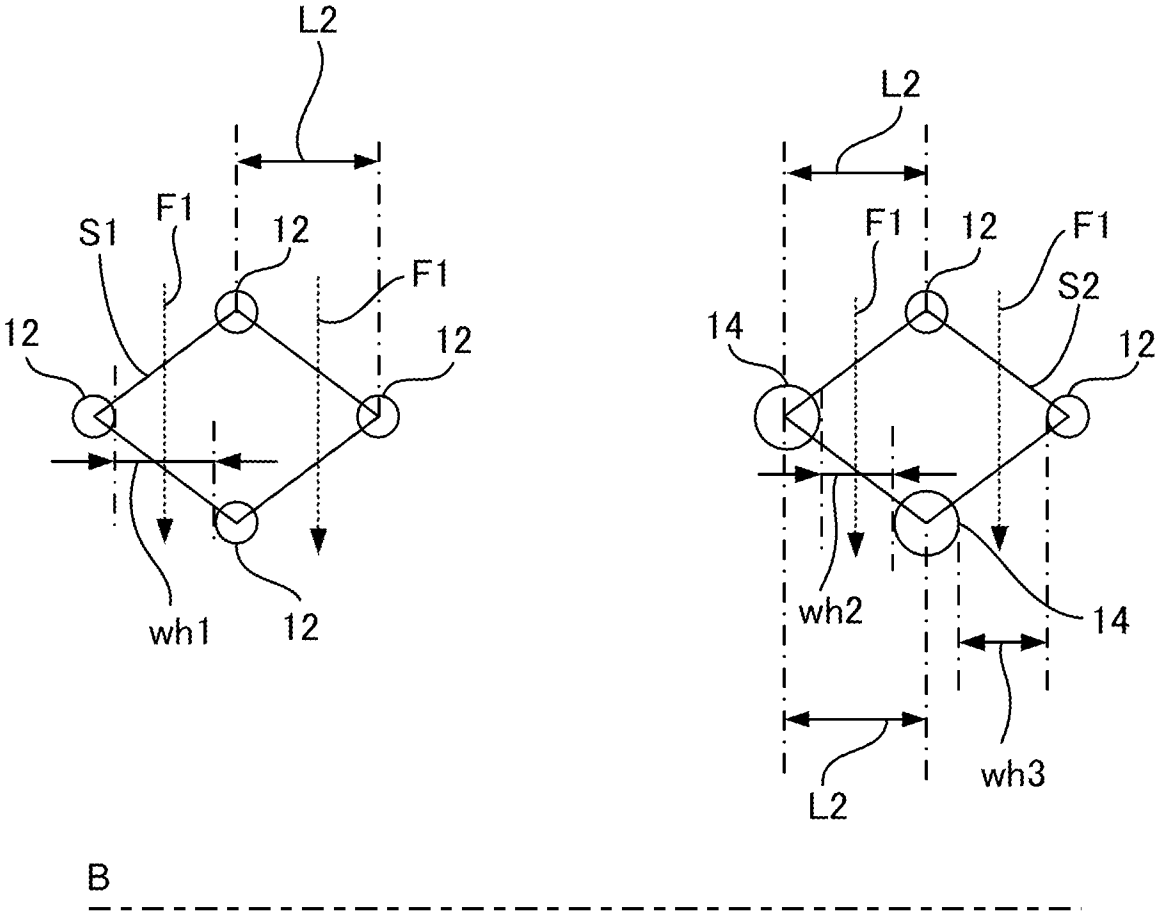
[Figure 36]

[Figure 37]
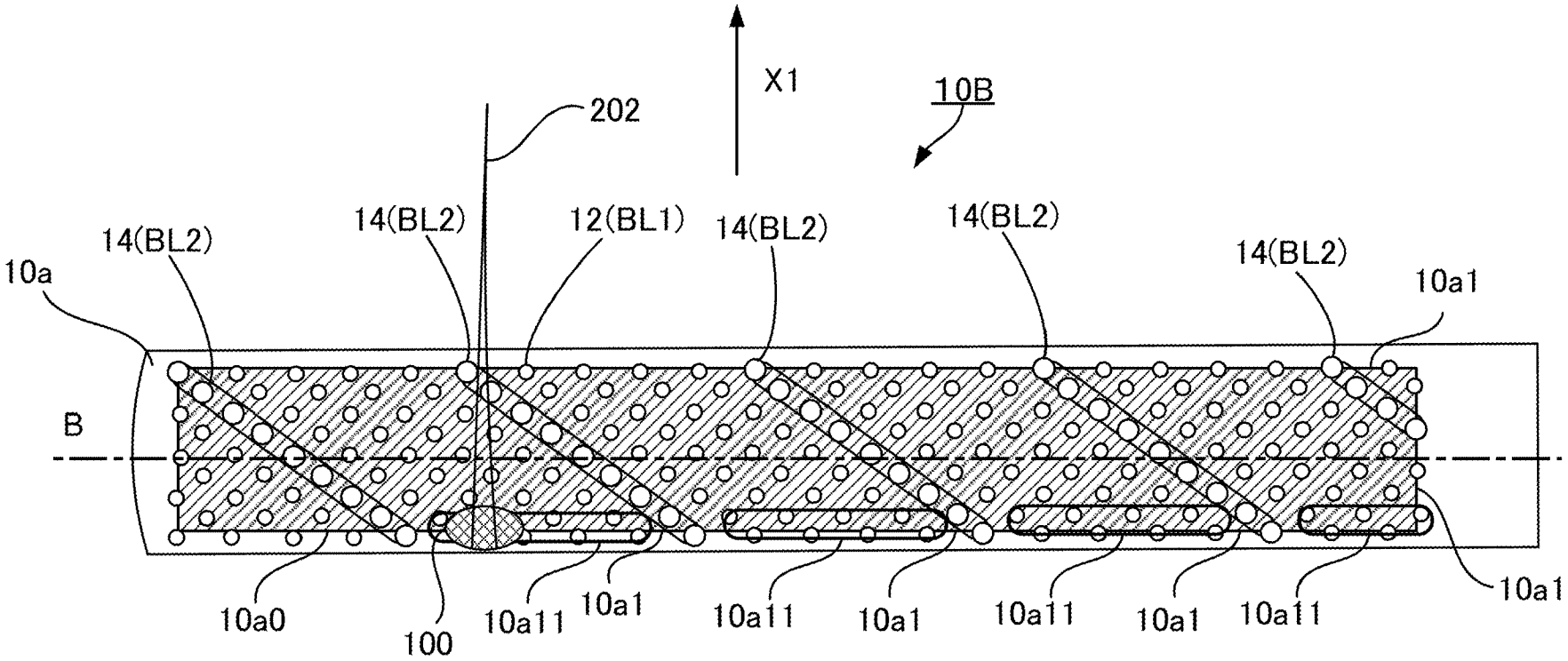

[Figure 38]
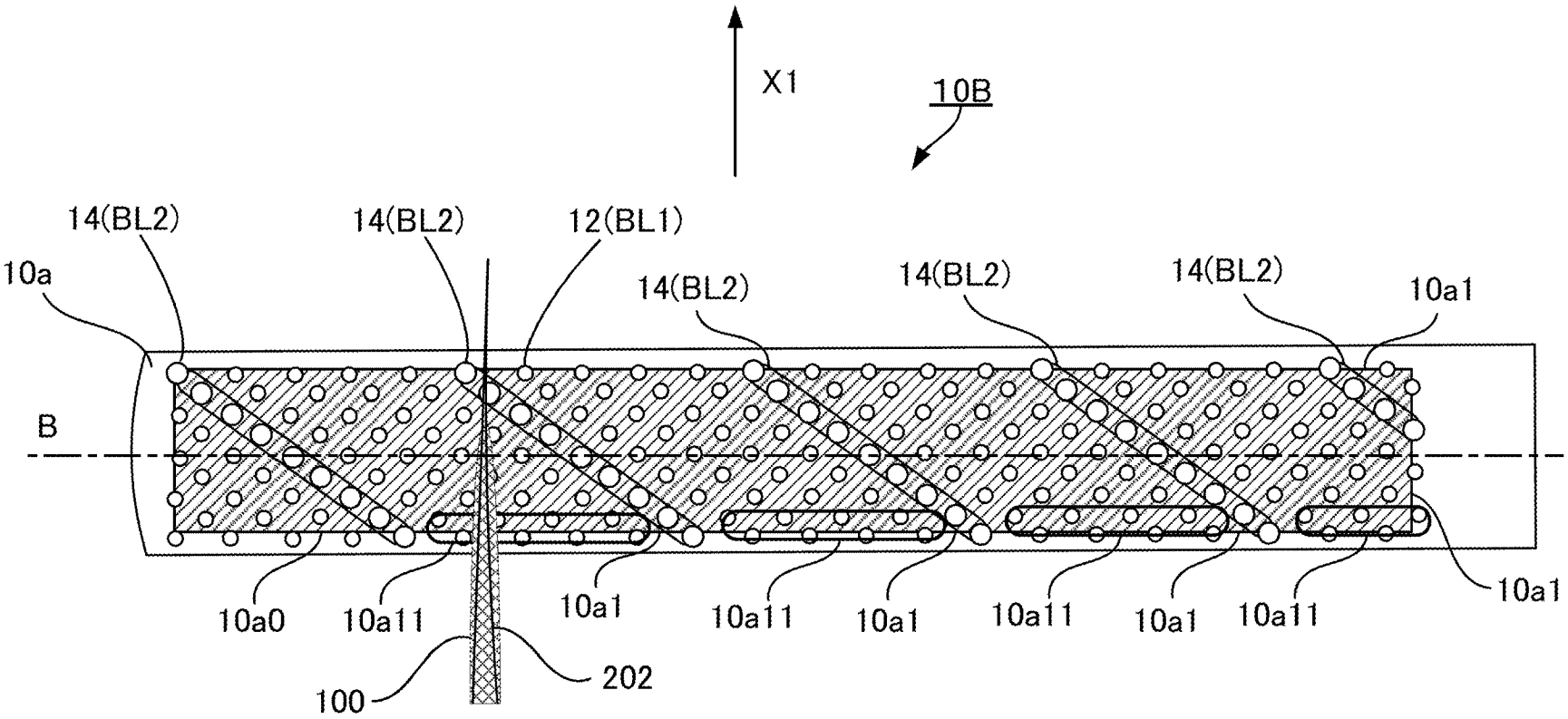

[Figure 39]
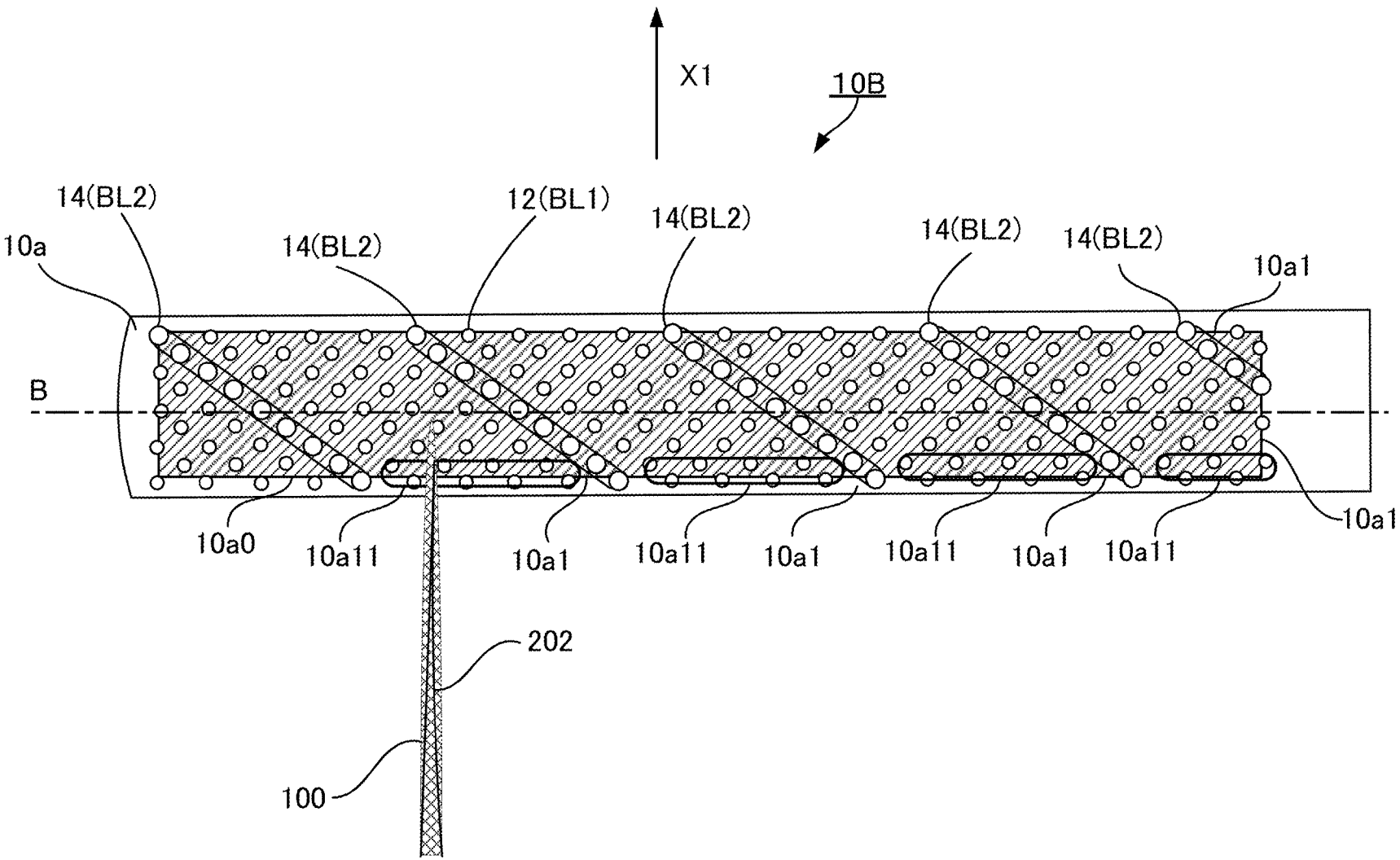

[Figure 40]
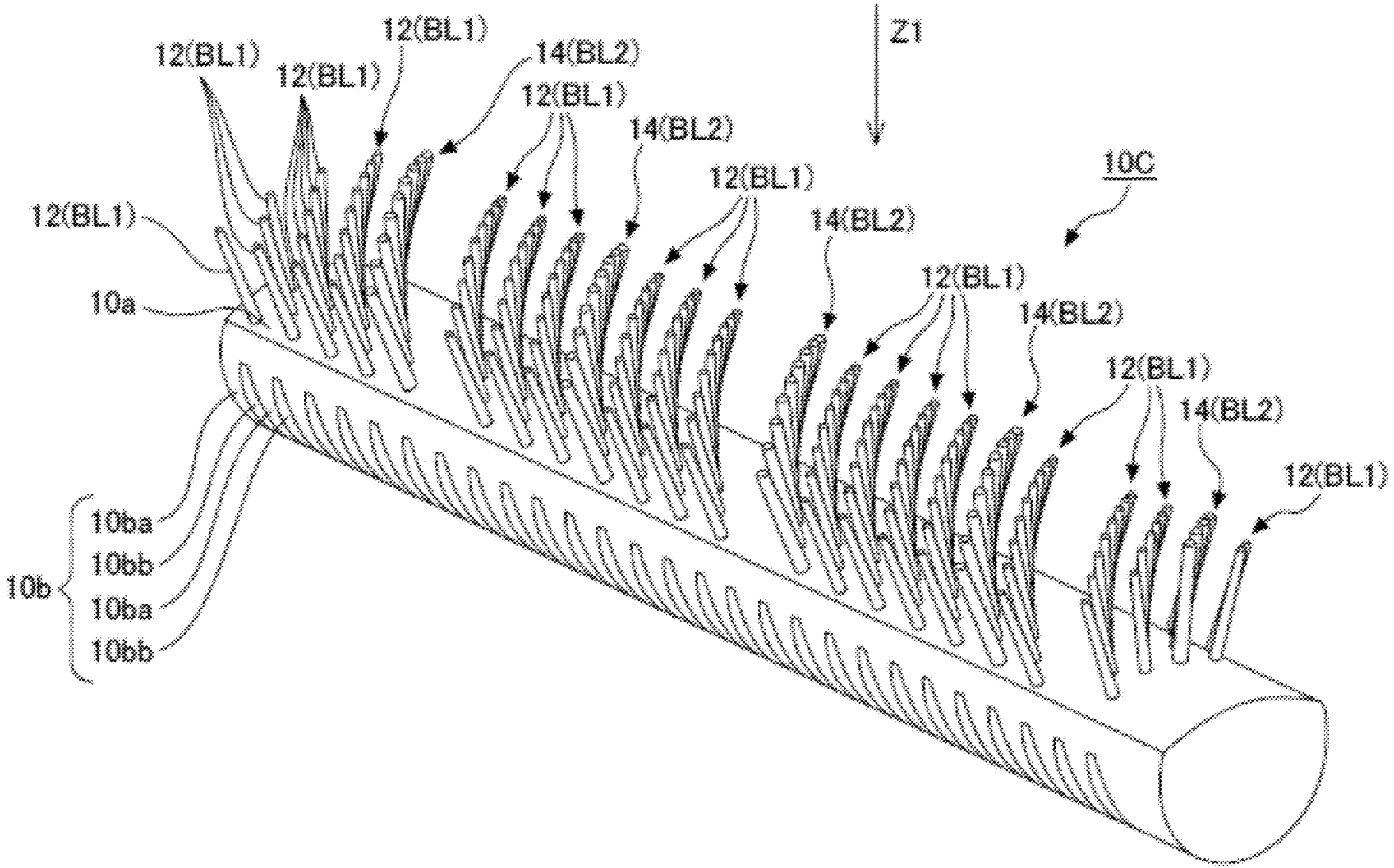

[Figure 41]
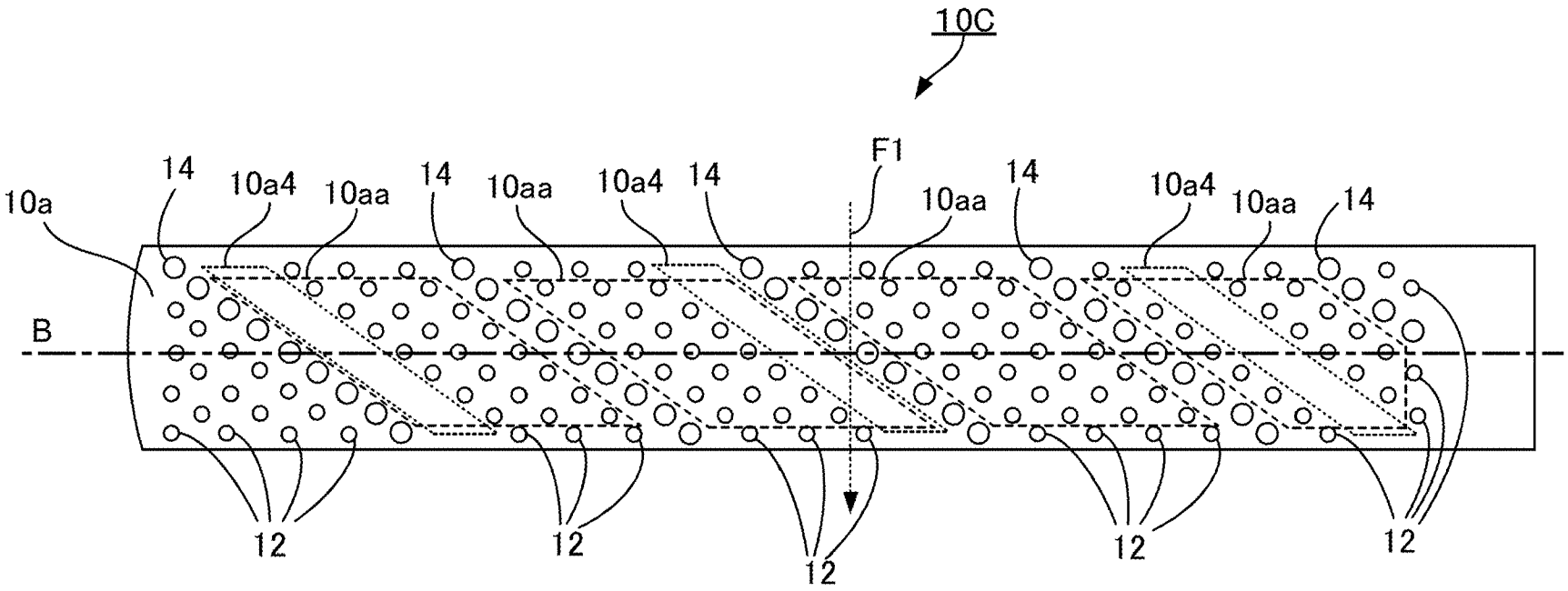

[Figure 42]
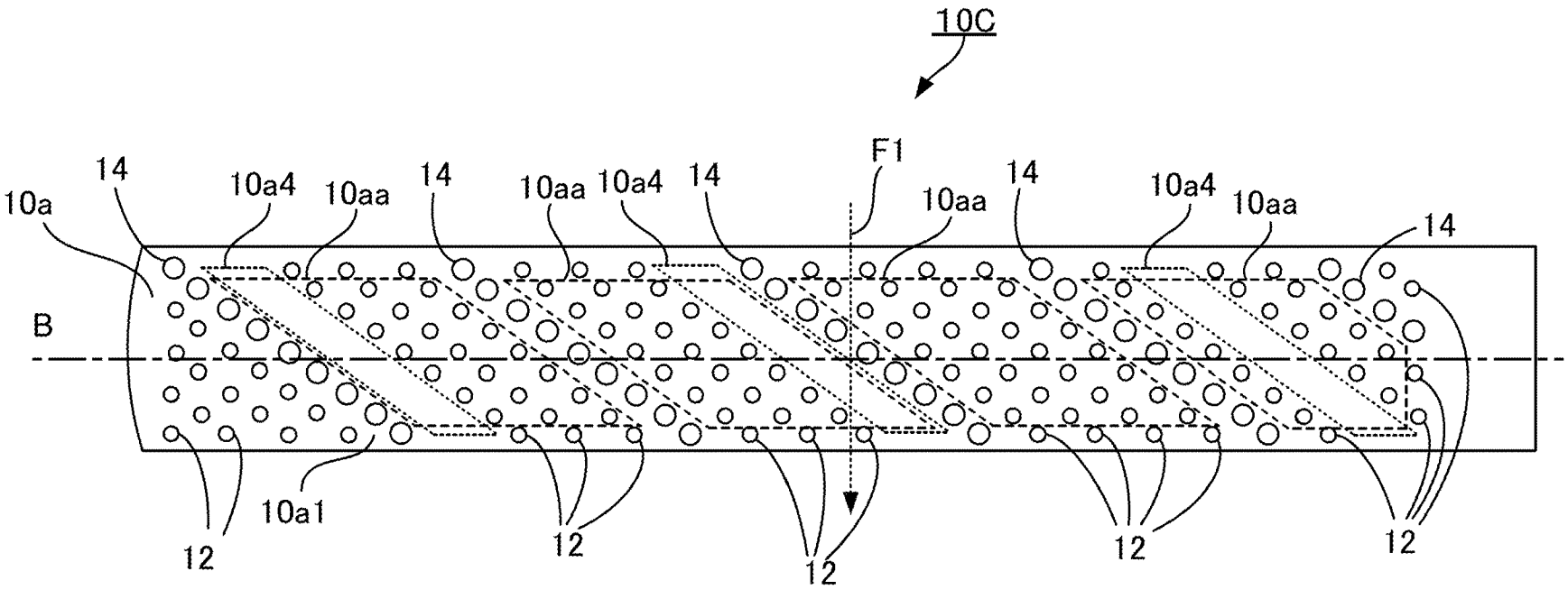

[Figure 43]
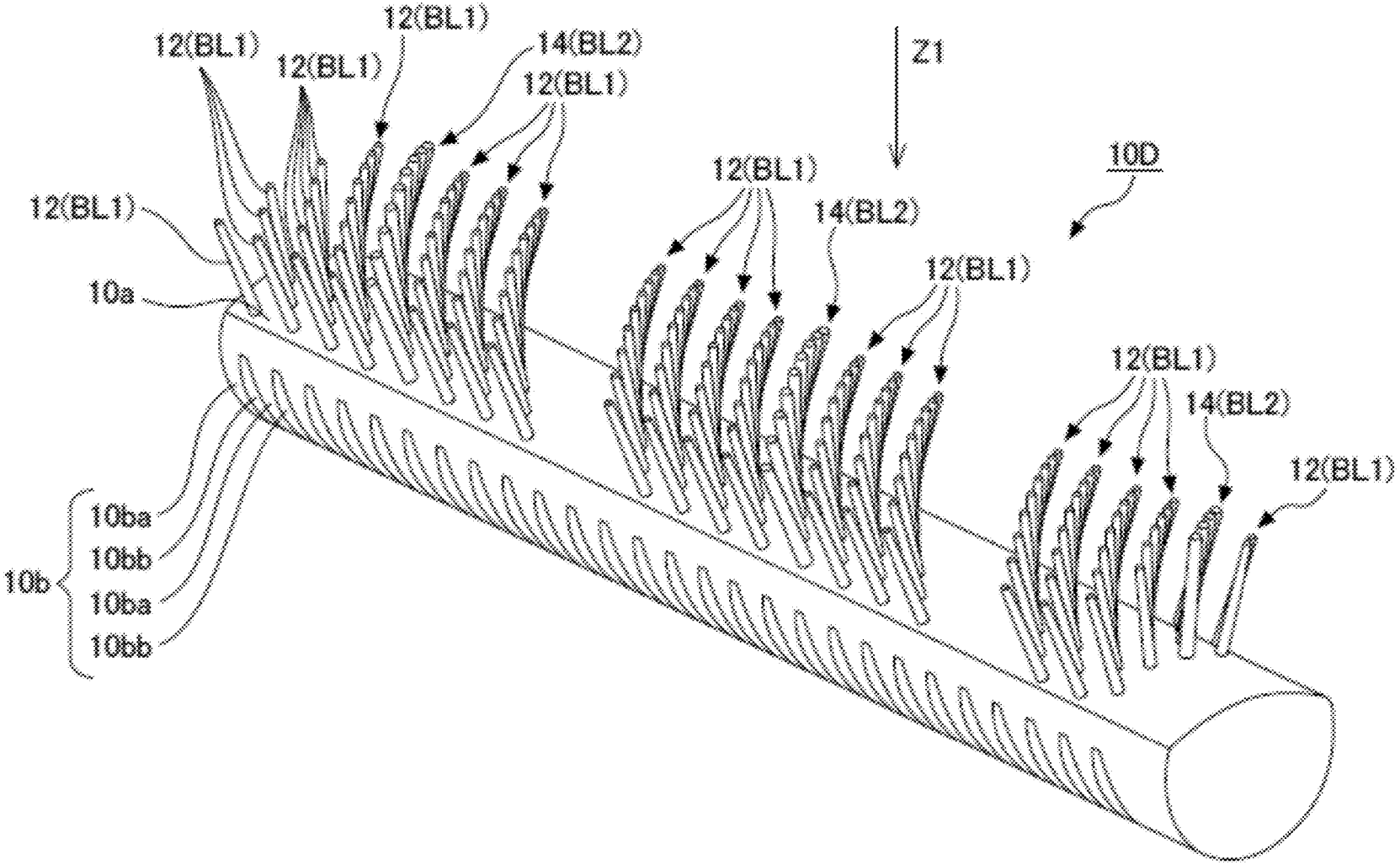

[Figure 44]
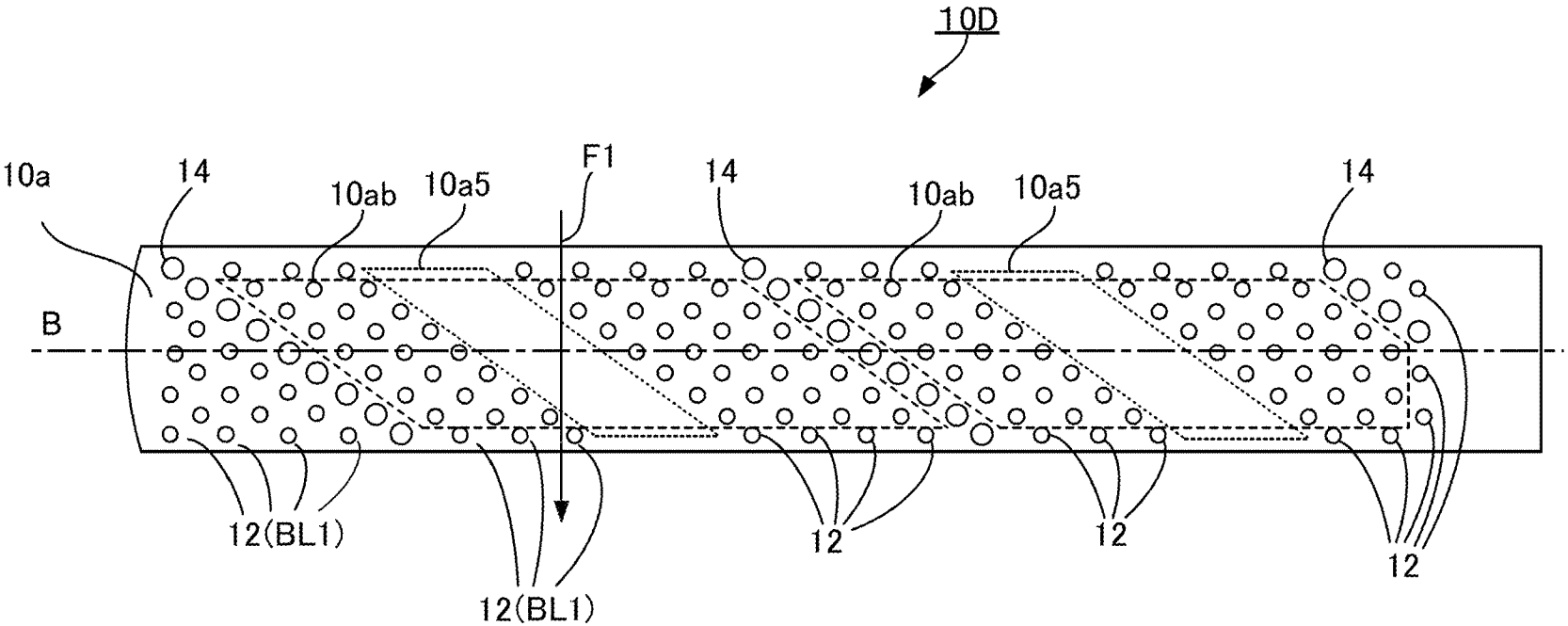

[Figure 45]
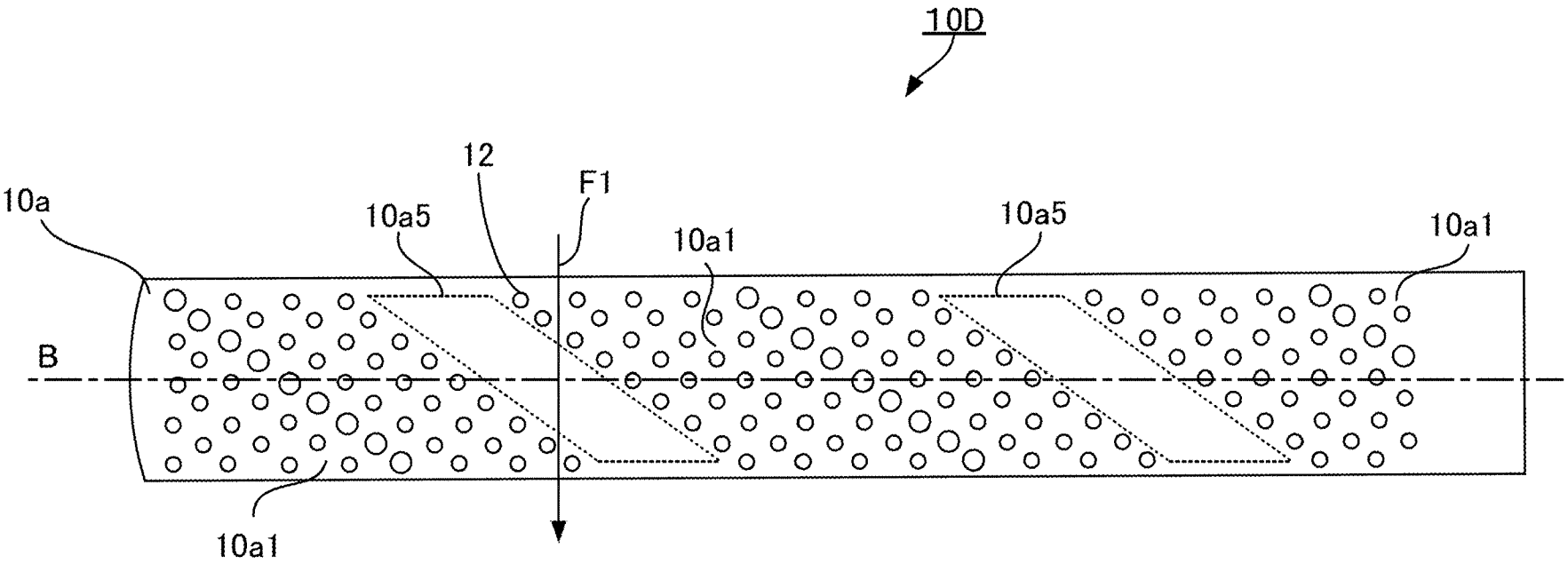

[Figure 46]
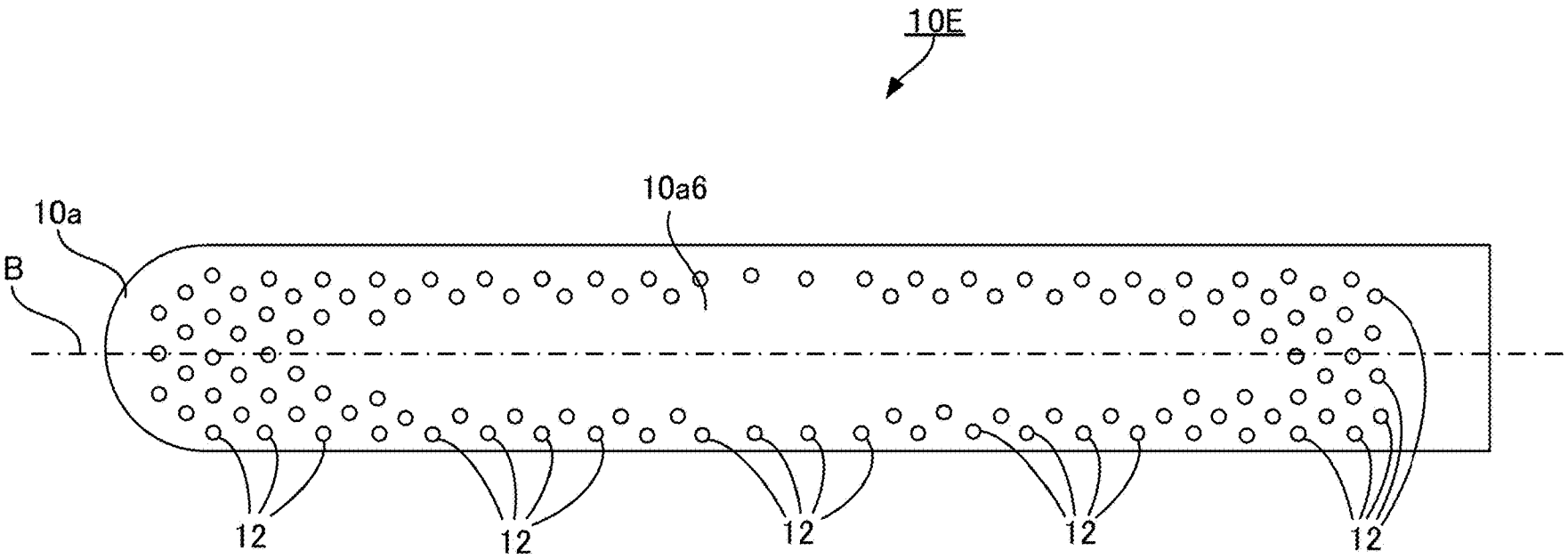

[Figure 47]
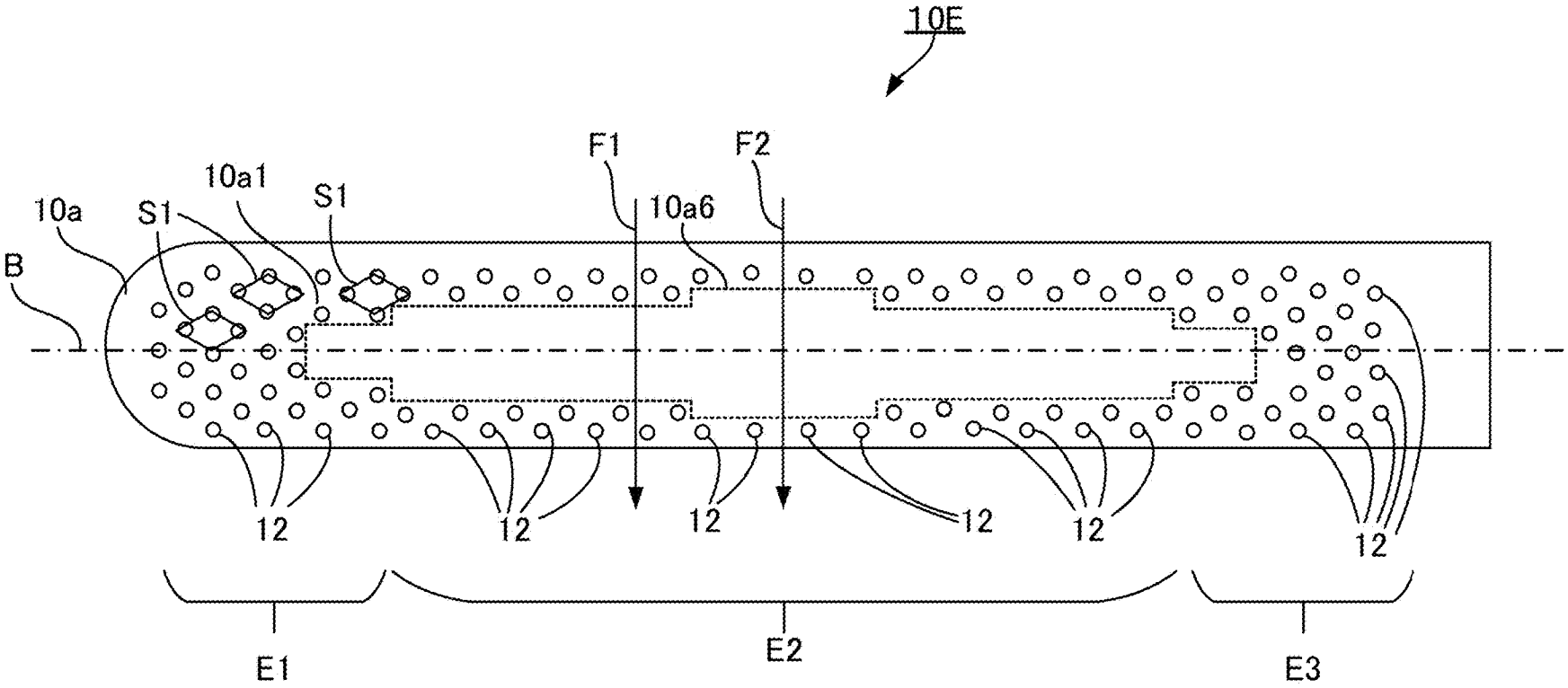

[Figure 48]
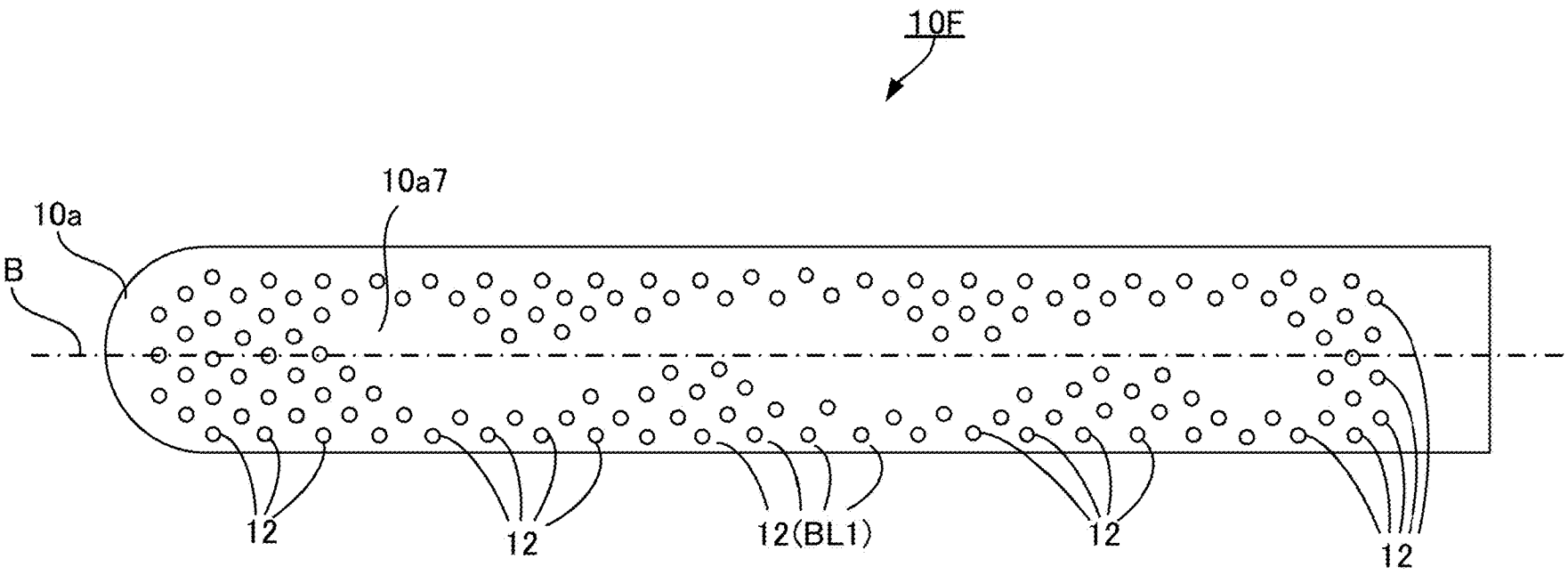

[Figure 49]
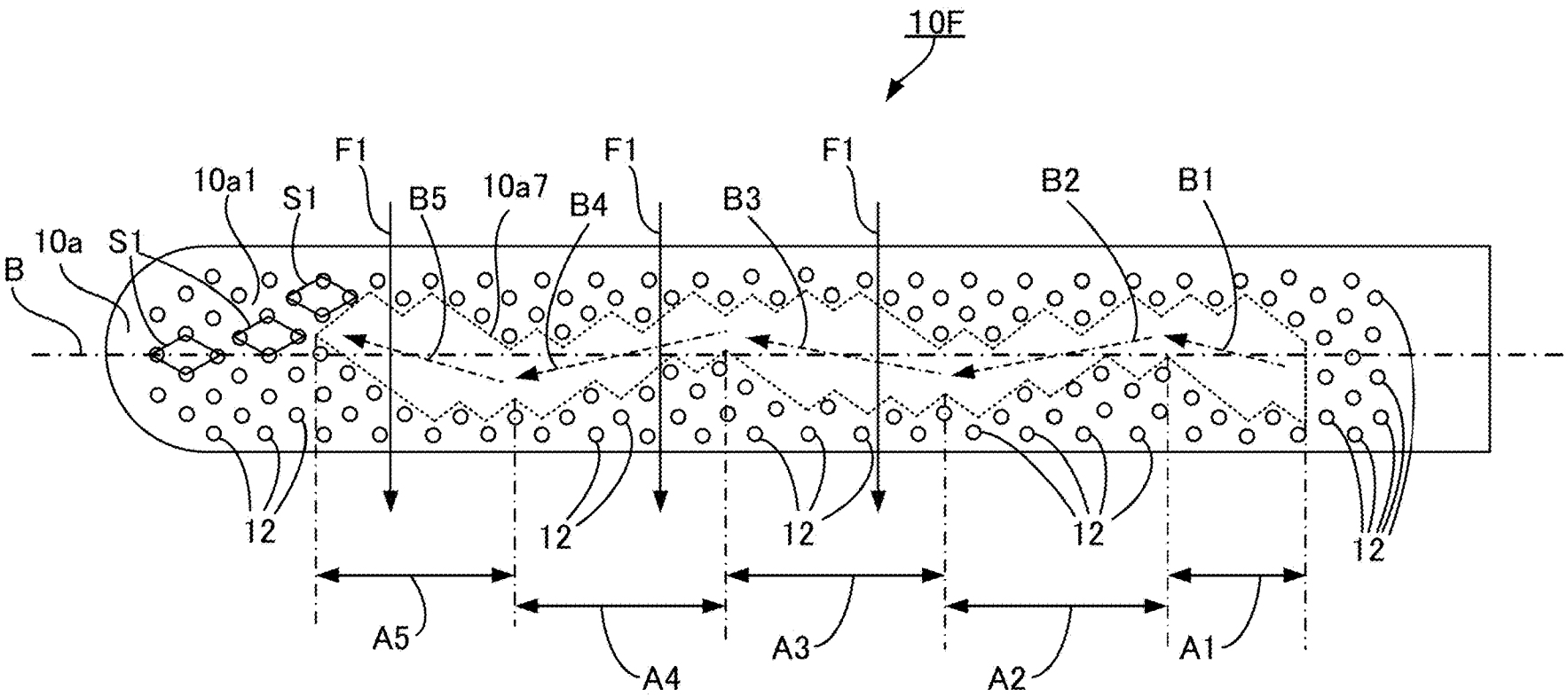

MASCARA COMB

TECHNICAL FIELD

The present invention relates to a mascara comb for applying a mascara liquid to eyelashes and combing eyelashes.

BACKGROUND ART

It is important when a user is applying viscous mascara liquid to the eyelashes a large amount of mascara liquid can be applied and lumps (hereinafter referred to as "lump") of mascara do not adhere to the eyelashes in small clumps.

For example, there has been proposed a mascara brush having an application brush including multiple hairs and an adjustment brush formed of a tooth-shaped comb, which is configured to apply mascara liquid to eyelashes with the application brush and comb the eyelashes with the adjustment brush (Patent Document 1).

CITATION LIST

Patent Literature

[Patent Document 1] Japanese Patent No. 4260674

SUMMARY OF INVENTION

Technical Problem

It is also important when a user is applying mascara liquid to the eyelashes to apply the mascara liquid quickly. However, with the above-described mascara brush, there is a problem in that the step of applying the mascara liquid to the eyelashes with the application brush, and a plurality of steps of flipping the direction of the application brush which had been directed toward the direction of the eyelashes so as to be opposite the direction of the eyelashes, directing the adjustment brush to the direction of the eyelashes, and brushing the eyelashes with the adjustment brush must be performed separately.

Based on the above, the present invention provides a mascara comb with which a user can quickly apply mascara liquid to eyelashes without forming clumps.

Solution to Problem

A first invention is a mascara comb which is a mascara comb for applying mascara liquid to user's eyelashes and combing the eyelashes, and having an upper surface formed as a convex-shaped curved surface having a curvature radius equal to or greater than a predetermined curvature radius, and a lower surface having a curvature radius smaller than the curvature radius of the upper surface; wherein on the upper surface, a plurality of protrusion elements are disposed so as to form multiple rhombus structures; when a deviation distance from the upper surface is given as a height, a cross-section of each of the protrusion elements in a direction orthogonal to the height direction forms a circle; each of the rhombus structures is configured so as to form a rhombus with a diagonal line in an axial direction of the comb portion longer than a diagonal line in an orthogonal direction orthogonal thereto, and a predetermined gap, which is a linear gap extending in the orthogonal direction, for applying the mascara liquid to the eyelashes while combing the eyelashes; further, the rhombus structures are a velocity adjustment portion functioning as a velocity adjustment mechanism for making the velocity with which the mascara liquid flows in the axial direction slower than the velocity with which the mascara liquid flows in the orthogonal direction; and in the upper surface, the inside of the rhombus structures is a holding portion having a function of holding the mascara liquid.

According to the configuration of the first invention, since the upper surface of the comb portion has a radius of curvature equal to or greater than a predetermined radius of curvature, the mascara liquid tends to stay on the upper surface when the mascara comb is pulled out from the container storing the mascara liquid, and further, through rhombus structures formed by a plurality of protrusion elements, the movement of the mascara liquid in the axial direction is restricted, and the mascara liquid is held inside the rhombus structures. While the mascara comb is used to comb the user's eyelashes in a direction orthogonal to the axial direction (hereinafter referred to as "orthogonal direction"), according to the configuration of the first invention, since a plurality of linear gaps extending in the orthogonal direction are formed between protrusion elements, the mascara liquid is applied to the tip of the eyelashes and combed by having the eyelashes pass through those gaps. Here, the rhombus structure is a rhombus whose diagonal line in the axial direction of the comb portion is longer than the diagonal line in the orthogonal direction. As a result, since the distance between the protrusion elements in the orthogonal direction becomes shorter than the distance between the protrusion elements in the axial direction, the movement of the mascara liquid in the axial direction can be effectively limited. In addition, this means that the distance between the protrusion elements in the axial direction is longer than the distance between the protrusion elements in the orthogonal direction, and through this, it is possible to form a predetermined gap for applying the mascara liquid to the eyelashes while combing the eyelashes. In other words, according to the mascara comb of the first invention, through a continuous operation, the mascara liquid held on the upper surface of the comb portion is applied to the eyelashes, and then with the protrusion elements formed on the upper surface of the same comb portion, it is possible to comb the eyelashes while applying the mascara liquid to the eyelashes in their entirety.

A second invention is the mascara comb according to the configuration of the first invention, wherein a distance between the centers of the cross-sections of two of the protrusion elements adjacent in the orthogonal direction is the same regarding all of the protrusion elements, the protrusion element is formed in a shape which decreases in diameter from the root portion as it approaches the apex vicinity portion; further, the protrusion element is configured such that the height of the protrusion element increases, and the reduction rate of the diameter of the protrusion elements decreases from the center portion toward the sides in the axial direction; and a plurality of the protrusion elements configure a velocity tapering mechanism for gradually reducing the velocity with which the mascara liquid flows in the axial direction.

When mascara liquid is located on the upper surface, there is a height from the upper surface to the liquid surface. In other words, not only the upper surface but also the protrusion element is an element which defines the ease and difficulty of flow of the mascara liquid. If the surface roughness of the protrusion elements is the same, the shorter the distance between the outer peripheries of the protrusion elements, the slower the velocity at which the mascara liquid flows between the protrusion elements. According to the configuration of the second invention, since the plurality of protrusion elements are formed so that the diameter reduction rate decreases toward the sides, the velocity at which the mascara liquid flows between the plurality of protrusion elements is slow. For this reason, when the mascara comb is pulled out from the container storing the mascara liquid, since the movement velocity of the mascara liquid to the sides is relatively slow, the mascara liquid tends to stay near the center of the upper surface. In addition, when the mascara liquid is applied, while the height of the protrusion element near the center portion is relatively low, since the mascara liquid tends to flow relatively easily between the protrusion elements, the mascara liquid can be effectively applied to eyelashes which come into contact with the protrusion elements near the center portion.

A third invention is a mascara comb according to the configuration of the second invention, wherein a plurality of the protrusion elements include a primary protrusion element and a secondary protrusion element having a cross-sectional diameter larger than the cross-sectional diameter of the primary protrusion element; the primary protrusion element and the secondary protrusion element are disposed on the upper surface such that a region where a plurality of the primary protrusion elements are disposed is sandwiched by a secondary protrusion element row configured by disposing the secondary protrusion elements; and a region sandwiched by the secondary protrusion element row is a velocity decreasing portion having a function of reducing the velocity with which the mascara liquid flows in the axial direction.

According to the configuration of the third invention, when the mascara comb is pulled out from the container storing the mascara liquid, the movement of the mascara liquid in the axial direction of the comb portion is greatly restricted by the secondary protrusion element row configured by the secondary protrusion elements having a relatively large cross-sectional diameter and the mascara liquid is mainly held in the region where the primary protrusion elements are disposed. Since the primary protrusion element has a smaller cross-sectional diameter than the secondary protrusion element, per unit area of the region exposed without the protrusion elements (hereinafter referred to as "exposed area") is relatively large. For this reason, a relatively large amount of mascara liquid is held in the primary region. The mascara liquid held in the primary region, the movement of the shaft portion in the axial direction is restricted by the primary protrusion elements, and the movement of the mascara liquid out of the primary region is restricted by the secondary protrusion element row.

A fourth invention is the mascara comb according to the configuration of the third invention, wherein the diameter reduction rate of the cross-sectional diameter of the secondary protrusion elements is defined as smaller than the diameter reduction rate of the cross-sectional diameter of the primary protrusion elements.

According to the configuration of the fourth invention, since the cross-sectional area from the root portion to the vicinity of the apex portion of the secondary protrusion element is larger than that of the primary protrusion element, the movement of the mascara liquid in the axial direction can be more effectively restricted.

A fifth invention is the mascara comb according to the configuration of any one of the first through fourth inventions, wherein the surface roughness of the protrusion elements is configured to be relatively small in relation to the surface roughness of the upper surface.

According to the configuration of the fifth invention, since the surface roughness of the protrusion element is small in relation to the upper surface, the mascara liquid held on the upper surface having a relatively large surface roughness can be smoothly transferred to the eyelashes, and the eyelashes can be effectively combed.

A sixth invention is the mascara comb according to the configuration of any one of the first through fifth inventions, wherein an open region where none of the protrusion elements are disposed is formed on the upper surface includes a center position in the orthogonal direction, has boundaries in the axial direction and the orthogonal direction defined by a plurality of the protrusion elements, and encompasses an area larger than the area encompassed on the upper surface by at least one of the rhombus structures; and the predetermined gap for applying the mascara liquid to the eyelashes while combing the eyelashes by the protrusion elements defining the boundaries is configured such that the eyelashes coming into contact with the open region pass through the predetermined gap.

According to the configuration of the sixth invention, since no protrusion elements are disposed in the open area, a larger amount of mascara liquid can be held than in the area where the protrusion elements are disposed. Furthermore, since the protrusion elements that define the boundary of the open region form a predetermined gap, the held mascara liquid can be applied to the eyelashes by the protrusion elements, and moreover the eyelashes can be combed.

A seventh invention is the mascara comb according to the sixth invention, wherein the open region is configured from a plurality of portion regions; the portion regions have disposed alternatingly a region with a relatively wide width in the orthogonal direction and a region with a relatively narrow width; and a linear segment connecting center portion vicinity locations in the orthogonal direction is configured so as to bend.

According to the configuration of the seventh invention, since the relatively wide regions and the narrow regions are alternatingly disposed in the open region, so that the velocity of the flow of the mascara liquid decreases. Furthermore, since the line segment connecting the locations near the center portion in the orthogonal direction is configured to bend, the flow velocity of the mascara liquid decreases further. Through this, it is possible to hold the mascara liquid more effectively in the open region.

Effect of the Invention

With a mascara comb according to the present invention, a user can quickly apply mascara liquid to eyelashes without forming clumps.

BRIEF DESCRIPTION OF THE DRAWINGS

FIG. 1 is a schematic overall view of a mascara comb according to a first embodiment of the present invention.

FIG. 2 is a schematic view illustrating the state in which the mascara comb is engaged with a mascara liquid container.

FIG. 3 is a schematic view illustrating the state in which the mascara comb is pulled out from the mascara liquid container.

FIG. 4 is a schematic perspective view illustrating a comb portion.

FIG. 5 is schematic plan views illustrating the comb portion.

FIG. 6 is a schematic side view illustrating the comb portion.

FIG. 7 is a schematic enlarged view illustrating a protrusion disposed at the comb portion.

FIG. 8 is a schematic enlarged view illustrating an upper surface and protrusion of the comb portion.

FIG. 9 is a schematic cross-sectional view in a direction (line A-A in FIG. 4) orthogonal to the axial direction of the comb portion.

FIG. 10 is a schematic view illustrating a mascara liquid holding region in the upper surface of the comb portion.

FIG. 11 is a schematic view illustrating the mascara liquid holding region in the comb portion when the mascara comb is pulled out from the container.

FIG. 12 is a schematic view illustrating a positioning state of protrusions in the mascara liquid holding region.

FIG. 13 is a schematic view illustrating a positioning state of protrusions for combing eyelashes.

FIG. 14 is a schematic view illustrating a positioning state of protrusions for combing eyelashes.

FIG. 15 is a schematic view illustrating a mascara comb usage method.

FIG. 16 is a schematic view illustrating the mascara comb usage method.

FIG. 17 is a schematic view illustrating the mascara comb usage method.

FIG. 18 is a schematic view of the mascara comb usage method as viewed from a side surface.

FIG. 19 is a schematic view of the mascara comb usage method as viewed from a side surface.

FIG. 20 is a schematic view of the mascara comb usage method as viewed from a side surface.

FIG. 21 is a schematic view of the mascara comb usage method as viewed from a side surface.

FIG. 22 is a schematic view illustrating the state which makes the mascara liquid adhere to the root of an eyelash with the comb portion.

FIG. 23 is a schematic view illustrating the state of combing an eyelash with the comb portion.

FIG. 24 is a schematic view illustrating the state of combing an eyelash with the comb portion.

FIG. 25 is a schematic perspective view illustrating a comb portion according to a second embodiment.

FIG. 26 is a schematic plan view illustrating the comb portion.

FIG. 27 is a schematic view illustrating a mascara liquid holding region in an upper surface of the comb portion.

FIG. 28 is a schematic perspective view illustrating a comb portion according to a third embodiment.

FIG. 29 is a schematic plan views illustrating the comb portion.

FIG. 30 is a schematic enlarged view illustrating a primary protrusion and a secondary protrusion disposed at the comb portion.

FIG. 31 is a schematic view illustrating a mascara liquid holding region in the upper surface of the comb portion.

FIG. 32 is a schematic view illustrating the mascara liquid holding region of the comb portion when a mascara comb is pulled out from a container.

FIG. 33 is a schematic view illustrating the positioning state of the primary protrusion and the secondary protrusion in the mascara liquid holding region.

FIG. 34 is a schematic view illustrating the positioning state of a protrusion for combing an eyelash.

FIG. 35 is a schematic view illustrating the positioning state of a protrusion for combing an eyelash.

FIG. 36 is a schematic view illustrating the positioning state of a protrusion for combing an eyelash.

FIG. 37 is a schematic view illustrating the state making mascara liquid adhere to the root of an eyelash with the comb portion.

FIG. 38 is a schematic view illustrating the state of combing an eyelash with the comb portion.

FIG. 39 is a schematic view illustrating the state of combing an eyelash with the comb portion.

FIG. 40 is a schematic perspective view illustrating a comb portion according to a fourth embodiment.

FIG. 41 is a schematic plan view illustrating the comb portion.

FIG. 42 is a schematic view illustrating a mascara liquid holding region in an upper surface of the comb portion.

FIG. 43 is a schematic perspective view illustrating a comb portion according to a fifth embodiment.

FIG. 44 is a schematic plan view illustrating the comb portion.

FIG. 45 is a schematic view illustrating a mascara liquid holding region in an upper surface of the comb portion.

FIG. 46 is a schematic plan view illustrating a comb portion according to a sixth embodiment.

FIG. 47 is a schematic view illustrating a mascara liquid holding region in an upper surface of the comb portion.

FIG. 48 is a schematic plan view illustrating a comb portion according to a seventh embodiment.

FIG. 49 is a schematic view illustrating a mascara liquid holding region in an upper surface of the comb portion.

DESCRIPTION OF EMBODIMENTS

Preferred embodiments of the present invention (hereinafter referred to as "embodiments") will be described in detail below with reference to the drawings. In the following description, the same reference numerals are given to the same components, and the description thereof is omitted or simplified. Note that description of configurations that can be appropriately implemented by those skilled in the art will be omitted, and only the basic configuration of the present invention will be described.

First Embodiment

As illustrated in FIG. 1, a mascara comb 1 includes a comb portion 10, a rod (handle) 50, and a grip member 70. The comb portion 10 is connected to one end portion of the rod 50, and the grip member 70 is connected to the other end portion thereof. The mascara comb 1 is a mascara comb for applying a mascara liquid 100 (see FIG. 2) to user's eyelashes and combing the eyelashes.

As illustrated in FIG. 2, the mascara comb 1 engages with a container 102 in which the mascara liquid 100 is stored in a detachable manner. The grip member 70 functions as a portion for gripping when the user operates the mascara comb 1. The grip member 70 also functions as a sealing lid for the container 102.

In the state illustrated in FIG. 2, when the mascara comb 1 is pulled out from the container 102 in the direction of the arrow Y1, the mascara liquid 100 is attached to the comb portion 10 of the mascara comb 1 as illustrated in FIG. 3. The arrow Y1 direction is given as the vertical direction. The user pulls out the mascara comb 1 from the container 102 from below to above. Hereinafter, the configuration of the comb portion 10 will be described.

As illustrated in FIG. 4, the comb portion 10 includes an upper surface 10*a* and a lower surface 10*b*. The upper surface 10*a* is an upward convex curved surface having a curvature radius equal to or greater than a predetermined curvature radius. The lower surface 10*b* is a curved surface having a predetermined curvature radius, but the curvature radius is smaller than the curvature radius of the upper surface 10*a*. In other words, the upper surface 10*a* is a curved surface that is nearly flat in comparison with the lower surface 10*b*. The lower surface 10*b* has a surface 10*ba* and a recess 10*bb*.

A plurality of primary protrusions 12 are disposed on the upper surface 10*a*. The primary protrusion 12 is an example of a protrusion element. The primary protrusion 12 has an overall elongated conical shape. That is, the primary protrusion 12 is formed in a shape that decreases in diameter as it progresses from the root portion to the vicinity of the apex, and the apex and the apex vicinity are configured as spherical surfaces. A plurality of primary protrusions 12 form a primary protrusion row BL1. A plurality of primary protrusion rows BL1 are disposed parallel to each other on the upper surface 10*a*. The primary protrusion row BL1 is an example of a protrusion element row.

The comb portion 10 including the primary protrusions 12 is formed by injection molding a plastic resin. The plastic resin may be, for example, polyethylene, polypropylene, or polyamide.

FIG. 5 is a schematic plan view of the comb portion 10 of FIG. 4 as viewed from the direction of the arrow Z1. The primary protrusion 12 illustrated in FIG. 5 illustrates a cross section at the root. In the present specification, the cross section of the primary protrusion 12 and the cross section of the secondary protrusion 14 described later are a cross section cut in a direction orthogonal to the height direction of the primary protrusion 12 or the secondary protrusion 14 unless otherwise described, and mean a circular surface. The diameter of the primary protrusion 12 or the diameter of the secondary protrusion 14 means the diameter of the cross section of the primary protrusion 12 or the secondary protrusion 14 (hereinafter referred to as "cross-sectional diameter") unless otherwise described. The radius of the primary protrusion 12 or the radius of the secondary protrusion 14 means the radius of the cross section of the primary protrusion 12 or the secondary protrusion 14 (hereinafter referred to as "cross-sectional radius") unless otherwise described. The secondary protrusion 14 will be described with reference to the third through fifth embodiments. In the present specification, a direction in which the axis B extends is referred to as the "axis direction", and a direction orthogonal to the axis direction as described above is referred to as the "orthogonal direction". The axis B is a line passing through the center position in the orthogonal direction of the comb portion 10.

The area of the upper surface 10*a* is defined as an area M1. The total area of the cross section of a root of the plurality of primary protrusions 12 is M3. In addition, the area (hereinafter referred to as "exposed area") of a region (hereinafter referred to as "exposed region") exposed without the primary protrusion 12 on the upper surface 10*a* is defined as M2. In other words, Expression 1: M2=M1−M3. In the exposed region, a region inside the plurality of rhombus structures S1 is defined as a primary region 10*a*1 (see FIG. 10). The mascara liquid 100 is mainly held in the primary region 10*a*1.

An exposure ratio which is the ratio of the area M2 to the area M1 (M2/M1) is defined within a predetermined range. Specifically, the exposure ratio is defined as 0.85 or more and 0.97 or less. In other words, the exposed area where the primary protrusion 12 does not exist on the upper surface 10*a* is larger than the total area of the cross section of the root of the primary protrusion 12. In the present embodiment, it is given that the area M1 is 105 $mm^2$ (square millimeters).

The primary protrusions 12 are evenly disposed on the upper surface 10*a*. In other words, the distance between the centers of the cross sections of two adjacent primary protrusions 12 in the axial direction is the same regardless of which primary protrusion 12 is focused upon. In addition, the distance between the centers of the cross sections of two adjacent primary protrusions 12 in the orthogonal direction is the same regardless of which primary protrusion 12 is focused upon.

For example, it is given that 205 primary protrusions are disposed on the upper surface 10*a*, and the cross-sectional radius of the root of the primary protrusion is 0.125 mm (millimeters). Then, since the cross-sectional area of the root of the primary protrusion 12 is 0.049 $mm^2$ (square millimeters) and there are 205 primary protrusions 12, the total cross-sectional area M3 is 10.045 $mm^2$ (square millimeters). From Expression 1, the exposed area M2 is 94.96 $mm^2$ (square millimeters). The exposure ratio (M2/M1) is then 0.90.

As illustrated in FIG. 5, the plurality of primary protrusions 12 are disposed on the upper surface 10*a* so as to form a rhombus structure S1. A plurality of rhombus structures S1 are disposed. The rhombus structures S1 share each side with an adjacent rhombus structure S1. The rhombus structure S1 is a rhombus whose diagonal line in the direction of the axis B is longer than the diagonal line in the orthogonal direction. As will be described later, in the rhombus structure S1, the two primary protrusions 12 forming the diagonal line in the axial direction are disposed so as to forma predetermined gap. The predetermined gap is a gap that does not interfere with the primary protrusion 12 and is a linear gap extending in the orthogonal direction; and is configured to apply the mascara liquid 100 to the eyelashes while combing the eyelashes. In addition, since they are configured in the shape where the diagonal line of the axial direction of the comb portion 10 is longer than the diagonal line of the orthogonal direction, the rhombus structures S1 are a velocity adjusting portion which functions as a velocity adjusting mechanism where the velocity with which the mascara liquid flows in the axial direction is slower than the velocity with which the mascara liquid 100 flows in the orthogonal direction; further, the inside of the rhombus structure S1 is a holding unit having a function of holding the mascara liquid 100 on the upper surface 10*a*.

In order to form the plurality of rhombus structures S1 described above, a plurality of primary protrusions 12 are disposed as described below. As illustrated in FIG. 5, each primary protrusion row BL1 is configured so as to be disposed such that in a cross section of the plurality of primary protrusions 12, the distance between center positions are an equal length LC.

A predetermined reference distance length C1 is defined for the distance between respective center lines of adjacent primary protrusion rows BL1. The center line of the primary protrusion row BL1 is a line connecting the centers of a cross section of the plurality of primary protrusions 12 configuring the primary protrusion row BL1. The length C1 of the reference interval is, for example, 1.0 mm (millimeter).

In addition, to form the rhombus structure S1, the primary protrusion row BL1 is disposed with a predetermined angle θ1 with respect to the axis B of the comb portion 10. The angle θ1 is an angle larger than 0 degrees and smaller than 45 degrees, desirably 25 degrees or more and less than 45 degrees, and in the present embodiment, it is 40 degrees. By having such an angle θ1, not only is the rhombus structure S1 formed limiting the movement of the mascara liquid 100 in the axial direction, but also the mascara liquid 100 can be applied to the eyelashes evenly.

FIG. 6 is a schematic side view of the comb portion 10. As illustrated in FIG. 6, the height of the primary protrusions 12 is configured to increase from the center portion of the comb portion 10 toward the sides (outside). As a result, the shape of the comb including the plurality of primary protrusions 12 matches the shape of the eyelid or the shape formed by the roots of the plurality of eyelashes. For example, the height h1 of the outermost primary protrusion 12A is 2.5 mm, and the height h2 of the innermost primary protrusion 12B is 1.5 mm. In the schematic perspective view of FIG. 4, the illustration of the difference in height between the plurality of primary protrusions 12 is omitted, which means that the same applies to the height of the primary protrusions 12 and/or the secondary protrusions 14 according to the second through seventh embodiments. Note that unlike the present embodiment, the plurality of primary protrusions 12 and/or secondary protrusions 14 may all be configured to have the same height, which means that the same applies to the height of the primary protrusions 12 and/or the secondary protrusions 14 according to the second through seventh embodiments.

FIG. 7 is a schematic view of the primary protrusion 12A positioned on an outermost end of the comb portion 10 and the primary protrusion 12B located in the center as viewed from the side. As illustrated in FIG. 7, the primary protrusion 12A has a height h1, and the primary protrusion 12B has a height h2. The height h2 is lower than the height h1. The primary protrusion 12A and the primary protrusion 12B have the same cross-sectional diameter 12*d*1 at the root portion and the same cross-sectional diameter 12*d*2 near the apex. This means that the rate at which the diameter of the primary protrusion 12A decreases (reduction rate) from the root portion toward the vicinity of the apex is smaller than the rate at which the diameter of the primary protrusion 12B decreases (reduction rate) from the root portion toward the vicinity of the apex. In other words, as illustrated in the rightmost drawing of FIG. 7, focusing on up to the height h2, it means that the area of the primary protrusion 12A in the side view is larger than the area of the primary protrusion 12B in the side view. As a result, the resistance acting upon the flow of the mascara liquid 100 increases between the primary protrusions 12 toward the sides of the comb portion 10. In the present embodiment, for example, the cross-sectional diameter 12*d*1 of the root portion of the primary protrusion 12 is 0.25 mm, and the cross-sectional diameter 12*d*2 near the apex is 0.17 mm.

As illustrated in FIG. 8, the primary protrusions 12 are disposed on the upper surface 10*a*. The surface roughness of the primary protrusions 12 is smaller than the surface roughness of the upper surface 10*a*. In other words, the surface of the primary protrusions 12 has relatively small unevenness, whereas the exposed region exposed without the primary protrusions 12 on the upper surface 10*a* has relatively large unevenness. As a result, it is easier for the mascara liquid 100 to remain in the exposed region of the upper surface 10*a*, and more difficult for it to remain on the surface of the primary protrusions 12. With this configuration, it is possible to hold the mascara liquid 100 in the exposed area of the upper surface 10*a*, and then effectively transfer the mascara liquid 100 to the eyelashes with the primary protrusions 12 as well as effectively comb the eyelashes.

As illustrated in FIG. 9, the upper surface 10*a* is formed as a curved surface having a predetermined curvature radius R1, and the lower surface 10*b* is formed as a curved surface having a predetermined curvature radius R2. The short axis length d1 in FIG. 5 is twice the curvature radius R2. The curvature radius R1 of the upper surface 10*a* is defined as a length that is at least 1.9 times the curvature radius R2 of the curved surface of the lower surface 10*b*. For example, the curvature radius R1 is 4.17 mm, and the curvature radius R2 is 2.1 mm. In other words, the upper surface 10*a* is formed as a curved surface that is nearly flat with respect to the lower surface 10*b*.

As illustrated in FIG. 10, on the upper surface 10*a*, the inside of the rhombus structure S1 is a primary region 10*a*1. The primary region 10*a*1 is a main region for holding the mascara liquid 100.

Hereinafter, the movement of the mascara liquid 100 in the upper surface 10*a* of the comb portion 10 when the mascara comb 1 is pulled out from the container 102 will be described while referencing FIG. 11 and FIG. 12. When the mascara comb 1 is pulled out from the container 102, it is pulled out from below so that the axis B of the comb portion 10 is substantially vertical. Since the mascara liquid 100 has viscosity, even if gravity acts upon the mascara liquid 100 adhering to the upper surface 10*a*, the mascara liquid 100 does not head downward rapidly but instead slowly flows downward. Here, on the upper surface 10*a*, when there is resistance against the downward flow of the mascara liquid 100, a larger amount of the mascara liquid 100 can be held on the upper surface 10*a*.

In the primary region 10*a*1, the primary protrusions 12 are disposed, which provides resistance against the flow of the mascara liquid 100. As illustrated in FIG. 11, in the primary region 10*a*1, the presence of the primary protrusions 12 becomes a resistance, and the mascara liquid 100 flows downward while meandering slowly as indicated by the arrow W1.

As illustrated in FIGS. 11 and 12, the primary protrusion 12 forms a rhombus structure S1. In other words, a plurality of primary protrusions 12 are disposed while forming a large number of rhombus structures S1. The rhombus structures S1 hold the mascara liquid 100 in the primary region 10*a*1 and forms a configuration for combing the eyelashes 202.

As illustrated in FIGS. 11 and 12, in the rhombus structure S1, the diagonal line in the axial direction is longer than the diagonal line in the orthogonal direction. For this reason, the distance (L1) in the orthogonal direction is shorter than the distance (L2) in the axial direction between the adjacent primary protrusions 12. As a result, the resistance against the flow in the axial direction of the mascara liquid 100 is increased, and the mascara liquid 100 is effectively held in the primary region 10*a*1.

In the rhombus structure S1, the distance in the orthogonal direction between the centers of the cross sections of the adjacent primary protrusions 12 is the distance L1, and the distance between the outer circumferences of the primary protrusions 12 is the distance wv1. Meanwhile, the distance in the axial direction between the centers of the cross sections of the adjacent primary protrusions 12 is the distance L2, and the distance between the outer circumferences of the primary protrusions 12 is the distance wh1. The distance wv1 is shorter than the distance wh1. As a result, the flow of the mascara liquid 100 in the axial direction can be effectively limited.

As illustrated in FIG. 12, the distance L2 is longer than twice the cross-sectional radius of the primary protrusion 12. As a result, a gap F1 having a distance wh1 is formed between the primary protrusions 12 and serves as a path for eyelashes when the eyelashes are combed as described below. For example, the distance L2 is 0.5 mm, twice the cross-sectional radius of the primary protrusion 12 is 0.25 mm, and the distance wh1 is 0.25 mm.

As described above, the diameter reduction rate of the primary protrusions 12 becomes smaller toward the sides of the comb portion 10. For this reason, as illustrated in FIG. 11, the flow velocity V2 at the sides is slower than the flow velocity V1 of the mascara liquid 100 near the center portion of the comb portion 10, and further toward the sides, the velocities V3, V4, and V5 are incrementally slower. In other words, the plurality of primary protrusions 12 configure a velocity tapering mechanism.

A structure for combing eyelashes 202 with the comb portion 10 will be described in detail while referencing FIG. 13 and FIG. 14. As illustrated in FIGS. 13 and 14, the primary protrusions 12 are disposed in a straight line in the orthogonal direction and form a plurality of straight lines BC1. A plurality of linear gaps F1 extending in the orthogonal direction are formed between the straight lines BC1, and the eyelashes 202 pass through the gaps F1 so as to apply the mascara liquid 100 over the entirety and be combed. The reduction ratio of the cross-sectional diameter of the primary protrusion 12 is smaller toward the sides. Since the reduction ratio of the cross-sectional diameter of the primary protrusions 12 is larger as it is closer to the center portion, the velocity at which the mascara liquid 100 moves between the primary protrusions 12 in the center portion of the comb portion 10 is faster than the side portions. In other words, the velocity Vh1 at the center portion is faster than the velocity Vh2 at the sides.

As described above, the primary protrusions 12 are disposed so as to form a plurality of rhombus structures S1. Accordingly, the plurality of primary protrusions 12 form primary protrusion rows BL1, and the primary protrusion rows BL1 are disposed at a predetermined angle θ1 with respect to the axis B of the comb portion 10. The angle θ1 is defined so as to generate the above-described gap F1 based on the equally spaced length LC (see FIG. 5) and the radius of the primary protrusion 12.

If the equally spaced length LC is determined, an angle θ1 with respect to the axial direction of the primary protrusion row BL1 and the secondary protrusion row BL2 described later is defined so as to form the gap F1 described above. The angle θ1 is also an angle with respect to the axial direction of the rhombus structure S1.

If the root radius of the primary protrusions 12 is R12, the angle θ1 is defined so as to satisfy Expression 2: $LC \cdot \cos \theta 1 > R12 \times 2$. In other words, the angle θ1 is defined by the equally spaced length LC and the radius R12. Note that the distance L2 (see FIG. 12) is given by Expression 3: $L2 = LC \cdot \cos \theta 1$. For this reason, when Expression 2 is modified, it becomes Expression 2A: $L2 > R12 \times 2$.

In the comb portion 10, since the primary protrusion row BL1 is disposed with the above-described angle θ1 with respect to the axial direction of the comb portion 10, not only can the flow of the mascara liquid 100 be effectively restricted but also a moderately large gap F1 can be formed, making it possible to evenly apply an appropriate amount of the mascara liquid 100 to the plurality of eyelashes 202.

As described above, the plurality of rhombus structures S1 has a holding force for holding the mascara liquid 100 in the region 10*a*1 and a structure for applying the mascara liquid 100 evenly to the eyelashes 202.

Hereinafter, a method of using the mascara comb 1 will be described while referencing FIGS. 15 through 21. As described above, when the mascara comb 1 is pulled out from the container 102, the mascara liquid 100 adheres to the upper surface 10*a* of the comb portion 10. As illustrated in FIGS. 15 and 18, an end portion along the longitudinal direction of the upper surface 10*a* is pressed against the root of the eyelashes 202, and the mascara liquid 100 adhering to the upper surface 10*a* adheres to the root of the eyelashes 202. Subsequently, as illustrated in FIGS. 16, 17, and 19 through 21, as the mascara liquid 100 held on the upper surface 10*a* is adhered to the eyelashes 202, the comb portion 10 is slightly rotated and the mascara liquid 100 is adhered to the eyelashes 202 in their entirety while combing the eyelashes 202 with the primary protrusions 12.

The state in which the mascara liquid 100 is applied to the eyelashes 202, the mascara liquid 100 is extended with the comb portion 10, and the eyelashes 202 are combed will be described while referencing FIGS. 22 through 24.

As illustrated in FIG. 22, when the comb portion 10 is held horizontally, a portion of the mascara liquid 100 moves downward (in the direction indicated by the arrow X2), that is, to the end portion 10*a*11 of the upper surface 10*a*. When the end portion 10*a*11 is pressed against the root of the eyelash 202, the mascara liquid 100 adheres to the root of the eyelash 202. In addition, when the comb portion 10 is moved in the direction of the arrow X1 while slightly rotating, the mascara liquid 100 held on the upper surface 10*a* is applied to the eyelashes 202, the mascara liquid 100 is applied to the whole eyelash 202, and the eyelash 202 passes between the straight lines BC1 and combed, as illustrated in FIGS. 23 and 24. As described above, since the upper surface 10*a* of the comb portion 10 is a curved surface that is nearly flat with respect to the lower surface 10*b*, the holding force of the mascara liquid 100 is further increased. When the user 200 presses the end portion of the upper surface 10*a* of the comb portion 10 against the root of the eyelash 202 to adhere the mascara liquid 100, if the lower surface 10*b* of the comb portion 10 is a curved surface, since the end portion of the upper surface 10*a* and the curved surface of the lower surface 10*b* are made continuous, it is easy for the user 200 to sense distance from the end portions. Meanwhile, if the lower surface 10*b* is flat, the end portion of the upper surface 10*a* and the lower surface 10*b* are not continuous, and it is difficult to sense the distance between the end portions of the upper surface 10*a*. In other words, the upper surface 10*a* and the lower surface 10*b* are curved surfaces, and the curvature radius R1 of the upper surface 10*a* and the curvature radius R2 of the lower surface 10*b* have the above relationship, thereby further increasing the holding force of the mascara liquid 100 on the upper surface 10*a*. In addition, when the user 200 presses the end portion of the upper surface 10*a* of the comb portion 10 against the root of the eyelash 202 to adhere the mascara liquid 100, it is easy to sense the distance from the end portions.

As described above, since the upper surface 10*a* of the comb portion 10 has a curvature radius equal to or larger than a predetermined curvature radius, when the mascara comb 1 is pulled out from the container 102 storing the mascara liquid 100, the mascara liquid 100 easily stays on the upper surface 10*a*, the movement of the mascara liquid 100 in the axial direction is restricted by the rhombus structure S1 formed by the primary protrusions 12, and the mascara liquid 100 is held inside the rhombus structure S1. The mascara comb 1 is used to comb the user's eyelashes in the orthogonal direction; however, since a plurality of linear gaps extending in the orthogonal direction are formed between the primary protrusions 12, by passing the eyelashes through the gaps, the mascara liquid 100 is applied all the way to the tips of the eyelashes as well as combed. Here, the rhombus structure S1 is a rhombus whose diagonal line in the axial direction of the comb portion 10 is longer than the diagonal line in the orthogonal direction orthogonal thereto. As a result, since the distance of the primary protrusions 12 in the orthogonal direction becomes shorter than the distance between the primary protrusions 12 in the axial direction, the movement of the mascara liquid 100 in the axial direction can be effectively restricted. This means that the distance between the primary protrusions 12 in the axial direction is longer than the distance between the primary protrusions 12 in the orthogonal direction, which allows a predetermined gap to be formed for applying the mascara liquid 100 to the eyelashes while combing the eyelashes. In other words, according to the mascara comb 1, the mascara liquid 100 held on the upper surface 10*a* of the comb portion 10 is applied to the eyelashes by a continuous operation, and while combing the eyelashes, the mascara liquid can also be applied to the eyelashes in their entirety by the primary protrusions 12 that are also formed on the upper surface 10*a* of the comb portion 10.

In addition, when the mascara liquid 100 is located on the upper surface 10*a*, there is a height from the upper surface 10*a* to the liquid surface. In other words, not only the upper surface 10*a* but also the outer peripheral surface of the primary protrusion 12 are also an element defining the ease or difficulty of flow of the mascara liquid 100. If the surface roughness of the primary protrusions 12 is the same, the velocity at which the mascara liquid 100 flows between the primary protrusions 12 decreases as the distance between the outer peripheral surfaces of two adjacent primary protrusions 12 decreases. Since a plurality of primary protrusions 12 are formed so that the diameter reduction rate becomes smaller toward the sides, the flow velocity of the mascara liquid 100 is slower toward the sides. For this reason, when the mascara comb 1 is pulled out from the container 102 in which the mascara liquid 100 is stored, since the movement speed of the mascara liquid 100 to the side is relatively slow, the mascara liquid 100 tends to accumulate near the center portion of the upper surface 10*a*. When applying the mascara liquid 100, while the height of the primary protrusion 12 in the vicinity of the center is relatively low, since the mascara liquid 100 flows relatively easily, it is possible to effectively apply the mascara liquid 100 to eyelashes coming into contact with protruding elements near the center portion.

Moreover, since the surface roughness of the primary protrusions 12 is small in relation to the upper surface 10*a*, it is possible to transfer the mascara liquid 100 held on the upper surface 10*a* having a relatively large surface roughness to the eyelashes as well as smoothly comb the eyelashes.

Second Embodiment

A second embodiment will be described with reference to FIGS. 25 through 27, with a focus on differences from the first embodiment. In the comb portion 10A of the second embodiment, open regions 10*a*2 in which the primary protrusions 12 are not disposed are formed. The open regions 10*a*2 hold a large amount of the mascara liquid 100 and a predetermined gap is formed by the primary protrusions 12 configuring the boundary of the open region 10*a*2. By having the eyelashes pass through the predetermined gaps in the plurality of primary protrusions 12, it is possible to apply the mascara liquid 100 to the eyelashes and comb the eyelashes.

The open regions 10*a*2 are configured as a plurality of respectively independent spaces. The open regions 10*a*2 are regions which include a center position in the orthogonal direction on the upper surface 10*a* and for which are defined boundaries in the axial and the orthogonal directions by a plurality of primary protrusions 12, and in which primary protrusions 12 are not disposed. Here, the center position in the orthogonal direction is a position through which the axis B passes.

The open regions 10*a*2 occupy an area larger than the area occupied by at least one rhombus structure S1 on the upper surface 10*a*. For this reason, an open region 10*a*2 can hold more mascara liquid 100 per unit area than a primary region 10*a*1.

The exposure ratio, which is the ratio of the area M2 to the area M1 (M2/M1), is defined as 0.85 or more and 0.97 or less. In the present embodiment, it is given that the area M1 is 105 $mm^2$ (square millimeters).

It is given that 159 primary protrusions 12 are disposed on the upper surface 10*a*, and the root cross-sectional radius of a primary protrusion 12 is 0.125 mm (millimeters). Then, since the cross-sectional area of the root of the primary protrusion 12 is 0.049 $mm^2$ (square millimeters) and there are 159 primary protrusions 12, the total cross-sectional area M3 is 7.791 $mm^2$ (square millimeters). According to Expression 1: M2=M1−M3, the exposed area M2 is 97.21 $mm^2$ (square millimeter). Also, the exposure ratio (M2/M1) is 0.93.

In addition, as illustrated in FIG. 26, the boundary of an open region 10*a*2 is defined by primary protrusions 12 so that both side surfaces of the eyelash 202 always pass through a gap between primary protrusions 12 in the orthogonal direction, allowing the eyelashes 202 to be combed. In other words, as illustrated in FIG. 26, in the open regions 10*a*2, the distance L3 between the primary protrusions 12*e*1 and 12*e*2 that are most separated in the orthogonal direction is configured to be equal to the distance L3 between the other primary protrusions 12. The distance L3 is the distance between the outer peripheral surfaces at the roots of adjacent primary protrusions 12.

As illustrated in FIG. 27, in an open region 10*a*2, the width w1 of the center position in the orthogonal direction is wider than the width w2 at the end portions in the orthogonal direction. In other words, an open region 10*a*2 is configured wider at a position relatively close to the axis B of the comb portion 10A than at a position relatively far from the axis B. For this reason, in the open region 10*a*2, the flow of the mascara liquid 100 in the orthogonal direction is restricted, and it is possible for more mascara liquid 100 to be held near the center in the orthogonal direction. As a result, when the mascara comb is pulled up from the container 102, the flow in the orthogonal direction is restricted, and more mascara liquid 100 is held on the upper surface 10*a*.

As described above, since no primary protrusions 12 are disposed in an open region 10*a*2, it is possible to hold more mascara liquid 100 per unit area than in a primary region 10*a*1 where primary protrusions 12 are disposed. Furthermore, since the boundaries are defined by primary protrusions 12 so that the mascara liquid 100 held in the open region 10*a*2 passes through the predetermined gap, it is possible for the mascara liquid 100 held to be applied to the eyelashes, and further the eyelashes be combed by the primary protrusions 12 defined by the boundaries.

Third Embodiment

A third embodiment will be described with reference to FIGS. 28 through 39, with a focus on differences from the first embodiment.

In the comb portion 10B of the third embodiment, a plurality of primary protrusions 12 and a plurality of secondary protrusions 14 are disposed on the upper surface 10*a*. The primary protrusion 12 is an example of a primary protrusion element, and the secondary protrusion 14 is an example of a secondary protrusion element. The primary protrusion 12 and the secondary protrusion 14 are in an overall elongated cone shape, with the apex and the apex vicinity configured as a spherical surface.

A plurality of primary protrusions 12 form primary protrusion rows BL1, and a plurality of secondary protrusions 14 form secondary protrusion rows BL2. On the upper surface 10*a*, a plurality of primary protrusion rows BL1 and a plurality of secondary protrusion rows BL2 are disposed parallel to each other. The primary protrusion row BL1 is an example of a primary protrusion element row, and the secondary protrusion row BL2 is an example of a secondary protrusion element row.

The comb portion 10 including primary protrusions 12 and secondary protrusions 14 is formed by injection molding of a plastic resin. The plastic resin may be, for example, polyethylene, polypropylene, or polyamide.

FIG. 29 is a schematic plan view of the comb portion 10B of FIG. 28 viewed from the arrow Z1 direction. The primary protrusions 12 and the secondary protrusions 14 illustrated in FIG. 29 illustrate a cross section at their roots. The cross-sectional diameter of a secondary protrusion 14 is larger than the cross-sectional diameter of a primary protrusion 12.

As illustrated in FIG. 29, the plurality of primary protrusions 12 are disposed on the upper surface 10*a* so that four primary protrusions 12 forma rhombus structure S1. The plurality of primary protrusions 12 and secondary protrusions 14 are disposed on the upper surface 10*a* so that a rhombus structure S2 is formed by two primary protrusions 12 and two secondary protrusions 14. A plurality of rhombus structures S1 and rhombus structures S2 are respectively disposed. A rhombus structure S1 shares each side with an adjacent rhombus structure S1. The rhombus structures S1 and S2 are rhombuses whose diagonal lines in the direction of the axis B of the comb portion 10 are longer than the diagonal lines in the orthogonal direction orthogonal thereto. A predetermined gap is formed by the rhombus structures S1. The predetermined gap is a gap that does not interfere with primary protrusions 12 and is a linear gap extending in the orthogonal direction; and is configured to apply the mascara liquid 100 to the eyelashes while combing the eyelashes. The rhombus structure S2 is also configured to forma predetermined gap that does not interfere with the primary protrusions 12 and the secondary protrusions 14.

In addition, since rhombus structures S1 and S2 are configured in a shape where the diagonal line in the axial direction of the comb portion 10 is longer than the diagonal line in the orthogonal direction, the rhombus structures S1 and S2 are velocity regulating portions which function as velocity regulating mechanisms to make the velocity with which the mascara liquid 100 flows in the axial direction slower than the velocity with which the mascara liquid 100 flows in the orthogonal direction, and are also holding portions having the function of holding the mascara liquid 100 within the rhombus structures S1 and S2 on the upper surface 10*a*.

In order to form the plurality of rhombus structures S1 and S2 described above, the plurality of primary protrusions 12 and secondary protrusions 14 are formed and disposed as follows.

As illustrated in FIG. 29, a primary protrusion row BL1 includes a plurality of primary protrusions 12. The primary protrusion row BL1 is configured such that the center positions in the cross section of the plurality of primary protrusions 12 are of equal length LC. A secondary protrusion row BL2 includes a plurality of secondary protrusions 14. The secondary protrusion row BL2 is configured such that the center positions in the cross section of the plurality of secondary protrusions 14 are arranged with the same length LC as the primary protrusion row BL1. As a result, the distance between the outer peripheral surfaces of the adjacent secondary protrusions 14 in a secondary protrusion row BL2 is shorter than the distance between the outer peripheral surfaces of the adjacent primary protrusions 12 in a primary protrusion row BL1.

A predetermined reference interval length C1 is defined for the distance of the center lines of adjacent primary protrusion rows BL1, and the distance of the center lines of adjacent primary protrusion rows BL1 and secondary protrusion rows BL2. The center line of the primary protrusion row BL1 is a line connecting the centers of the cross sections of the plurality of primary protrusions 12 forming the primary protrusion row BL1. The center line of the secondary protrusion row BL2 is a line connecting the centers of the cross sections of the plurality of secondary protrusions 14 forming the secondary protrusion row BL2. The length C1 of the reference interval is, for example, 1.2 mm (millimeters).

The primary protrusion row BL1 and the secondary protrusion row BL2 are disposed with a predetermined angle θ1 with respect to the axis B of the comb portion 10. The angle θ1 is an angle greater than 0 degrees and smaller than 45 degrees, desirably 25 degrees or more and less than 45 degrees, and in the present embodiment, it is 36 degrees. By having such an angle θ1, the movement of the mascara liquid 100 in the axial direction is restricted, and it is possible to configure a gap in the orthogonal direction for applying the mascara liquid 100 evenly to the eyelashes.

The plurality of primary protrusion rows BL1 are disposed in a state sandwiched between the secondary protrusion rows BL2. For example, four primary protrusion rows BL1 are sandwiched between two secondary protrusion rows BL2. The region inside the rhombus structure S1 or the rhombus structure S2 and sandwiched between two secondary protrusion rows BL2 is defined as an inner region 10*aa*. The movement of the mascara liquid 100 held in the inner region 10*aa* toward the outside is restricted in the axial direction by the secondary protrusion row BL2.

FIG. 30 is a schematic view of the primary protrusion and the secondary protrusion 14 located at the same position in the axial direction, for example, at the center portion of the comb portion 10B, as viewed from the side. As illustrated in FIG. 30, the primary protrusion 12 and the secondary protrusion 14 have the same height h2. The diameter of a secondary protrusion 14 is larger than the diameter of a primary protrusion 12. The diameter 14*d*1 of the root portion of the secondary protrusion 14 is larger than the diameter 12*d*1 of the root portion of the primary protrusion 12, and the diameter 14*d*2 near the apex of the secondary protrusion 14 is larger than the diameter 12*d*2 near the apex of the primary protrusion 12. For example, the height h2 is 1.5 mm (millimeters), the diameter 14*d*1 is 0.3 mm, the diameter 14*d*2 is 0.26 mm, the diameter 12*d*1 is 0.25 mm, and the diameter 12*d*2 is 0.17 mm.

The primary protrusion 12 and the secondary protrusion 14 are formed in a shape in which the cross-sectional diameter decreases from the root portion toward the vicinity of the apex portion. The reduction rate of the cross-sectional diameter from the root portion of the secondary protrusion 14 toward the apex vicinity is smaller than the reduction rate of the cross-sectional diameter from the root portion of the primary protrusion 12 toward the apex vicinity. For example, the ratio of the diameter 14*d*2 near the apex to the diameter 14*d*1 of the root portion of the secondary protrusion 14 is 0.87, and the ratio of the diameter 12*d*2 near the apex to the diameter 12*d*1 of the root portion of the primary protrusion 12 is 0.68. For this reason, the secondary protrusion 14 not only restricts the movement of the mascara liquid 100 in the axial direction at the root portion, but also effectively restricts the movement of the mascara liquid 100 in the axial direction at a portion from the root portion to the apex vicinity.

As illustrated in FIG. 31, an inner region 10*aa* is formed as a region sandwiched between the secondary protrusion rows BL2 on the upper surface 10*a*. Since the primary protrusion 12 has a smaller root diameter than the secondary protrusion 14, a relatively large area of the upper surface 10*a* is exposed per unit area in the inner region 10*aa*. The inner region 10*aa* is a main region for holding the mascara liquid 100. The secondary protrusion row BL2, by restricting the movement of the mascara liquid 100 in the axial direction, allows the mascara liquid 100 to be effectively held by the inner region 10*aa*.

On the upper surface 10*a*, for example, 162 primary protrusions 12 and 40 secondary protrusions 14 are disposed. The exposure ratio, which is the ratio (M2/M1) of the exposed region M2 of the region where the primary protrusion 12 and the secondary protrusion 14 do not exist with respect to the upper surface area M1, is defined as 0.85 or more and 0.97 or less. In the present embodiment, the area M1 is given as 123 $mm^2$ (square millimeters). Since the cross-sectional area of the root of the primary protrusion 12 is 0.049 $mm^2$ (square millimeters), the total cross-sectional area M3 is 7.94 $mm^2$ (square millimeters). Since the cross-sectional area of the root of the secondary protrusion 14 is 0.071 $mm^2$ (square millimeters) and there are 40 secondary protrusions 14, the total cross-sectional area M4 is 2.84 $mm^2$ (square millimeters). Accordingly, the exposed area M2 is 112.22 $mm^2$ (square millimeters). In addition, the exposure ratio (M2/M1) is 0.91.

Hereinafter, the movement of the mascara liquid 100 on the upper surface 10*a* of the comb portion 10B when the mascara comb 1 is pulled out from the container 102 will be described while referencing FIG. 32 and FIG. 33.

In the inner region 10*aa*, the primary protrusion 12 is disposed, which provides resistance against the flow of the mascara liquid 100. As illustrated in FIG. 32, in the inner region 10*aa*, the presence of the primary protrusion 12 becomes a resistance, and the mascara liquid 100 flows downward while meandering slowly as indicated by the arrow W1.

Since the secondary protrusion 14 has a larger diameter than the primary protrusion 12, the resistance to the flow of the mascara liquid 100 in contact with the secondary protrusion row BL2 is larger than the resistance in the inner region 10*aa*, and the movement of the mascara liquid 100 becomes more sluggish. As a result, the mascara liquid 100 adhering to the upper surface 10*a* becomes easily held in the inner region 10*aa*.

The primary protrusions 12 and the secondary protrusions 14 form primary protrusion rows BL1 and secondary protrusion rows BL2, and as illustrated in FIG. 33, also form rhombus structures S1 and S2. That is, the primary protrusions 12 and secondary protrusions 14 are disposed forming multiple rhombus structures S1 and S2. The rhombus structures S1 and S2 form a structure for holding the mascara liquid 100 on the upper surface 10*a* and for combing the eyelashes 202.

As illustrated in FIG. 33, the rhombus structure S1 is formed by four primary protrusions 12. Adjacent primary protrusion rows BL1 are referred to as a primary protrusion row BL11 and a primary protrusion row BL12 (not shown) for convenience. The primary protrusions 12 are disposed on the upper surface 10*a* such that a rhombus structure S1 is formed by two adjacent primary protrusions 12 in the primary protrusion row BL11 and two adjacent primary protrusions 12 in the primary protrusion row BL12 facing the two primary protrusions 12.

A rhombus structure S2 is formed by two primary protrusions 12 and two secondary protrusions 14. The primary protrusions 12 and the secondary protrusions 14 are disposed on the upper surface 10*a* such that a rhombus structure S2 is formed at adjacent primary protrusion row BL1 and secondary protrusion row BL2 by two adjacent primary protrusions 12 in the primary protrusion row BL1 and two adjacent secondary protrusions 14 in the secondary protrusion row BL2 facing the two primary protrusions 12.

As illustrated in FIGS. 32 and 33, in the rhombus structures S1 and S2, the diagonal line in the axial direction is longer than the diagonal line in the orthogonal direction. For this reason, the distance in the orthogonal direction is shorter than the distance in the axial direction between adjacent primary protrusions 12, between a primary protrusion 12 and a secondary protrusion 14, and between adjacent secondary protrusions 14. As a result, the resistance upon the flow of the mascara liquid 100 in the axial direction increases, effectively holding the mascara liquid 100 in the inner region 10*aa*.

In the rhombus structures S1 and S2, the distance in the orthogonal direction between the centers of the cross sections of the adjacent primary protrusion 12 and secondary protrusion 14 is the distance L1 in each case. Since the diameter 12*d*1 of the root portion of the primary protrusion 12 is smaller than the diameter 14*d*1 (see FIG. 30) of the root portion of the secondary protrusion, the distance wv2 between the outer periphery of the primary protrusion 12 and the outer periphery of the secondary protrusion 14 in the rhombus structure S2 is shorter than the distance wv1 in the orthogonal direction between the outer peripheries of the primary protrusions 12 in the rhombus structure S1. In addition, the distance wv3 between the outer peripheries of the secondary protrusions 14 in the rhombus structure S2 is shorter than the distance wv2. In other words, the primary protrusions 12 and the secondary protrusions 14 are disposed such that the Expression 4: wv3<wv2<wv1 is established.

As for the resistance to the flow of the mascara liquid 100 toward the arrow Y2 direction (downward) illustrated in FIG. 33, the resistance in the inner region 10*aa* is given as a resistance $\alpha 1$, the resistance at the boundary between the inner region 10*aa* and the secondary protrusion row BL2 is given as a resistance $\alpha 2$, and the resistance at the secondary protrusion row BL2 is given as a resistance $\alpha 3$. As described above, since Expression 4 is satisfied, the resistance $\alpha 3$ is larger than the resistance $\alpha 2$, and the resistance $\alpha 2$ is larger than the resistance $\alpha 1$. That is, Expression 5: $\alpha 1<\alpha 2<\alpha 3$ is established.

Since the primary protrusions 12 and the secondary protrusions 14 are disposed so that the above-described Expression 5 is satisfied, the resistance upon the mascara liquid 100 heading in the direction of the arrow Y2 increases as it heads downward. In other words, the primary protrusion 12 and the secondary protrusion 14 are configured to provide an incrementally larger resistance upon the downward flow of the mascara liquid 100. As a result, since the mascara liquid 100 arrives at the secondary protrusion 14 having been decelerated by the resistance $\alpha 1$ and the resistance $\alpha 2$, it is possible to more effectively restrict the downward flow of the mascara liquid 100. Furthermore, in the first embodiment, as described while referencing FIG. 6, by configuring the height of the primary protrusions 12 and/or the secondary protrusions 14 so that it increases from the center of the comb portion 10B toward the sides (outside), and configuring the cross-sectional area in a side view occurring at a predetermined height (for example, the height h1 in FIG. 6) to increase as the height of the primary protrusions 12 and/or secondary protrusions 14 increases, since a large resistance will develop downward along the axial direction, it becomes possible to more effectively restrict the downward flow of the mascara liquid 100.

Next, a configuration for combing the eyelashes 202 with the comb portion 10B will be described in detail while referencing FIG. 34 through FIG. 36. As illustrated in FIGS. 34 and 35, the primary protrusions 12 and the secondary protrusions 14 are linearly disposed in the orthogonal direction and configure a plurality of straight lines BC1. A plurality of linear gaps F1 extending in the orthogonal direction are formed between the straight lines BC1, and by passing the eyelashes 202 through the gap F1, the mascara liquid 100 is applied to the entirety and they are combed.

As described above, the primary protrusions 12 and the secondary protrusions 14 are disposed forming multiple rhombus structures S1 and S2. As illustrated in FIG. 36, in the rhombus structures S1 and S2, the distance in the axial direction between the centers of the cross sections of adjacent primary protrusions 12 and secondary protrusions 14 is the distance L2 for each.

As illustrated in FIG. 36, the distance L2 is longer than twice the radius of the cross section of the primary protrusion 12. As a result, a gap F1 having a distance wh1 is formed between the primary protrusions 12. The distance L2 is longer than twice the radius of the cross section of the secondary protrusion 14. As a result, a gap having a distance wh2 is formed between the secondary protrusions 14. The distance L2 is larger than the sum of the radius of the cross section of the primary protrusion 12 and the radius of the cross section of the secondary protrusion 14. As a result, a gap having a distance wh3 is formed between the primary protrusion 12 and the secondary protrusion 14. As a result, a gap F1 in the orthogonal direction is formed between the primary protrusions 12, between the secondary protrusions 14, and between the primary protrusion 12 and the secondary protrusion 14.

The distance L2 is, for example, 0.6 mm, the distance wh1 is 0.35 mm, the distance wh2 is 0.300 mm, and the distance wv3 is 0.325 mm.

As described above, the primary protrusion row BL1 and the secondary protrusion row BL2 are disposed with a predetermined angle $\theta 1$ with respect to the axis B of the comb portion 10B. The angle $\theta 1$ is defined so as to produce the above-described gap F1 based on the equally spaced length LC and the radii of the primary protrusion 12 and the secondary protrusion 14.

If the equally spaced length LC is determined, the angle $\theta 1$ with respect to the axial direction of the primary protrusion row BL1 and the secondary protrusion row BL2 is defined so as to form the gap F1 described above. The angle $\theta 1$ is also an angle with respect to the axial direction of the sides of the rhombus structures S1 and S2.

If the radius of the primary protrusion 12 is given as R12 and the radius of the secondary protrusion 14 is given as R14, the angle $\theta 1$ is defined so as to satisfy Expression 2: $LC \cdot \cos \theta 1 > R12 \times 2$, Expression 6: $LC \cdot \cos \theta 1 > R14 \times 2$, and Expression 7: $LC \cdot \cos \theta 1 > R12 + R14$. In other words, the angle $\theta 1$ is defined by the equally spaced length LC and the radii R12 and R14. Note that the distance L2 is obtained by Expression 3: $L2 = LC \cdot \cos \theta 1$. As a result, when Expressions 2, 6 and 7 are modified, they become Expression 2A: $L2 > R12 \times 2$, Expression 6A: $L2 > R14 \times 2$, and Expression 7A: $L2 > R12 + R14$.

Since the direction in which the secondary protrusion row BL2 extends approaches the orthogonal direction as the angle $\theta 1$ satisfying the above-mentioned Expressions 2, 6, and 7 approaches 90 degrees, the variation in the disposition of the secondary protrusions 14 in the axial direction becomes smaller. Then, when the plurality of eyelashes 202 pass through the gap, there is a large difference between the number of eyelashes 202 passing only between the primary protrusions 12 and the number of eyelashes 202 passing between the primary protrusions 12 and the secondary protrusions 14, preventing the mascara liquid 100 from being evenly applied across the plurality of eyelashes 202.

On the other hand, while the variation in the disposition of the secondary protrusions 14 in the axial direction increases as the predetermined angle $\theta 1$ approaches 0 degrees, the gap F1 becomes too large.

In this regard, in the comb portion 10B, since the primary protrusion row BL1 and the secondary protrusion row BL2 are disposed with the above-described angle $\theta 1$ with respect to the axial direction of the comb portion 10B, it is possible to effectively restrict the flow of the mascara liquid 100 in the axial direction as well as appropriately limit the variation of the secondary protrusions 14 in the axial direction and the difference in the number of eyelashes 202 passing between only the primary protrusions 12 and the eyelashes 202 passing also between the primary protrusions 12 and the secondary protrusions 14, and since it is possible to form the appropriate gap F1, the mascara liquid 100 can be applied to an appropriate extent evenly to the plurality of eyelashes 202.

As described above, the configuration having the rhombus structures S1 and S2 is a configuration for providing holding force for holding the mascara liquid 100 in the inner region 10*aa* and the secondary protrusion row BL2, and for applying the mascara liquid 100 evenly to the eyelashes 202.

The state of applying the mascara liquid 100 to an eyelash 202, extending the mascara liquid 100 with the comb portion 10B, and combing the eyelash 202 will be described while referencing FIG. 37 through FIG. 39. As illustrated in FIG. 37, when the end portion 10*a*11 of the upper surface 10*a* is pressed against the root of the eyelash 202, the mascara liquid 100 adheres to the root of the eyelash 202. In addition, when the comb portion 10B is moved in the direction of the arrow X1 while being slightly rotated, as illustrated in FIG. 38 and FIG. 39, the mascara liquid 100 is applied to the entire eyelash 202, and also the eyelash 202 is combed passing through gap F1 (see FIG. 36) and coming into contact with the primary protrusion 12 and the secondary protrusion 14.

Fourth Embodiment

A fourth embodiment will be described with reference to FIGS. 40 through 42, with a focus on differences from the third embodiment.

In the comb portion 10C of the fourth embodiment, an inner region 10*aa* is a region inside the rhombus structure S1 or the rhombus structure S2, and is a region sandwiched between two secondary protrusion rows BL2.

In the inner region 10*aa*, an open region 10*a*4 in which neither primary protrusions 12 nor secondary protrusions 14 are disposed is formed. The open region 10*a*4 is configured so as to hold a large amount of the mascara liquid 100, and the primary protrusions 12 and/or the secondary protrusions 14 configuring the boundary of the open region 10*a*4 are configured so as to make it possible to apply the mascara liquid 100 to the eyelashes and comb the eyelashes.

The open regions 10*a*4 are configured as a plurality of respectively independent spaces. The open regions 10*a*4 are regions on the upper surface 10*a* which include a center position in the orthogonal direction and having boundaries defined in the axial direction and the orthogonal direction by a plurality of primary protrusions 12 and/or secondary protrusions 14, and are regions where primary protrusions 12 and/or secondary protrusions 14 are not disposed. Here, a center position in the orthogonal direction is a position through which the axis B passes.

Since the open region 10*a*4 is a region where primary protrusions 12 and/or secondary protrusions 14 do not exist, more mascara liquid 100 can be held per unit area than the primary region 10*a*1.

As illustrated in FIG. 41 and FIG. 42, in the comb portion 10C of the fourth embodiment, a portion of the position where the primary protrusion 12 is disposed in the comb portion 10B of the third embodiment becomes an exposed region. As a result, as illustrated in FIG. 42, the exposed area is larger in the inner region 10*aa*, and more mascara liquid 100 can be held per unit area.

In the upper surface 10*a*, for example, 140 primary protrusions 12 and 40 secondary protrusions 14 are disposed. The exposure ratio, which is the ratio (M2/M1) of the exposed area M2 of the region where primary protrusions 12 and secondary protrusions 14 do not exist with respect to the upper surface area M1, is given as 0.85 or more and 0.97 or less. In the present embodiment, the area M1 is given as 123 $mm^2$ (square millimeters). Since the cross-sectional area of the root of the primary protrusion 12 is 0.049 $mm^2$ (square millimeters), the total cross-sectional area is 6.86 $mm^2$ (square millimeters). Since the cross-sectional area of the root of the secondary protrusion 14 is 0.071 $mm^2$ (square millimeters) and there are 40 secondary protrusions 14, the total cross-sectional area is 2.84 $mm^2$ (square millimeters). Then, the total M3 of the cross-sectional areas of the primary protrusions 12 and the secondary protrusions 14 is 9.7 $mm^2$ (square millimeters). Accordingly, the exposed area M2 is 113.3 $mm^2$ (square millimeters). In addition, the exposure ratio (M2/M1) is 0.92.

Further, as illustrated in FIG. 42, it is configured such that at any position in the axial direction, both side surfaces of an eyelash 202 must always pass in the orthogonal direction between primary protrusions 12 or between secondary protrusions 14, making it possible to comb the eyelashes 202.

Fifth Embodiment

A fifth embodiment will be described with reference to FIGS. 43 through 45, with a focus on differences from the fourth embodiment.

In the comb portion 10D of the fifth embodiment, an inner region 10*ab* is formed. Similar to the inner region 10*aa* of the fourth embodiment, the inner region 10*ab* is an inner region of the rhombus structure S1 or the rhombus structure S2, and is a region sandwiched between the two secondary protrusion rows BL2. However, the inner region 10*ab* is longer in the axial direction and has a larger area than the inner region 10*aa* (see FIG. 42) of the fourth embodiment.

In the inner region 10*ab*, an open region 10*a*5 in which neither primary protrusions 12 nor secondary protrusions 14 are disposed is formed. The open region 10*a*5 is longer in the axial direction and has a larger area than the open region 10*a*4 of the fourth embodiment. The open region 10*a*5 holds a large amount of the mascara liquid 100, and the primary protrusions 12 configuring the boundary of the open region 10*a*5 are configured to apply the mascara liquid 100 to the eyelashes and to comb the eyelashes.

The open region 10*a*5 is configured as a plurality of respectively independent spaces. The open regions 10*a*5 are regions on the upper surface 10*a* which include a center position in the orthogonal direction and having boundaries in the axial direction and the orthogonal direction defined by the plurality of primary protrusions 12 and/or the secondary protrusions 14, and are regions where neither primary protrusions 12 nor secondary protrusions 14 are disposed. Here, a center position in the orthogonal direction is a position through which the axis B passes.

In the upper surface 10*a*, for example, 140 primary protrusions 12 and 22 secondary protrusions 14 are disposed. The exposure ratio, which is the ratio (M2/M1) of the exposed area M2 of the region where primary protrusions 12 and secondary protrusions 14 do not exist with respect to the upper surface area M1, is given as 0.85 or more and 0.97 or less. In the present embodiment, the area M1 is given as 123 $mm^2$ (square millimeters). Since the cross-sectional area of the root of the primary protrusion 12 is 0.049 $mm^2$ (square millimeters) and there are 140 primary protrusions 12, the total cross-sectional area is 6.86 $mm^2$ (square millimeters). Since the cross-sectional area of the root of the secondary protrusion 14 is 0.071 $mm^2$ (square millimeters) and there are 22 secondary protrusions 14, the total cross-sectional area is 1.56 $mm^2$ (square millimeters). Then, the total M3 of the cross-sectional areas of the primary protrusion 12 and the secondary protrusion 14 is 8.42 $mm^2$ (square millimeters). Accordingly, the exposed area M2 is 114.58 $mm^2$ (square millimeters). In addition, the exposure ratio (M2/M1) is 0.93.

Further, as illustrated in FIGS. 44 and 45, it is configured such that at any position in the axial direction, both side surfaces of an eyelash 202 must always pass in the orthogonal direction between primary protrusions 12 or between secondary protrusions 14, making it possible to comb the eyelashes 202.

Sixth Embodiment

A sixth embodiment will be described with reference to FIGS. 46 and 47, with a focus on differences from the first embodiment. In a comb portion 10E of the sixth embodiment, an open region 10*a*6 (see FIG. 47) in which primary protrusions 12 are not disposed is formed. It is configured such that the open region 10*a*6 holds a large amount of the mascara liquid 100, and the primary protrusions 12 configuring the boundary of the open region 10*a*6 can apply the mascara liquid 100 to the eyelashes and comb the eyelashes.

As illustrated in FIG. 47, in the comb portion 10E of the sixth embodiment, an open region 10*a*6 is formed. The open region 10*a*6 has boundaries in the axial direction and the orthogonal direction defined by the primary protrusions 12 and is configured as a single space. The open region 10*a*6 is a region on the upper surface 10*a* which includes a center position in the orthogonal direction, and having boundaries in the axial direction and the orthogonal direction defined by a plurality of primary protrusions 12, and is a region where primary protrusions 12 are not disposed.

In the open region 10*a*6, while rhombus structures S1 are formed in the regions E1 and E3, no rhombus structures are formed in the region E2. As a result, it is possible to enlarge the area in the orthogonal direction of the open region 10*a*6. Unlike the present embodiment, the rhombus structures S1 may also be formed in the region E2.

Since the open region 10*a*6 is a region where no primary protrusions 12 exist, it is able to hold more mascara liquid 100 per unit area than the primary region 10*a*1.

As illustrated in FIG. 47, the boundaries of the open region 10*a*6 are defined by the primary protrusions 12 so that both side surfaces of the eyelash 202 must always pass through the gap between the primary protrusions 12 in the orthogonal direction, making it possible to comb the eyelashes 202.

As illustrated in FIG. 47, the gap indicated by the arrow F2 near the center portion in the axial direction is larger than the gap indicated by the arrow F1. As a result, when applying the mascara liquid 100, the flow of the mascara liquid 100 in the center portion vicinity is made comparatively fast, and it is possible to apply more mascara liquid to the eyelashes as well comb the eyelashes.

Modification of the Sixth Embodiment (Reference Example)

A modification of the sixth embodiment does not include the rhombus structures S1. In other words, in the sixth embodiment, the mode in which the primary protrusions 12 are disposed does not form the rhombus structures S1. Specifically, unlike the rhombus structures S1, the rhombus structures may be those in which the length in the axial direction is shorter than the length in the orthogonal direction, or the rhombus structures may be those in which the length in the axial direction is equal to the length in the orthogonal direction. Alternatively, the configuration may have, for example, only the region E2 of FIG. 47, and not have any rhombus structures at all.

Seventh Embodiment

A seventh embodiment will be described with reference to FIGS. 48 and 49, with a focus on differences from the sixth embodiment. In a comb portion 10F of the seventh embodiment, an open region 10*a*7 (see FIG. 49) in which no primary protrusions 12 are disposed is formed. It is configured such that the open region 10*a*7 holds a large amount of the mascara liquid 100, and the primary protrusions 12 configuring the boundary of the open region 10*a*7 can apply the mascara liquid 100 to the eyelashes and comb the eyelashes.

As illustrated in FIG. 49, an open region 10*a*7 is formed in a comb portion 10F of the seventh embodiment. The open region 10*a*7 has boundaries in the axial direction and the orthogonal direction defined by the primary protrusions 12 and is configured as a single space. The open region 10*a*7 is a region on the upper surface 10*a* which includes a center position in the orthogonal direction and having boundaries defined in the axial direction and the orthogonal direction by a plurality of primary protrusions 12; and is a region where no primary protrusions 12 are disposed.

In the open region 10*a*7, there are formed wide width portions A1, A3, and A5 having relatively wide widths in the orthogonal direction and narrow width portions A2 and A4 having relatively narrow widths, with the wide width portions and narrow width portions formed alternatingly. When the mascara liquid 100 flows from a wide width portion to a narrow width portion, the speed decreases. In addition, when the respective vicinities of the center position in the orthogonal direction of, for example, the wide width portion A1 and the narrow width portion A2 are connected, arrows B1 to B5 are obtained. The trajectory formed by the arrows B1 to B5 is not linearly continuous but is bent. For this reason, the speed with which the mascara liquid flows decreases compared with the case where the trajectory configured by the arrows B1 to B5 is linear.

With the above configuration, more mascara liquid 100 can be held in the open region 10*a*7.

Further, as illustrated in FIG. 49, the boundary of the open region 10*a*7 is defined by the primary protrusions 12 such that both side surfaces of an eyelash 202 must always pass in the orthogonal direction through the gap between the primary protrusions 12, making it possible to comb the eyelashes 202.

As illustrated in FIG. 49, a gap indicated by an arrow F1 is formed at any position in the axial direction. As a result, it is possible to apply more mascara liquid to the eyelashes and comb the eyelashes.

Modification of the Seventh Embodiment (Reference Example)

A modification of the seventh embodiment does not include the rhombus structures S1. In other words, in the seventh embodiment, the mode in which the primary protrusions 12 are disposed does not form the rhombus structures S1. Specifically, unlike the rhombus structures S1, the rhombus structures may be those in which the length in the axial direction is shorter than the length in the orthogonal direction, or the rhombus structures may be those in which the length in the axial direction is equal to the length in the orthogonal direction. Alternatively, the configuration may have, for example, no rhombus structures at all.

The mascara comb of the present invention is not limited to the above embodiments, and various modifications can be made without departing from the scope of the present invention.

REFERENCE SIGNS LIST

1 Mascara Comb
10, 10A, 10B, 10C, 10D, 10E, 10F Comb Portion
10*a* Upper Surface
10*a*1 Primary Region
10*a*2, 10*a*4, 10*a*5, 10*a*6, 10*a*7 Open Region
10*aa* Inner Region
12 Primary Protrusion
14 Secondary Protrusion BL1 Primary Protrusion Row
BL2 Secondary Protrusion Row
50 Rod
70 Grip member
100 Mascara Liquid
102 Container
202 Eyelash(es)

The invention claimed is:

1. A mascara comb for applying mascara liquid to user's eyelashes and combing the eyelashes, comprising a comb portion having an upper surface formed as a convex-shaped curved surface having a first curvature radius, a first curvature edge and a second curvature edge, and a lower surface having a second curvature radius smaller than the first curvature radius of the upper surface, a third curvature edge and a fourth curvature edge, the first curvature edge contacting the third curvature edge and the second curvature edge contacting the fourth curvature edge; wherein on the upper surface a plurality of protrusion elements are disposed so as to form multiple rhombus structures;

when a deviation distance from the upper surface is given as a height, a cross-section of each of the protrusion elements in a direction orthogonal to the height direction forms a circle;

each of the rhombus structures is configured so as to form a rhombus with a diagonal line in an axial direction of the comb portion longer than a diagonal line in an orthogonal direction orthogonal thereto, and a linear gap extending in the orthogonal direction, for applying the mascara liquid to the eyelashes while combing the eyelashes;

further, the rhombus structures are a velocity adjustment portion functioning as a velocity adjustment mechanism for making the velocity with which mascara liquid flows in the axial direction slower than the velocity with which the mascara liquid flows in the orthogonal direction; and in the upper surface, the inside of the rhombus structures is a holding portion having a function of holding the mascara liquid;

a plurality of the protrusion elements include a primary protrusion element and a secondary protrusion element having a cross-sectional diameter larger than the cross-sectional diameter of the primary protrusion element;

the primary protrusion element and the secondary protrusion element are disposed on the upper surface such that a region in which a plurality of the primary protrusion elements are disposed is sandwiched by a secondary protrusion element row configured by disposing the secondary protrusion elements; and a region sandwiched by the secondary protrusion element row is a velocity decreasing portion having a function of reducing the velocity with which the mascara flows in the axial direction; and the diameter reduction rate of the cross-sectional diameter of the secondary protrusion elements is defined as smaller than the diameter reduction rate of the cross-sectional diameter of the primary protrusion elements.

2. The mascara comb according to claim 1, wherein a distance between the centers of the cross-sections of two of the protrusion elements adjacent in the orthogonal direction is the same regarding all of the protrusion elements, the protrusion element is formed in a shape which decreases in diameter from the root portion as it approaches the apex vicinity portion;

further, the protrusion element is configured such that the height of the protrusion element increases, and the reduction rate of the diameter of the protrusion elements decreases from the center portion toward the sides in the axial direction; and a plurality of the protrusion elements configure a velocity tapering mechanism for gradually reducing the velocity with which the mascara liquid flows in the axial direction.

3. The mascara comb according to claim 1, wherein the surface roughness of the protrusion elements is configured to be relatively small in relation to the surface roughness of the upper surface.

4. A mascara comb for applying mascara liquid to user's eyelashes and combing the eyelashes, comprising a comb portion having an upper surface formed as a convex-shaped curved surface having a first curvature radius, a first curvature edge and a second curvature edge, and a lower surface having a second curvature radius smaller than the first curvature radius of the upper surface, a third curvature edge and a fourth curvature edge, the first curvature edge contacting the third curvature edge and the second curvature edge contacting the fourth curvature edge; wherein on the upper surface a plurality of protrusion elements are disposed so as to form multiple rhombus structures;

when a deviation distance from the upper surface is given as a height, a cross-section of each of the protrusion elements in a direction orthogonal to the height direction forms a circle;

each of the rhombus structures is configured so as to form a rhombus with a diagonal line in an axial direction of the comb portion longer than a diagonal line in an orthogonal direction orthogonal thereto, and a linear gap extending in the orthogonal direction, for applying the mascara liquid to the eyelashes while combing the eyelashes;

further, the rhombus structures are a velocity adjustment portion functioning as a velocity adjustment mechanism for making the velocity with which mascara liquid flows in the axial direction slower than the velocity with which the mascara liquid flows in the orthogonal direction; and in the upper surface, the inside of the rhombus structures is a holding portion having a function of holding the mascara liquid;

an open region where none of the protrusion elements are disposed is formed on the upper surface, includes a center position in the orthogonal direction, has boundaries in the axial direction and the orthogonal direction defined by a plurality of the protrusion elements, and encompasses an area larger than the area encompassed on the upper surface by at least one of the rhombus structures; and the linear gap for applying the mascara liquid to the eyelashes while combing the eyelashes is formed by the protrusion elements defining the boundaries, and the eyelashes is capable to come into contact with the open region pass through the linear gap;

the open region is configured from a plurality of portion regions;

the portion regions have disposed alternatingly a region with a relatively wide width in the orthogonal direction and a region with a relatively narrow width; and a linear segment connecting center portion vicinity locations in the orthogonal direction bends.

* * * * *